United States Patent [19]

Bain et al.

[11] Patent Number: 4,778,586

[45] Date of Patent: Oct. 18, 1988

[54] VISCOSITY REDUCTION PROCESSING AT ELEVATED PRESSURE

[75] Inventors: Richard L. Bain, Golden; John R. Larson, Boulder; Dennis D. Gertenbach, Golden; Daniel W. Gillespie, Wheatridge; Joseph J. Leto, Broomfield, all of Colo.

[73] Assignee: Resource Technology Associates, Boulder, Colo.

[21] Appl. No.: 58,881

[22] Filed: Jun. 5, 1987

Related U.S. Application Data

[63] Continuation-in-part of Ser. No. 771,205, Aug. 30, 1985, abandoned.

[51] Int. Cl.[4] ..... C10G 9/14; C10G 9/00

[52] U.S. Cl. ..... 208/132; 137/13; 165/45; 196/110; 208/106; 208/125

[58] Field of Search ..... 208/106, 125, 131, 132; 196/110; 137/13; 165/45

[56] References Cited

U.S. PATENT DOCUMENTS

| | | | |
|---|---|---|---|
| 1,479,653 | 1/1924 | Davidson | 196/65 |
| 1,828,691 | 10/1931 | Stransky et al. | 196/65 |
| 2,135,332 | 11/1938 | Gary | 196/62 |
| 2,160,814 | 6/1939 | Arveson | 196/50 |
| 2,293,421 | 8/1942 | Baetz | 196/110 |
| 2,587,703 | 3/1952 | Deansely | 196/65 |
| 2,651,601 | 9/1953 | Taff et al. | 196/73 |
| 2,695,264 | 11/1954 | Taff et al. | 196/50 |
| 2,752,407 | 6/1956 | Cahn | 266/683 |
| 2,818,419 | 12/1957 | McKinley et al. | 260/451 |
| 2,844,452 | 7/1958 | Hasche | 48/196 |
| 2,862,870 | 12/1958 | Voorhies | 208/56 |
| 2,900,327 | 8/1959 | Beuther | 208/106 |
| 2,937,987 | 5/1960 | Jenkins | 208/108 |
| 2,981,747 | 4/1961 | Lang et al. | 260/451 |
| 3,156,642 | 11/1964 | Trantham et al. | 208/120 |
| 3,170,863 | 2/1965 | Spillane et al. | 208/3 |

(List continued on next page.)

FOREIGN PATENT DOCUMENTS

| | | |
|---|---|---|
| 1184523 | 3/1985 | Canada . |
| 1189011 | 6/1985 | Canada . |
| 420650 | 3/1974 | U.S.S.R. . |

OTHER PUBLICATIONS

"Conversion of Petroleum", A. N. Sachanen, D. Sc., Reinhold Publishing Corporation, New York, 1948.

"Visbreaking . . . Still the Basic Process for Fuel Reduction", M. G. Boone and D. F. Ferguson, The Oil and Gas Journal, Mar. 22, 1954.

"Visbreaking: A Flexible Process", A. Rhoe and C. de Blignieres, Hydrocarbon Processing, Jan. 1979.

"Visbreaking: More Feed for FCC", R. Hournac, J. Kunn and M. Notarbartolo, Hydrocarbon Processing, Dec. 1979.

"Visbreaking Process has Strong Revival", Martin Hus, Technology Oil and Gas Journal, Apr. 13, 1981, vol. 79.

"Rebuilding Hydrocarbons", W. L. Nelson, Petroleum Refinery Engineering, 4th Ed., McGraw-Hill Book Company, Inc., 1958.

*Primary Examiner*—Paul E. Konopka

*Attorney, Agent, or Firm*—Sheridan, Ross & McIntosh

[57] ABSTRACT

A method is disclosed for improving the transportability of a hydrocarbon composition by passing an influent feed stream of composition into a downcomer to provide a hydrostatic column of fluid. The influent stream is heated by heat exchange with an effluent product stream wherein at least one of the streams is in turbulent flow. The feed stream is pressurized by the hydrostatic pressure head to a reaction pressure of at least about 1000 psi. The heated and pressurized feed stream is contacted with an active heat source in a reaction zone to increase the temperature of the feed stream to a reaction temperature of between about 300° C. and the coking temperature of the hydrocarbon composition. The temperature differential between the active heat source and the feed stream in the reaction zone is maintained at less than about 30° C. to provide a treated effluent stream which is brought into heat exchange contact with the influent stream. The treated composition has a lower viscosity than the feed composition.

28 Claims, 1 Drawing Sheet

U.S. PATENT DOCUMENTS

| | | | |
|---|---|---|---|
| 3,306,839 | 2/1967 | Vaell | 208/59 |
| 3,310,109 | 3/1967 | Marx et al. | 166/7 |
| 3,320,154 | 5/1967 | Tokuhisa et al. | 208/130 |
| 3,412,011 | 11/1968 | Lindsay | 208/113 |
| 3,439,741 | 4/1969 | Parker | 166/372 |
| 3,442,333 | 5/1969 | Meldau | 166/272 |
| 3,523,071 | 8/1970 | Knapp et al. | 208/14 |
| 3,738,931 | 6/1973 | Frankovich et al. | 208/67 |
| 3,767,564 | 10/1973 | Youngblood et al. | 208/92 |
| 3,775,296 | 11/1973 | Chervenak et al. | 208/108 |
| 3,803,259 | 4/1974 | Porchey et al. | 208/106 |
| 3,948,755 | 4/1976 | McCollum et al. | 208/113 |
| 3,989,618 | 11/1976 | McCollum et al. | 208/208 R |
| 4,042,487 | 8/1977 | Seguchi et al. | 208/48 R |
| 4,089,340 | 5/1978 | Smith et al. | 137/13 |
| 4,248,306 | 2/1981 | VanHuisen et al. | 166/305 R |
| 4,252,634 | 2/1981 | Knulbe et al. | 208/48 R |
| 4,298,457 | 11/1981 | Oblad et al. | 208/107 |
| 4,334,976 | 6/1982 | Yan | 208/8 |
| 4,354,922 | 10/1982 | Derbyshire et al. | 208/68 |
| 4,379,747 | 4/1983 | Yan | 208/251 H |
| 4,428,828 | 1/1984 | Bose | 208/208 R |
| 4,432,864 | 2/1984 | Myers et al. | 208/120 |
| 4,448,665 | 5/1984 | Zaczepinski et al. | 208/8 |
| 4,460,012 | 5/1984 | Murthy et al. | 208/130 |
| 4,465,584 | 8/1984 | Effron et al. | 208/56 |
| 4,469,587 | 9/1984 | Tailleur et al. | 208/61 |
| 4,478,705 | 10/1984 | Ganguli | 208/59 |
| 4,481,101 | 11/1984 | Yan | 208/50 |
| 4,508,614 | 4/1985 | Yan | 208/78 |
| 4,560,467 | 12/1985 | Stapp | 208/89 |
| 4,631,384 | 12/1986 | Cornu | 291/121 |
| 4,671,351 | 6/1987 | Rappe | 165/45 |
| 4,741,386 | 5/1988 | Rappe | 165/45 |

VISCOSITY REDUCTION PROCESSING AT ELEVATED PRESSURE

CROSS-REFERENCE TO RELATED APPLICATION

This application is a continuation-in-part of copending and commonly assigned U.S. patent application Ser. No. 771,205 filed Aug. 30, 1985 now abandoned.

FIELD OF INVENTION

This invention relates to a method for improving the transportability of heavy oils and other hydrocarbons by reducing viscosity in order to render them more suitable for transportation by pipeline and ship and/or to provide enhanced value for refinery processing to increasing the API gravity.

BACKGROUND OF THE INVENTION

Development of many of the world's petroleum reserves is hindered or prevented by the nature of crude oil where the viscosity, pour point and API gravity renders the crude oil unsuitable for pipeline transportation. Varied methods of producing pipeline-quality oil from such crudes have been used. In general, such methods can be categorized as either physical or chemical treatments.

Physical treatments change the physical properties of the oil to produce a pumpable fluid, but do not change the chemical composition of the oil itself. As discussed by Flournoy et al. in U.S. Pat. No. 4,134,415 (1979) a common method involves dilution of the heavy crude with lighter fractions of hydrocarbons. This can involve the use of large amounts of expensive solvents to transport a relatively cheap product and requires the availability of the diluent which can be inconvenient in certain oil fields. Another method disclosed by Flournoy et al. involves heating the heavy oil to reduce its viscosity. This method requires the installation of heating equipment along the pipeline and insulation of the pipeline itself. Such a procedure is expensive and uses a large amount of energy. The extent of decrease in viscosity which can be achieved by an increase in temperature varies widely between heavy oils depending on the oil composition. Such physical treatments do not upgrade, i.e. enhance the value of, the oil and, in fact, usually increase the overall cost of oil processing. Nevertheless, physical treatments provide a simple solution and are most widely used today. In many applications, dilution with lighter crudes is coupled with pipeline heating for pumping very heavy crudes. It is also possible to add water to reduce the pressure gradients as discussed by B. L. Moreau in an article "The Pipeline Transportation of Heavy Oils", *The Journal of Canadian Petroleum Technology*, p. 252, 1965. However it is difficult to maintain proper flow in this system and still obtain the desired viscosity reduction. Other methods such as the addition of surfactants to form oil-in-water emulsions have been used. Flournoy et al., U.S. Pat. No. 3,943,954 (1976).

Chemical treatments can involve contacting the oil with a strong base to form an oil-in-water emulsion which is more easily transported. Kessick et al., Canadian Pat. No. 1,137,005 (1982). However, chemical treatments typically require changing the hydrogen to carbon ratio of the oil, either by reducing the carbon content or by addition of hydrogen. Carbon reduction technologies range from simple distillation and deasphalting to mild visbreaking to severe thermal cracking. Distillation and deasphalting processes result in separation of the heavy portion of the oil, i.e. the residuum, from the remaining lighter portion, with only the lighter end being transported.

A number of processes which involve heating a heavy oil to improve its transportability have been tried over the years. A thermal treating process to reduce the viscosity and improve transportation of the oil has been disclosed by Engle in U.S. Pat. No. 3,496,097 (1970). This process involves heating the oil between 500° F. and 700° F. for at least 24 hours. The process has the disadvantage of being time and energy consumptive and producing substantial amounts of gas which are not readily used in the field.

Scott et al. in U.S. Pat. No. 3,474,596 (1969) describe a process for reducing the viscosity of a stream of viscous fluid flowing within a pipeline by diverting a portion of the stream and heating it to about 850° F. to 900° F. (454° C.–482° C.) and 200 to 400 psig at which thermal degradation or "visbreaking" of at least some of the constituents thereof takes place. This heated portion is then blended with the remainder of the stream to reduce the viscosity of the bulk material. This process, however, only modifies a portion of the oil. Additionally, that portion which is modified must be taken from the fraction of "dry oil" which is obtained from a crude oil-water separator.

Huang in U.S. Pat. No. 4,298,455 (1981) discloses that the pumpability of a heavy hydrocarbon oil, such as a crude, reduced crude or other oil with an API gravity of less than 15°, is improved by using a viscosity reducing or visbreaking heat treatment. The disclosed process involves heating the oil at between 800° F. and 950° F. (427° C.–510° C.) between two and thirty minutes and at a pressure of 100 to 1500 psig. To minimize the amount of coke or tar and gas formed during this visbreaking process, the visbreaking is carried out in the presence of a chain transfer agent and a free radical initiator. This process requires the careful control of the concentration of the initiator and transfer agent in conjunction with adjustment of the residence time at reaction temperature to minimize coke formation.

A method which involves reducing the viscosity and sulfur content of a heavy crude as it is being produced is disclosed by Meldau in U.S. Pat. No. 3,442,333 (1969). This method involves injecting steam at the wellhead through a conduit which extends down-hole. The steam heats the oil to a temperature in the range of 550° F.–700° F. (288° C.–371° C.). The rate of production of the oil is controlled so that the oil is at temperature within the well for at least 24 hours. This process has the disadvantages of long contact times at temperature, high energy requirement, low production rates, and the necessity for special equipment in each well-hole.

A form of thermal cracking known as visbreaking is well known in the art. As disclosed by Biceroglu et al. in U.S. Pat. No. 4,462,895 (1984), visbreaking conditions can include temperatures from 750° F.–950° F. (399° C.–510° C.) and pressures of 50–1500 psig. Other conditions disclosed include a temperature of 850° F.–975° F. (454° C.–524° C.) and a pressure of 50–600 psig. Beuther et al. U.S. Pat. No. 3,132,088 (1964). Normally the residue from "topped" or "reduced" crudes is the feedstock for refinery visbreaking operations. Taff et al. U.S. Pat. No. 2,695,264 (1954). It has been disclosed by Beuther et al. in U.S. Pat. No. 3,324,028

(1967) that resids and certain heavy crudes with an API gravity below about 20° can be exposed to visbreaking conditions. This patent, however, teaches that the resids or crude should be hydrodesulfurized before visbreaking at 800° F.–1000° F. (427° C.–538° C.) at pressures of 50–1000 psig. Such "visbreaking" processes are not practical for in the field treatment of whole crude because of the additional facilities required to pretreat the feedstock and to recover and process products from the treatment.

The principal variables in single-pass visbreaking have been reported to be furnace outlet temperature, residence time and pressure. Beuther et al., "Thermal Visbreaking of Heavy Residues", *The Oil and Gas Journal,* Vol. 57, No. 46, p. 151 (1959). An increase in any of the three variables is said to result in an increase in visbreaking severity. Shu et al. in U.S. Pat. No. 4,504,377 (1985) and Yan et al. in U.S. Pat. No. 4,522,703 (1985).

It has been disclosed that at higher severities there is an increased tendency to form coke deposits in the heating zone or furnace. Black in U.S. Pat. No. 1,720,070 (1929) teaches that operating at lower temperatures for increased lengths of time provides "a much smaller amount of carbon is deposited than is deposited at higher temperatures." Hanna et al. in U.S. Pat. No. 1,449,227 (1923) disclose the continuous circulation of a stream of oil from an evaporating chamber through a heating coil to maintain the temperature of the oil in the chamber at the desired cracking temperature. The temperature differences between the oil in the chamber and the heating coil is kept small to minimize cracking in the coil. Hess in U.S. Pat. No. 1,610,523 (1926) teaches that it is desirable to avoid local overheating in order to prevent excessive coke formation in cracking systems of oil distillation. Akbar et al., "Visbreaking Uses Soaker Drum", *Hydrocarbon Processing,* May 1981, p. 81 discloses that, when there is a high temperature differential between the tube wall in a furnace cracker and the bulk temperature of the oil, the material in the boundary layer adjacent to the tube wall gets overcracked. Therefore, the coking rate is roughly a function of the inside boundary layer temperature. In furnace cracking this boundary layer is commonly 30° C.–40° C. higher than the bulk temperature. In soaker cracking the skin temperature is lower but still is reported to be above 480° C. Therefore, the formation of coke is slower in a soaker cracker but still causes regular shutdowns of the equipment for coke removal.

Frequent shutdowns for coke removal from visbreaking units can be tolerated in refinery operations where there is adequate storage for the topped crude or residue feedstock normally processed. However, this is unacceptable in a field operation where crude is continually produced and must be rapidly transported. Yan et al. (supra) recognize the problem of coke formation. They attempt to minimize the problem by adding "1–10 weight percent of finely divided solids in the heavy hydrocarbon oil feedstream . . . " in an attempt ". . . to prevent the deposition of coke on the walls of the heating coils and reactor . . . "

Although some patents relating to visbreaking suggest that whole crude can be used as a feedstock, this has not proven possible with conventional processes due to the pressure generated by the volatile components present in the whole crude. In fact, Lutz in U.S. Pat. No. 4,454,023 (1984) teaches that it is necessary to pass a whole crude oil through a distillation column before passing it to a visbreaking heater. Black (supra) teaches that it is desirable to minimize vaporization during cracking to maintain only a liquid phase. Black used mechanical pressure of up to 1000 psi and the addition of a liquid diluent to maintain the liquid phase.

In view of the disadvantages of the processes described hereinabove, there is a need for a process suitable for well-site locations by which viscous crudes can be rendered more pumpable. More particularly, it would be advantageous to have a process which, unlike traditional visbreaking, is suitable for untopped, rather than topped, feeds and which uses lower temperatures to achieve the same or greater viscosity reductions.

It has now been found that significant reductions in the viscosity of heavy hydrocarbon mixtures can be attained with a process using a vertical tube reactor. Vertical tube reactors which oridinarily involve the use of a subterranean U-tube configuration for establishing a hydrostatic column of fluid sufficient to provide a selected pressure are known. This configuration provides a less expensive way to achieve high pressures than with standard high pressure pumps. This type of reactor has been primarily used for the direct wet oxidation of materials in a waste stream and particularly for the direct wet oxidation of sewage sludge.

Bower in U.S. Pat. No. 3,449,247 discloses a process in which combustible materials are disposed of by wet oxidation. A mixture of air, water and combustible material is directed into a shaft and air is injected into the mixture at the bottom of the hydrostatic column.

Lawless in U.S. Pat. No. 3,606,999 discloses a similar process in which a water solution or suspension of combustible solids is contacted with an oxygen-containing gas. Excess heat is removed from the apparatus by either diluting the feed with the product stream or withdrawing vapor, such as steam, from the system.

Land, et al. in U.S. Pat. No. 3,464,885 (1969) is directed to the use of a subterranean reactor for the digestion of wood chips. The method involves flowing the material through counter-current coaxial flow paths within a well-bore while flowing heated fluid coaxially of the material to be reacted. The reactants, such as sodium hydroxide and sodium sulfate, are combined with the wood chip stream prior to entry into the U-tube which is disposed within a well-bore.

Titmas in U.S. Pat. No. 3,853,759 (1974) discloses a process in which sewage is thermally treated by limiting combustion of the material by restricting the process to the oxygen which is present in the sewage, i.e. no additional oxygen is added. Therefore, it is necessary to provide a continuous supply of heat energy to effect the thermal reactions.

McGrew in U.S. Pat. No. 4,272,383 (1981) discloses the use of a vertical tube reactor to contact two reactants in a reaction zone. The method is primarily directed to the wet oxidation of sewage sludge in which substantially all of the organic material is oxidized. There is heat exchange between the inflowing and product streams. The temperature in the reaction zone is controlled by adding heat or cooling as necessary to maintain the selected temperature. It is disclosed that when gas is used in the reaction, it is preferred to use a series of enlarged bubbles known as "Taylor Bubbles". These bubbles are formed in the influent stream and are transported downward into the reaction zone. It is disclosed that preferably air is introduced into the influent stream at different points with the amount of air equaling one volume of air per volume of liquid at each injection point. The presence of this amount of oxidant would not be possible with a liquid which was primarily carbonaceous.

Other patents which disclose the use of a hydrostatic column to generate pressure include Beddoes, U.S. Pat. No. 887,506 (1908). Silverman in U.S. Pat. No. 3,371,713 (1968) discloses a method for generating steam for steam flooding for oil production. Palmer in U.S. Pat. No. 1,514,098 (1924) discloses a system in which an elevated vessel is used to provide a low pressure hydrostatic head on oil in a thermal cracking vessel. Other patents include U.S. Pat. No. 3,140,986 of Hubbard (1964) and U.S. Pat. No. 2,421,528 of Steffen (1947).

The above-cited patents which disclose vertical tube reactor systems describe the use of such systems with primarily aqueous streams. None of these patents describe treatment of a primarily hydrocarbon stream. Specifically, there is no suggestion of the thermal treatment of a hydrocarbon stream in a vertical tube reactor system to provide for viscosity reduction. Based on the teachings of the visbreaking art as described hereinabove, it would be expected that coking of the reactor surfaces would be a significant problem with this configuration.

Therefore, it would be advantageous to have a thermal process by which significant viscosity reduction can be achieved with a heavy oil feedstock. It would be particularly advantageous for the process to produce little or no coke make so that a vertical tube apparatus could be used. Additionally, the process should provide viscosity reduction without the need for long residence times and a high throughput rates.

These and other advantages are now achieved by practice of the present invention as described hereinbelow.

SUMMARY OF THE INVENTION

It has been discovered that significant improvements in the transportability of heavy hydrocarbon feeds can result at elevated pressure with the careful control of the driving temperature differential during relatively mild thermal treatment of the feed. More particularly, this invention comprises a method of reducing the viscosity of hydrocarbon feed comprising: heating said feed at a pressure of at least about 1000 psig to a reaction temperature of at least about 300° C. by contact with a heat source; and maintaining the difference between said reaction temperature and the temperature of said heat source sufficiently small so as to have minimal coke and enhanced or maximized viscosity reduction at the reaction temperature and pressure. This is accomplished by maintaining an efficient heat transfer between an effluent product stream and an influent feed stream in which at least one of the streams is in turbulent flow.

This invention further comprises reducing the viscosity of a hydrocarbon composition by passing a feed stream of the hydrocarbon composition at an initial temperature into a vertical tube reactor to form a hydrostatic pressure head. The influent stream is heated to a second temperature by heat exchange with an effluent product stream in which at least one of the streams is in turbulent flow. The influent stream is then heated to a reaction temperature at a reaction pressure by contact with an external heat source in which a temperature differential between the heat source and the hydrocarbon stream of less than about 30° C. is maintained. The reaction temperature is between about 300° C. and the coking temperature of the hydrocarbon composition and the reaction pressure is at least about 1000 psi.

BRIEF DESCRIPTION OF THE DRAWING

The FIGURE is a schematic representation of a preferred configuration of a vertical tube reactor system useful in practicing the instant process.

DETAILED DESCRIPTION OF THE INVENTION

Figure 1:
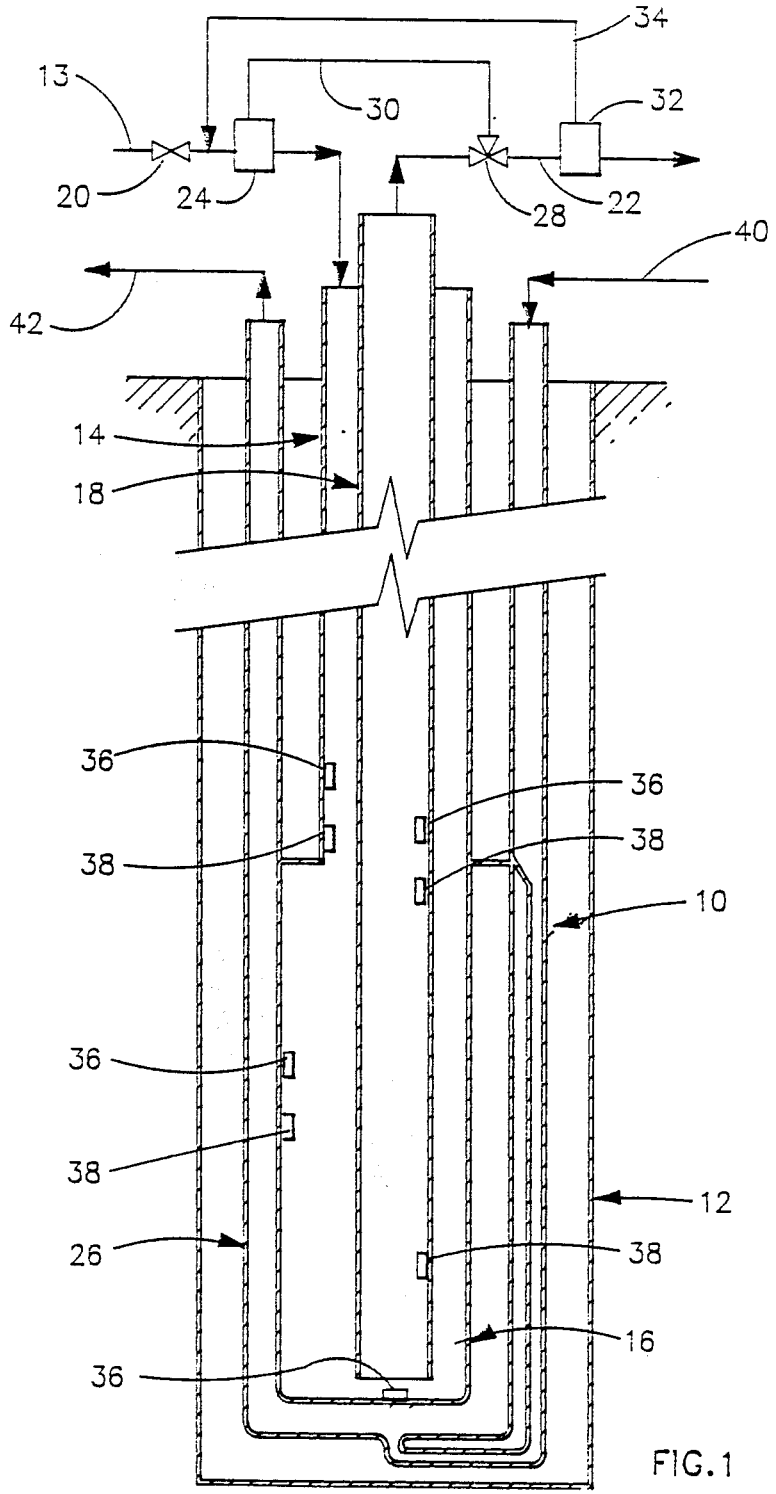

The method of the present invention involves a process useful for improving crude oil transportability, i.e., by treating a whole crude to substantially reduce its viscosity. In the instant process, a vertical tube reactor is used to provide the necessary pressure through the formation of a hydrostatic column of fluid. Coke make in the reactor is minimized by maintaining a relatively low driving temperature differential during heating at the reaction temperature. It has been found that the necessary reaction temperatures can be attained while maintaining the low driving temperature differential by providing substantially improved heat exchange between the influent feed stream and effluent product stream in which at least one of he streams is in turbulent flow.

As used herein "temperature differential" ($\Delta T$) refers to reaction driving force and more particularly, to the difference between the temperature of the bulk fluid in the reaction zone (as defined hereinbelow) and the temperature of the active heat source in a system of indirect heating. As used herein the "heat transfer surface" refers to that surface actually contacting the hydrocarbon stream and providing heat to said stream. The term "heat source" refers to a heat transfer surface whose temperature is at least equal to or greater than the temperature of the hydrocarbon stream which contacts said surface. The term "active heat source" refers to a heat source whose temperature is greater than the reaction temperature but is below the coking temperature of the hydrocarbon material in contact with the surface.

The temperature differential during practice of the present invention is minimized to the extent practicable. It is preferred that the temperature differential be maintained below about 25° C., more preferably below about 15° C., and most preferably below about 5° C. It has been found that maintaining a relatively small $\Delta T$ during treatment of the feed at elevated pressures enables significantly higher viscosity reductions to be achieved with minimal or substantially no coke make, e.g. below about 0.5 weight percent of the hydrocarbon feed, preferably below about 0.2 weight percent coke make, and most preferably less than about 0.05 weight percent coke make. As used herein the term "coke" refers to material which is insoluble in boiling benzene. As $\Delta T$ increases, coke make occurs at lower reaction temperatures and/or at lower pressures and/or at higher final viscosities, i.e. smaller viscosity reductions are achieved at equivalent coke make.

As used herein the term "reaction temperature" ($T_{RX}$) refers to the maximum bulk temperature of the hydrocarbon stream reached in the process. However, it is understood that some reaction can begin at a lower temperature ("initiation temperature"). The maximum useful temperature in the instant process is the "coking temperature" of the particular feedstock. The "coking temperature" is defined herein as the temperature at which at least about 0.5 weight percent coke is formed based upon the hydrocarbon feed. In ordinary operation, the reaction temperature is maintained below the coking temperature. At a minimum the reaction temperature used for practice of the present invention is high enough to initiate a thermal cracking reaction at an effective rate. For most feeds the reaction temperature is above about 300° C. and less than about 475° C., more typically in the range of about 350° C. to about 450° C. and most often in the range of about 375° C. to about 435° C.

The influent hydrocarbon stream is introduced to the inlet of the vertical tube reactor at a first or initial temperature ($T_1$), normally less than about 100° C., and an initial pressure ($P_1$) typically less about 200 psi. As any particular volume element of the influent hydrocarbon stream travels down the downcomer in the vertical tube reactor, the pressure on the increment increases due to the increasing hydrostatic column of fluid above it. Additionally, the bulk of the influent stream increases to a second temperature ($T_2$) due to heat exchange with the effluent product stream. The second temperature is the highest bulk temperature reached in the influent stream due to heat exchange with the effluent stream. Normally this temperature is at least about 200° C., preferably this temperature is at least about 250° C., and preferably this temperature is at least about 300°. In the reaction zone, the temperature of the hydrocarbon is increased to a maximum reaction temperature ($T_{RX}$) due to contact with an active heat source. As used herein, the term "reaction zone" refers to the region in the vertical tube reactor in which the bulk temperature of the hydrocarbon stream is greater than the second temperature ($T_2$) and equal to or less than the reaction temperature ($T_{RX}$). This temperature is achieved by contacting the hydrocarbon stream with the active heat source.

In order to minimize the temperature differential, the second temperature $T_2$ should be maximized. Therefore, it is necessary for the heat exchange between the influent and effluent streams to be more efficient than those disclosed in the known patents relating to vertical tube reactors. The temperature of the influent stream achieveable by heat exchange with the reaction product is limited by a number of factors including the temperature of the reaction product, the heat-exchange surface area and the velocity of the hydrocarbon streams. In order to achieve the necessary heat-exchange efficiencies, it has been found that turbulent flow of the streams is necessary. Although static mixing devices can be used to provide turbulent flow, this is not preferred. It has been found that substantially improved results are obtained when at least one of, and preferably both, the influent feed stream and the product stream are in substantially vertical, multiphase flow. When both streams are in vertical multiphase flow, an increase in heat-exchange efficiency of at least about 100% can be achieved compared to heat exchange when neither stream is in turbulent This allows a $T_2$ temperature to be attained which is sufficiently close to the reaction temperature to allow a small $\Delta T$ to be used in order to provide the incremental heat necessary to attain the desired reaction temperature.

It has been found that thermal treatment of hydrocarbon feeds according to the present invention, wherein $\Delta T$ is minimized, results in advantageous viscosity reductions with significantly less heat flux in the reaction zone. Heat flux is defined herein as the heat flow (Q) into the feed fluid per unit area of heat transfer surface. It has been found that the reaction zone heat flux required for practice of this invention is substantially less than the heat flux required in conventional visbreaking operations. A typical heat flux for a conventional visbreaker is ordinarily at least 30,000 BTU/ft$^2$/hour. By contrast the typical reaction zone heat flux for the method of the present invention is on the order of about one-half to less than one-tenth that value or less than about 15,000 BTU/ft$^2$/hour and more preferably less than about 6,000 BTU/ft$^2$/hour. It is expected that a heat flux as low as about 2,000 BTU/ft$^2$/hour can be attained in a commercial scale unit for the present invention.

The pressures useful for the practice of the present invention are typically above about 1000 psi and preferably above about 1500 psi in the reaction zone. As used herein the term "psi" refers to "pounds per square inch absolute" and "psig" refers to "pounds per square inch gauge". Such pressures are in excess of those typically used for visbreaking or most other crude oil treatments employed at or near the well-site for viscosity reduction purposes. Similarly, such pressures are in excess of those used for treating hydrocarbons in the absence of added hydrogen. Traditionally such high pressures have been used in conjunction with severe cracking and thermal treatments where an increase in the hydrogen to carbon ratio is intended and hydrogenation with hydrogen gas is most common.

The use of such pressure has an additional advantage in that the volume percent of the hydrocarbon stream which is in the liquid phase in the reaction zone is maximized. This minimizes the concentration of amphaltenes and other coke precursors and thus reduces the likelihood of such materials precipitating on internal reactor surfaces to produce coke.

The process of the present invention is broadly applicable to reducing the viscosity of petroleum-type hydrocarbons. The invention is especially useful for treating heavy oil crudes of a nature and viscosity which renders them unsuitable for pipeline transport to distant refineries, i.e. feeds having a viscosity above about 1000 centipoise (cps) at 25° C. (unless otherwise indicated, viscosity herein is at 25° C.), a pour point above 15° C. or an API gravity at 25° C. of 15° and below. However, even "light" heavy crudes, i.e. those having viscosities of 1000 cps or less, can be beneficially treated as can any feeds having an API of less than about 25°. More particularly, the advantages of reduced viscosity, increased API gravity and/or reduced pour point can be achieved by practice of the present invention without regard to the initial viscosity, API gravity or pour point of the feed. Additionally, it may be desirable to add a diluent to the product from the instant process in order to further reduce the viscosity. It is also possible to blend the product of the instant process with unmodified or virgin crude to obtain an overall reduction in viscosity of the final blend product. Heating of the product, for example with heating stations, in order to further reduce the viscosity or to maintain an acceptable viscosity for a particular pipeline or transportation medium is also possible.

Heavy hydrocarbon feeds to the process of the instant invention comprise, but are not limited to, heavy whole crude oil, tar sands, bitumen, kerogen, and shale oils. Examples of heavy crude oil are Venezuelan Boscan crude oil, Canadian Cold Lake crude oil, Venezuelan Cerro Negro crude oil and California Huntington Beach crude oil. The viscosity of the typical feed at 25°

C. can vary widely ranging from about 300,000 cps or more to about 20,000 cps or lower. In practice, as would be expected, the most significant reductions in viscosity are achieved where the starting feed is most viscous. It has been found that essentially unpumpable feeds having viscosities up to about 200,000 cps can be rendered suitable for pipeline transport by treatment according to the present invention. With feeds of viscosities greater than about 200,000 cps, significant viscosity reduction, preferably greater than 50 percent, more preferably greater than 90 percent, and most preferably greater than 95 percent (based on feed viscosity) is achieved by the method of the present invention, although supplemental physical treatment, such as heating or dilution, can still be used to render the product more readily pumpable.

In a similar manner, the process of the present invention is effective to reduce the pour point and/or increase the API gravity of the feed. Typically, a reduction of at least about 15° C. in pour point is preferred. In particular, for feeds having a pour point of between about 15° C. and about 30° C., the process of the present invention can yield a product with a pour point below about −10° C. For typical heavy feeds having an API gravity of less than about 25° and more typically less than about 15°, the process of the present invention can yield a product with an API gravity increase of at least about 2°.

Typically, the feeds to the process of the present invention are whole crudes, "untopped", i.e. without passing through a distillation unit to remove lower boiling components, and without added solvents. However, the advantageous results of the present invention can be achieved with separate crude fractions and independent of any solvents or water which are present. Ordinarily, whole crude contains water with the amount of water depending upon the method of production. Crude oil produced by steam flood commonly contains in excess of 50 weight percent water as measured at the wellhead. It is contemplated that the feedstock for the instant process normally passes through the usual primary water/oil hot phase separator to remove most of the aqueous phase and reduce the water level to less than about 10 weight percent and preferably less than about 5 weight percent of the hydrocarbon feedstock. The terms "hydrocarbon stream", "hydrocarbon feedstock", and "hydrocarbon feed" are used interchangeably herein to mean the fluid stream which is passed through the instant process and contains primarily hydrocarbonaceous components but can also contain smaller amounts of other components such as water.

As expected, treatment by heating, according to the present invention, results in some conversion or alteration of the hydrocarbon feed. However, it has been found that even at constant conversion percentages, (i.e. conversion of the +950° F. fraction), use of elevated pressure according to the present invention results in enhanced viscosity reduction.

It is generally known that increased temperature in the thermal treatment of hydrocarbons results in decreased viscosity due to higher conversion, i.e. increased formation of lighter products, and a concomitant increase in coke formation. Avoidance of coke formation by use of more moderate temperatures in visbreaking processes, heretofore has required unduly long "soaking" or residence times on the order of 2–24 hours to effect any significant results. Surprisingly, it has been found that temperatures high enough to effect significant viscosity reduction can be used without causing significant coke make and/or without the need for long residence times by the use of elevated pressure and a minimal temperature differential. Reaction and/or residence times in the reaction zone for processes of the present invention are relatively short, i.e. times less than 1 hours, often less than 30 minutes, more frequently less than about 15 minutes and even less than about 5 minutes are possible.

Heretofore, the relationships between reaction temperature, ΔT, pressure and coke make as they specifically relate to viscosity reduction have gone unrecognized. Practice of the processes of the present invention permits valuable viscosity reduction to be maximized at elevated pressures above 1,000 psi by use of a reactor temperature and a related ΔT selected to minimize coke make. By the processes disclosed herein, it becomes possible to maximize viscosity reduction under practical conditions of minimal coke make and relatively low temperatures by using high pressures, e.g., greater than 1,000 psi, and minimizing the system ΔT. While it is anticipated that in normal operations the primary objective is to maximize viscosity reduction, it is recognized that particular circumstances may require a different mode of operation whereby somewhat less than the absolute "maximum" viscosity reduction results. For example, if heating stations and insulated pipelines are available, it may be desirable to increase throughput and accept a smaller reduction in viscosity. As will be understood by those skilled in the art the terms "maximize" or "maximizing" and "minimum" or "minimizing" are not absolute and are intended to encompass selection of parameters which approach such maximums or minimums.

The use of a vertical tube reactor involves subjecting a moving hydrocarbon feed stream to essentially continually increasing pressure until a reaction pressure ($P_2$) is reached. As used herein the term "reaction pressure" refers to the maximum pressure on the hydrocarbon stream in the reaction zone. The hydrocarbon stream is maintained at a reaction temperature of about 300° C. to about 475° C., more commonly about 350° C. to about 450° C. and a reaction pressure of at least about 1000 psi for a time sufficient to provide the desired reduction in viscosity of the hydrocarbon stream. As used herein the term "treated hydrocarbon stream" refers to the product of the instant process in which the viscosity of the hydrocarbon stream has been reduced without significant coke make. It is preferred that the pressure of the resulting treated hydrocarbon stream is essentially continually decreased to an exit pressure ($P_3$).

The temperature of the hydrocarbon stream is also essentially continually increased from an initial temperature to a second temperature by heat exchange with the treated hydrocarbon stream. The bulk temperature of the stream is then increased to a reaction temperature by contact of the stream with an active heat source. The temperature of the resulting treated hydrocarbon stream is essentially continually decreased from the reaction temperature to a final temperature by heat exchange with influent feed stream.

The hydrocarbon stream is ordinarily a whole crude oil which has been subjected to the primary dewatering process discussed hereinabove. However, it is contemplated that any of the other heavy hydrocarbon streams discussed hereinabove such as bitumen, shale oil or resid could be subjected to this embodiment of the instant process. If the hydrocarbon stream is whole crude, the initial temperature of the incoming stream is ordinarily about 40° C. to about 100° C. depending upon the method of production. In general, the present invention is operable independent of the presence or absence of water in varying amounts.

The pressure on any particular volume segment of the hydrocarbon stream is essentially continuously increased from an initial pressure to the reaction pressure. By "essentially continuously" it is meant that the stream is not maintained at a constant pressure below the reaction pressure for a significant period of time, i.e. any period of constant pressure that has a duration of less than about 5 minutes and ordinarily less than about one minute. It is possible that phase changes can occur depending upon the composition of the stream. This can result in rapid pressure increases or decreases possibly followed by momentary leveling of pressure. However, except for such stream composition-dependent deviations, the increase in pressure is continuous from the initial pressure to about the reaction pressure.

In operation of the instant process, the pressure on the stream ordinarily increases from some lower pressure, when the bulk temperature of the stream is at the second temperature, to the reaction pressure as the stream passes through the reaction zone. This operation contemplates that the flow of the stream through the reaction zone is substantially linear or plug flow. If another manner of flow through the reaction zone is used, e.g. if there is substantial backmixing of the stream, it is possible that a particular segment of the stream would be exposed to some fluctuation in pressure. However, the maximum range of any such fluctuations is expected to be from between the pressure at the second temperature and the reaction pressure. As set forth hereinabove, the reaction pressure is at least about 1000 psi and preferably at least about 1500 psi. In normal operation it is not expected that the reaction pressure would exceed about 4000 psi. Commonly, the reaction pressure ranges from about 1000 psi to about 3000 psi and usually ranges from about 1000 psi to about 2000 psi. The initial pressure of the hydrocarbon feed stream is ordinarily between about 25 psi and about 1000 psi, and preferably is between about 25 psi and about 500 psi. It is contemplated, however, that the hydrocarbon feed stream can be provided under a higher initial pressure if it is desired to have a higher reaction pressure than is obtained by the hydrostatic head of the fluid column. As set forth hereinabove, the reaction pressure is primarily due to a hydrostatic head. If it is desired that the reaction pressure be greater than would be generated by the hydrostatic head, the initial pressure of the hydrocarbon feed stream can be increased by, for example, centrifugal pumps to provide the desired total reaction pressure.

The high pressure serves to maintain in liquid phase volatile components present in the hydrocarbon feed stream or formed during thermal cracking reactions. While the process of coking is not fully understood, it is known that materials such as asphaltenes are more likely to form coke. Once these materials precipitate and solidify on surfaces it is difficult to dissolve them before coke deposits are formed. It is therefore important to maximize the liquid phase in the reaction zone to minimize the concentration of asphaltenes and other coke precursors to avoid the precipitation from the hydrocarbon phase and possible deposition on internal reaction surfaces with subsequent coke formation. A small volume fraction of the stream can be vapor phase and, in fact, a small vapor phase can be beneficial in promoting mixing of the stream for rapid distribution of heat. Preferably, the vapor phase should amount to no more than about 10 volume percent of the hydrocarbon stream and preferably less than 5 volume percent. If the vapor phase comprises a substantial percent of the stream volume, it can become difficult to maintain a pressure balance in the reactor vessel.

Preferably, the temperature of the incoming hydrocarbon stream is increased essentially continuously from an initial temperature to the second temperature $T_2$. By "essentially continuously" it is meant that there are no long soaking periods in which the stream is maintained at a constant temperature. During this temperature increase, it is possible for various phase changes to occur in the stream. For example, depending upon the temperature and pressure, water contained in the stream can vaporize. Such phase changes can cause a temporary leveling or even a decrease in the temperature of the stream due to the heat of vaporization. However, such a leveling or dip in temperature is of short duration and in the instant process the temperature increase quickly resumes.

The temperature of the influent hydrocarbon feed stream is increased by contact with a heat source. The heat source can be any means capable of providing the necessary temperature increase in the hydrocarbon feed stream from the initial temperature to the second temperature $T_2$. For example, multiple zones of increasing temperature can be provided by electrical resistance heaters or through use of a heat exchange fluid. The heat source should be maintained at a temperature below the reaction temperature in order to assure minimum coke make. The influent and effluent hydrocarbon streams should be in thermal communication with one another to provide for maximum efficiency. Economically it is preferred that the influent and effluent streams be in counter-current heat exchange in which the treated hydrocarbon stream is initially contacted at its highest temperature with the influent hydrocarbon feed stream at or near the reaction zone. The effluent product fluid is then maintained in countercurrent heat exchange contact with the influent hydrocarbon stream to provide an essentially continuous increase in the temperature of the influent stream and a continuous decrease in the temperature of the effluent fluid. Other things being equal, it is anticipated that the time required to heat the influent hydrocarbon feed from its initial temperature to a second temperature (heat exchange temperature) is at least about 30 seconds and preferably at least about 100 seconds.

In normal operation the hydrocarbon feed stream is heated to the second temperature which is preferably within about 30° C. of the reaction temperature before it contacts an "active heat source". As discussed hereinabove, the differential between the temperature of the bulk hydrocarbon fluid at reaction temperature and the active heat source should be maintained as low as possible, normally below about 30° C., preferably below about 25° C., more preferably below about 15° C., and most preferably below about 5° C. In addition to minimizing actual coke make, this $\Delta T$ provides a product which has good stability in storage and during transportation, i.e. solid materials do not form and precipitate.

Ordinarily the reaction temperature for a whole crude oil feedstock is in the range of about 300° C. to about 450° C. and preferably between about 375° C. and about 435° C. The hydrocarbon stream is maintained at the reaction temperature and pressure for a time sufficient to effect the desired viscosity reduction without providing significant coke make. In normal operation, the hydrocarbon stream is maintained at the reaction temperature for less than 1 hour, preferably less than 30 minutes, and most preferably less than 15 minutes. Ordinarily the viscosity of the treated or modified stream is reduced by at least 50 percent and usually by at least 90 percent and more preferably by at least 95 percent compared to the untreated feedstock.

This treated hydrocarbon stream is passed out of contact with the active heat source. The temperature and pressure of the treated stream are reduced essentially continuously from the reaction temperature and pressure to a final or exit temperature ($T_E$) and pressure $P_3$ by heat exchange contact with the feed stream. While the temperature and pressure are being reduced, phase changes can occur, for example, water vapor can condense to form liquid water. This can result in a momentary leveling in temperature due to the latent heat of vaporization. Also the pressure can rapidly drop due to this condensation. These are transient phenomena dependent upon the particular composition of the stream. Therefore, when the temperature and pressure changes are viewed as a whole, the decreases are essentially continuous from the reaction conditions to the final conditions.

Although some pressure reduction occurs as the result of a reduction in temperature, there is a continual reduction in pressure as the hydrostatic pressure head is decreased.

The use of a hydrostatic pressure head is particularly useful when whole crude oils or other feedstocks which contain a substantial amount of volatile components, e.g. materials boiling below about 300° C. This is even more critical when the feedstock contains a significant amount of water. These materials are not readily useable in conventional visbreaking processes due to the high pressures required in order to provide an acceptable residence time at reaction temperature. In the instant process, the necessary pressures can be provided with simple, relatively inexpensive equipment.

It is particularly important in a vertical tube reactor for the coke make to be minimized in the process. Excessive coke formation can rapidly coat the internal surfaces of the apparatus and cause premature shutdowns. Therefore, the coke make should be kept below about 0.5 weight percent and preferably below about 0.2 weight percent. As discussed hereinabove this is accomplished by a combination of very efficient heat exchange between the influent and effluent streams and a low $\Delta T$ in the reaction zone.

The exit temperature and pressure depend on the feedstock being used, the particular reaction conditions, and the extent of viscosity reduction desired in the feedstock. Ordinarily, the temperature ranges from about 75° C. to about 200° C. and the pressure ranges from about 150 psig to about 350 psig.

The instant invention can be more readily understood after a brief description of a typical application. As will be understood by those skilled in the art, other apparatus and configurations can be used in the practice of the present invention.

The FIGURE depicts a subterranean vertical reactor 10 disposed in a well bore 12. The term "vertical" is used herein to mean that the tubular reactor is disposed toward the earth's center. It is contemplated that the tubular reactor can be oriented several degrees from true vertical, i.e. normally within about 10 degrees. During operation, flow of the hydrocarbon stream can be in either direction. As depicted, flow of the untreated hydrocarbon feed stream is through line 13 and into downcomer 14 to the reaction zone 16 and up the concentric riser 18. This arrangement provides for heat exchange between the outgoing product stream and the incoming feed stream.

During start-up, untreated hydrocarbon feed is introduced into the vertical tube reactor system through feed inlet 13, the flow rate being controlled by valve 20. The hydrocarbon feed stream passes through downcomer 14 into reaction zone 16 and up through concentric riser 18 exiting through discharge line 22. Unless external heat is provided to the hydrocarbon stream, the initial temperature $T_1$ is equal to the final heat exchange temperature $T_2$ and is also equal to the maximum temperature in the reaction zone $T_{RX}$ (provided there is no heat loss to the environment). It is necessary to increase the temperature of the effluent stream so that the desired $T_2$ temperature of the influent stream can be obtained. This can be accomplished by passing the influent stream through an above-ground heating means 24 so that the $T_1$ is essentially equal to the desired $T_2$. Alternatively, the necessary heat can be provided by an external heating means 26 surrounding the reaction zone. In another configuration (not shown), the downcomer 14 can be jacketed to allow external heating of the hydrocarbon stream at this location in addition to or instead of heating at the reaction zone. Of course, the external heating means 26, can be used in conjunction with the above-ground heating means 24 to provide the hydrocarbon feed stream at the desired temperature $T_2$. It may be necessary during start-up to provide a hydrocarbon feed stream which has a lower viscosity than the hydrocarbon material to be processed during normal operation to allow ready transport of the fluid through the reactor system. Additionally, it is preferred during start-up operation for the effluent stream to be recycled by diverting through valve 28 into recycle line 30. This recycle allows conservation of energy necessary to heat the hydrocarbon stream and the apparatus to the desired $T_2$ temperature.

Once the desired $T_2$ has been attained, temperature of the external heating means 26 can be increased to provide the desired $T_{RX}$ in the reaction zone. Recycle through line 30 can be stopped and the feed which is desired to be processed can be directed into the vertical tube reactor through line 13. As the treated hydrocarbon exits the vertical tube reactor through line 22, it can be directed to an above-ground product treatment means 32 which can separate gaseous materials such as methane from the product stream. A fraction of components boiling below about 40° C. can also be separated and recycled into the feed stream through line 34. As is discussed in more detail hereinbelow, the recycle of such volatile materials, such as butanes and pentanes can be used to induce multiphase flow in the downcomer 14 to provide for significantly improved heat exchange.

As the influent hydrocarbon stream passes down through downcomer 14, any particular volume segment is exposed to increasing pressure due to the hydrostatic column of fluid above it. The temperature of the hydrocarbon stream is measured by temperature monitors 36 which can be located in the hydrocarbon stream throughout the vertical tube reactor system as desired. Pressure monitors 38 can also be located throughout the vertical tube reactor system to monitor any pressure increases or fluctuations in the fluid stream.

The external heat 26 source preferably uses a heat exchange fluid which is passed into inlet 40 through a jacket surrounding the reaction zone and out through outlet 42. The use of the heat exchange fluid allows careful temperature control to assure that the desired temperature differential can be maintained. Additionally, control of the heat exchange temperature can assure that the surface temperature of the vertical tube reactor in the reaction zone does not exceed the coking temperature.

In order to obtain the desired $T_2$ temperature of the influent stream by heat exchange with the effluent stream, it is necessary that very efficient heat exchange be provided. It has been found that unexpectedly higher overall heat transfer coefficients than would be predicted from empirical heat transfer correlations such as Sieder-Tate can be attained by providing substantially vertical, multiphase flow in the fluid stream. If necessary, multiphase flow can be induced in the influent stream by recycling volatile components from the effluent product stream to provide a gas phase in the liquid phase. As the influent stream progresses down downcomer 14, the increasing pressure serves to liquify and/or dissolve the gaseous components in the liquid phase providing for substantially a liquid phase in the reaction zone. The substantially liquid phase in the reaction zone is desired in order to minimize the concentration of asphaltenes and other coke producing materials in the reaction zone in order to minimize coke formation on surfaces in the reaction zone. As the effluent product flows up the riser, the pressure on any particular volume segment decreases. Volatile components dissolved in the liquid at reaction pressure can vaporize to yield a vapor phase in the liquid stream and provide multiphase flow in the effluent stream. The efficient heat exchange allows the heat flux required in the reaction zone to be minimized. Thus, the typical heat flux in the reaction zone is substantially less than that required in an conventional visbreaker operation. To maximize heat exchange efficiency, it is preferred that both the influent and effluent streams be in multiphase flow, although improved efficiency can be obtained if only one of the streams is in multiphase flow.

The following examples are intended by way of illustration and not by way of limitation.

EXPERIMENTAL

In the following examples, five heavy crude oils and two shale oils were used to test various process parameters. One of the crude oils came from Cold Lake, Alberta, Canada and four of the crudes came from Venezuela. The Boscan and Tia Juana crudes were from the Lake Maracaibo Basin and the Zuata and Cerro Negro heavy oils were from the Orinoco River area. In addition, heavy shale oils were tested.

The heavy crude oils and shale oil were analyzed for water content, viscosity, density, distillation fractions, solids content, asphaltenes content, pour point, Conradson carbon, and sulfur content. Additionally, the pour point and the salt content, as chloride, was measured for the Venezuelan heavy oils.

In order to test the different parameters for heavy oil conversion, including the effect of temperature, pressure, residence time, and water content of the feed oils, both batch and continuous-flow testing was done on the Cold Lake heavy crude oil and on the four Venezuelan crudes.

The batch experiments were performed in rocking bomb autoclave units. The continuous-flow bench unit experiments were performed in a specially designed system, containing the following sections: a high pressure feed system, a tubular reactor, and a pressure letdown system. The unit was designed to handle flow rates of 0.2 to 2.2 gallons/hr. at temperatures up to 450° C. and pressures of 3000 psi. The feed system consisted of an electrically heated five gallon tank connected to a recirculation pump. The heavy oil feed was recirculated continuously through in-line heaters and back into the tank to keep the oil well mixed and to maintain the oil temperature at 70° C. A side stream from the recirculation system served as the feed to the tubular reactor through a high pressure system pump. An additional three gallon heated tank supplied a high temperature oil to the system for start up and shut down. The reactor consisted of 50 feet of $\frac{3}{8}$ inch O.D. stainless steel tubing coiled to form a 9-inch diameter coil with 2-inch spacing between each ring of the coil. Reaction temperature was reached and maintained by means of a fluid bed sand bath. Temperature was measured throughout the system including two points within the heated coil section. The coil form, coupled with the uniformity of the heated fluidized sand bed, allowed a fine degree of temperature control with temperature differences between the sand bed and the oil of less than 5° C. Pressures were measured at various points in the circuit. The temperature and pressure of the oil was measured as it exited from the tubular reactor. The pressure of the product was decreased through a series of valves, and the product was collected in a low pressure receiver tank. In the low pressure receiver tank, the liquid and gas phases separated, with the liquid exiting the bottom and gas sampling and venting at the top.

For each experiment, the products were analyzed for water content, viscosity, density, distillation fractions, solids content, asphaltenes content, Conradson carbon, sulfur content and gas composition. Additionally, tests were made with feed containing added water of approximately 2 percent, 5 percent, and 10 percent by weight to determine the effects of water on the products and on process parameters. The runs with added water are tests CBU-9 to -11, -19 to -21, and -23 to -25.

The products from the batch and the continuous-flow tests were analyzed for structural components and compared with the structural components of the crude oil feed. The structural data were obtained by mass spectral analysis. The structural data on the crude oil feeds were determined by analysis of whole oil samples. The structural data on the products were determined by separate analysis on distillation cuts of the product. The result for the whole oil product was then calculated from these results.

EXAMPLE 1

The batch autoclave and the continuous flow unit experiments described above were performed on the Cold Lake crude oil samples. Analysis of the feed for these tests is given in Table 1A. Results from a mass spectrometer analysis of the 273° F.–430° F. fraction of the Cold Lake feed are given in Table 1B.

The experimental conditions and analysis of the products are given in Table 1C.

TABLE 1B

| MASS SPECTROMETER ANALYSIS OF 285–430° F. FRACTION OF THE COLD LAKE FEED | | |
|---|---|---|
| Paraffins | 35.3 | vol % |
| Olefins | ND | |

TABLE 1B-continued

| MASS SPECTROMETER ANALYSIS OF 285–430° F. FRACTION OF THE COLD LAKE FEED | | |
|---|---|---|
| Cycloparaffins | 35.0 | |
| Cond. Cycloparaffins* | 29.0 | |
| Alkyl Benzenes | 0.7 | |
| | 100.0 | vol 7% |

*May include cyclic olefins and certain sulfur compounds.
ND None detected.

TABLE 1A

| | ANALYSES ON COLD LAKE CRUDE | | | | | | |
|---|---|---|---|---|---|---|---|
| Temp. Range, °F. at 1 Atmos. | Whole Oil | IPB-285 | 285–430 | 430–525 | 525–650 | 650–950 | 950+ |
| Cut Vol % of Whole Oil | 100 | No | 0.99 | 3.05 | 11.16 | 34.24 | 50.56(1) |
| Σ Vol. % OH at Cut End | 100 | Material | 0.99 | 4.04 | 15.20 | 49.44 | 100.00(1) |
| Cut Wt % of Whole Oil | 100 | | 0.83 | 2.67 | 10.10 | 32.86 | 53.54(1) |
| Σ Wt % OH at Cut End | 100 | | 0.83 | 3.50 | 13.60 | 46.46 | 100.00(1) |
| °API Gravity 60/60 | 10.4 | | 36.9 | 30.4 | 25.4 | 16.4 | 2.8 |
| Specific Gravity 60/60 | 0.9969 | | 0.8402 | 0.8742 | 0.9017 | 0.9567 | 1.0539 |
| Sulfur, wt % | 4.44 | | 1.06 | 1.30 | 1.94 | 3.31 | 5.91 |
| Nitrogen, wt % | | | | | 122 ppm | 0.14 | |
| Pour Point, °F. | | | | <−75 | −75 | 5 | |
| Cetane Index(2) | | | | 35.4 | 39.5 | 25.2 | |
| Smoke Point, mm | | | | 11.1 | 9.9 | (3) | |
| Con Carbon Res, wt % | | | | | | 0.39 | 24.4 |
| Viscosity, | | | | | | | |
| 100° F., cst | | | | 3.02 | 6.01 | 149 | |
| 210° F., cst | | | | 1.19 | 1.69 | 9.34 | |
| 275° F., cp | | | | | | | 2,930 |
| Nickel, wppm | | | | | | 7.4 | 131 |
| Vanadium, wppm | | | | | | ND | 284 |

Sulfur balance closure = 101.2%.
ND = None Detected.
(1)By difference to give 100% recovery since loss is primarily in the residue.
(2)Calculated from midpoint of distillation fractions, not from a separate D-86 distillation.
(3)Material would not wick, test not applicable.

TABLE 1C

COLD LAKE HEAVY OILS RUN DATA

| Run | Temp °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % | Coke Wt. % | Gas Wt. % | IPB-450° F. Wt. % | 450–950° F. Wt. % | Resid +950 F. Wt. % | Con-Carbon Wt. % | Sulfur Wt. %* |
|---|---|---|---|---|---|---|---|---|---|---|---|---|---|---|---|---|---|---|---|---|
| Cold Lake Crude (Barrel 1) - Batch Tests | | | | | | | | | | | | | | | | | | | | |
| Feed | | | 0.7 | | | 41,600 | 687 | 11.5 | 60.2 | | 16.3 | | 0.00 | | 0.05 | 4.7 | 35.1 | 60.2 | 11.7 | 4.5 |
| Run 1 | 360 | 290 | 0.7 | 15 | Trace | 26,400 | 550 | 12.2 | 58.4 | 3.0 | 16.1 | 1.2 | 0.00 | 0.0 | 0.3 | 2.0 | 39.3 | 58.4 | 10.8 | 4.5 |
| Run 2 | 380 | 330 | 0.7 | 15 | 0.5 | 9,710 | 334 | 13.2 | 56.0 | 7.0 | 14.2 | 12.9 | 0.00 | 0.0 | 0.3 | 4.7 | 39.0 | 56.0 | 11.9 | 4.6 |
| Cold Lake Crude (Barrel 2) - Batch Tests | | | | | | | | | | | | | | | | | | | | |
| Feed | | | 0.2 | | | 47,100 | 886 | 11.4 | 59.0 | | 16.3 | | 0.00 | | 0.2 | 3.9 | 36.9 | 59.0 | | 4.6 |
| Run 1 | 370 | 250 | 0.2 | 15 | Trace | 16,300 | 370 | 12.9 | 56.1 | 4.9 | 14.5 | 11.0 | 0.00 | 0.0 | 0.3 | 6.4 | 37.2 | 56.1 | | 4.5 |
| Run 2 | 415 | 710 | 0.2 | 15 | 0.0 | 156 | 27 | 18.6 | 37.2 | 37.0 | 13.2 | 19.0 | 0.14 | 1.5 | 1.3 | 11.7 | 48.3 | 37.2 | 12.9 | 3.9 |
| Run 3 | 405 | 340 | 0.2 | 15 | Trace | 758 | 58 | 13.7 | 45.7 | 22.5 | 14.0 | 14.1 | 0.00 | 0.0 | 1.1 | 8.3 | 44.9 | 45.7 | | 4.1 |
| Continuous Unit Runs (Barrel 2) | | | | | | | | | | | | | | | | | | | | |
| CBU-1 | 400 | 40 | 0.2 | 1.8 | | 15,400 | 327 | | | | 14.2 | 12.9 | 0.00 | | | | | | | |
| | 400 | 40 | 0.2 | 2.2 | 0.0 | 13,900 | 333 | 13.6 | 56.8 | 3.7 | 14.2 | 12.9 | 0.00 | ND | 0.4 | 4.1 | 38.7 | 56.8 | 11.6 | 4.5 |
| | 415 | 20 | 0.2 | 0.6 | 0.0 | 10,400 | 347 | 13.9 | 51.9 | 12.0 | 14.2 | 12.9 | 0.00 | ND | 0.5 | 5.9 | 41.7 | 51.9 | 10.8 | |
| | 415 | 20 | 0.2 | 0.6 | 0.0 | 8,300 | 243 | 13.1 | 53.5 | 9.3 | 13.4 | 17.8 | 0.00 | ND | 0.5 | 5.3 | 40.7 | 53.5 | | 4.3 |
| CBU-2 | 400 | 390 | 0.2 | 2.4 | | 4,810 | 177 | | | | 13.3 | 18.4 | 0.00 | | | | | | | |
| | 400 | 400 | 0.2 | 2.7 | Trace | 4,080 | 148 | 12.1 | 53.6 | 9.2 | 13.1 | 19.6 | 0.00 | ND | 0.9 | 6.9 | 38.6 | 53.6 | 12.2 | 4.5 |
| | 400 | 1040 | 0.2 | 4.6 | | 2,470 | 111 | | | | 12.5 | 23.3 | 0.03 | | | | | | | 4.4 |
| | 400 | 1060 | 0.2 | 2.8 | Trace | 2,810 | 126 | 12.7 | 49.3 | 16.4 | 12.9 | 20.9 | 0.00 | ND | 1.3 | 9.7 | 39.7 | 49.3 | 12.4 | 4.3 |
| | 415 | 910 | 0.2 | 3.5 | | 664 | 61 | | | | 13.3 | 18.4 | 0.00 | | | | | | | |
| | 415 | 920 | 0.2 | 3.5 | Trace | 506 | 43 | 14.5 | 43.5 | 26.3 | 13.2 | 19.0 | 0.00 | ND | 2.9 | 8.9 | 44.7 | 43.5 | 13.0 | 4.2 |
| | 415 | 390 | 0.2 | 2.6 | | 819 | 64 | | | | 13.1 | 19.6 | 0.02 | | | | | | | |
| | 415 | 430 | 0.2 | 2.6 | Trace | 776 | 64 | 12.5 | 47.1 | 20.2 | 13.2 | 19.0 | 0.01 | ND | 3.1 | 9.7 | 40.1 | 47.1 | 12.3 | 4.3 |
| CBU-3 | 415 | 1000 | 0.2 | 3.4 | Trace | 723 | 54 | 13.0 | 45.4 | 23.1 | 13.5 | 17.2 | 0.00 | ND | 2.2 | 9.2 | 43.2 | 45.4 | 12.4 | 4.1 |
| | 425 | 990 | 0.2 | 2.9 | Trace | 281 | 29 | 13.6 | 39.2 | 33.6 | 13.5 | 17.2 | 0.00 | ND | 3.2 | 11.5 | 46.6 | 39.2 | 13.5 | 4.0 |
| | 435 | 1020 | 0.2 | 2.3 | Trace | 175 | 23 | 14.5 | 37.2 | 36.9 | 13.7 | 16.0 | 0.04 | ND | 4.2 | 12.9 | 45.7 | 37.2 | 13.3 | 4.0 |
| | 445 | 1020 | 0.2 | 2.0 | Trace | 63 | 9 | 16.7 | 29.3 | 50.3 | 12.7 | 22.1 | 0.06 | ND | 5.8 | 18.1 | 46.8 | 29.3 | 12.5 | 3.8 |
| CBU-4 | 415 | 2010 | 0.2 | 5.4 | Trace | 435 | 40 | 13.5 | 45.0 | 23.7 | 13.3 | 18.4 | 0.00 | ND | 4.3 | 8.1 | 42.6 | 45.0 | 10.6 | 4.0 |
| | 425 | 2060 | 0.2 | 4.5 | 0.0 | 245 | 25 | 14.5 | 39.3 | 33.4 | 13.2 | 19.0 | 0.02 | ND | 5.9 | 9.4 | 45.4 | 39.3 | 12.8 | 3.9 |
| | 435 | 2020 | 0.2 | 5.4 | Trace | 52 | 16 | 16.0 | 31.9 | 45.9 | 11.5 | 29.4 | 0.17 | ND | 6.3 | 14.4 | 47.4 | 31.9 | 11.4 | 3.7 |
| | 445 | 2020 | 0.2 | 3.5 | Trace | 25 | 9 | 16.8 | 28.5 | 51.7 | 9.4 | 42.3 | 0.00 | ND | 8.2 | 16.1 | 47.2 | 28.5 | 11.1 | 3.7 |
| CBU-5 | 435 | 1010 | 0.2 | 8.3 | 0.0 | 85 | 20 | 14.2 | 33.3 | 43.6 | 14.5 | 11.0 | 0.23 | ND | 7.4 | 11.5 | 47.8 | 33.3 | 12.7 | 4.0 |
| CBU-6 | 415 | 1060 | 0.2 | 4.1 | 0.0 | 442 | 49 | 13.9 | 45.5 | 22.9 | 13.0 | 20.3 | 0.00 | ND | 4.2 | 6.3 | 44.0 | 45.5 | 12.4 | 4.2 |
| | 415 | 1010 | 0.2 | 2.7 | 0.0 | 1,250 | 74 | 13.9 | 48.7 | 17.5 | 12.8 | 21.5 | 0.00 | ND | 2.3 | 6.1 | 42.9 | 48.7 | 12.6 | 4.3 |
| | 425 | 940 | 0.2 | 4.3 | 0.0 | 219 | 26 | 14.4 | 44.8 | 24.1 | 13.3 | 18.4 | 0.00 | ND | 3.7 | 6.3 | 45.2 | 44.8 | 13.3 | 4.1 |
| | 425 | 1030 | 0.2 | 2.7 | 0.0 | 605 | 46 | 14.2 | 47.1 | 20.2 | 13.0 | 20.3 | 0.00 | ND | 2.5 | 5.8 | 44.6 | 47.1 | 12.2 | 4.3 |
| CBU-8 | 425 | 1040 | 0.2 | 2.6 | 0.1 | 259 | 33 | 14.1 | 37.8 | 35.9 | 12.8 | 21.5 | 0.13 | ND | 4.8 | 15.5 | 41.9 | 37.8 | 12.5 | 4.2 |
| | 425 | 1030 | 0.2 | 2.6 | 0.1 | 841 | 68 | 13.2 | 43.1 | 27.0 | 12.9 | 20.9 | 0.08 | ND | 1.6 | 13.3 | 42.0 | 43.1 | 12.4 | 4.3 |
| | 435 | 1060 | 0.2 | 2.3 | 0.1 | 163 | 22 | 14.2 | 35.3 | 40.2 | 13.3 | 18.4 | 0.14 | ND | 4.7 | 18.0 | 42.0 | 35.3 | 13.2 | 4.0 |
| | 435 | 1000 | 0.2 | 2.2 | 0.05 | 222 | 27 | 13.9 | 39.1 | 33.7 | 13.7 | 16.0 | 0.17 | ND | 4.1 | 17.5 | 39.4 | 39.1 | 13.6 | 4.2 |
| | 445 | 1020 | 0.2 | 2.5 | 0.05 | 69 | 9 | 15.3 | 29.2 | 50.5 | 11.5 | 29.5 | 0.08 | ND | 5.3 | 24.2 | 41.4 | 29.2 | 12.9 | 4.0 |
| | 445 | 1010 | 0.2 | 1.7 | 0.05 | 198 | 26 | 13.9 | 37.2 | 37.0 | 13.5 | 17.2 | 0.21 | ND | 4.6 | 20.9 | 37.4 | 37.2 | 13.7 | 4.2 |
| CBU-9 | | | 5.1 | | | 39,300 | 1090 | | | | | | | | | | | | | |
| Feed | 415 | 1150 | 5.1 | 1.9 | 4.4 | 3,300 | 227 | 12.5 | 53.9 | 8.6 | 13.2 | 19.1 | 0.11 | ND | 2.9 | 2.6 | 40.6 | 53.8 | 12.4 | 4.4 |
| | 415 | 2080 | 5.1 | 3.1 | 4.6 | 1,730 | 141 | 12.6 | 52.8 | 10.5 | 13.0 | 20.3 | 0.07 | ND | 4.5 | 2.6 | 40.2 | 52.8 | 11.8 | 4.4 |
| | 425 | 1040 | 5.1 | 1.5 | 4.8 | 1,280 | 84 | 14.0 | 53.9 | 3.6 | 13.3 | 18.4 | 0.08 | ND | 3.7 | 2.7 | 39.8 | 53.9 | 12.6 | 4.3 |
| | 425 | 2020 | 5.1 | 3.1 | 3.1 | 1,100 | 86 | 13.9 | 48.0 | 18.6 | 12.8 | 21.5 | 0.05 | ND | 3.9 | 4.9 | 43.1 | 48.0 | 12.1 | 4.2 |
| CBU-10 | | | 5.1 | | | 45,600 | 816 | | | | | | | | | | | | | |

TABLE 1C-continued

COLD LAKE HEAVY OILS RUN DATA

| | | | | | | | | | | | | | | | | | | | | |
|---|---|---|---|---|---|---|---|---|---|---|---|---|---|---|---|---|---|---|---|---|
| Feed | 435 | 1040 | 5.1 | 1.4 | 3.2 | 572 | 52 | 13.2 | 46.7 | 20.6 | 13.2 | 18.9 | 0.08 | ND | 4.9 | 5.8 | 42.6 | 46.7 | 12.9 | 4.1 |
| | 435 | 2050 | 5.1 | 3.0 | 3.4 | 372 | 44 | 13.3 | 44.5 | 24.6 | 13.1 | 19.6 | 0.15 | ND | 3.7 | 6.5 | 45.3 | 44.5 | 13.1 | 4.2 |
| | 445 | 1070 | 5.1 | 1.8 | 2.0 | 283 | 35 | 13.9 | 40.6 | 31.2 | 14.3 | 12.4 | 0.11 | ND | 5.7 | 8.6 | 45.1 | 40.6 | 13.8 | 4.2 |
| | 445 | 2050 | 5.1 | 3.2 | 0.0 | 110 | 18 | 15.0 | 36.1 | 38.8 | 12.5 | 23.3 | 0.14 | ND | 6.4 | 11.3 | 46.2 | 36.1 | 12.2 | 3.8 |
| CBU-11 | | | 10.7 | | | 42,300 | 1,060 | | | | | | | | | | | | | |
| Feed | 415 | 2060 | 10.7 | 3.2 | 7.5 | 3,730 | 132 | 13.0 | 50.6 | 14.2 | 13.4 | 17.8 | 0.10 | ND | 2.1 | 5.3 | 42.0 | 50.6 | 12.3 | 4.2 |
| | 425 | 2070 | 10.7 | 2.9 | 6.4 | 1,300 | 73 | 13.6 | 46.2 | 21.7 | 12.8 | 21.4 | 0.12 | ND | 2.9 | 7.8 | 43.0 | 46.2 | 12.4 | 4.3 |
| | 435 | 2050 | 10.7 | 2.6 | 7.5 | 510 | 44 | 14.1 | 41.3 | 30.0 | 14.4 | 11.8 | 0.21 | ND | 3.7 | 11.5 | 43.6 | 41.3 | 13.1 | 4.0 |
| | 445 | 2030 | 10.7 | 2.5 | 4.7 | 260 | 41 | 16.0 | 38.8 | 34.2 | 15.9 | 2.1 | 0.37 | ND | 6.7 | 7.5 | 46.9 | 38.8 | 13.8 | 4.1 |
| CBU-12 | 415 | 1030 | 0.2 | 7.1 | 0.0 | 480 | 37 | 13.2 | 43.4 | 26.4 | 13.5 | 17.2 | 0.11 | ND | 3.8 | 8.0 | 44.8 | 43.4 | 13.3 | 4.3 |
| | 425 | 1040 | 0.2 | 5.6 | 0.1 | 248 | 26 | 13.8 | 37.6 | 36.3 | 13.8 | 15.5 | 0.23 | ND | 3.8 | 13.2 | 45.4 | 37.6 | 13.4 | 4.1 |
| | 435 | 1050 | 0.2 | 4.9 | 0.1 | 53 | 15 | 16.0 | 30.8 | 47.8 | 11.1 | 32.1 | 0.05 | ND | 5.7 | 18.3 | 45.2 | 30.8 | 11.9 | 4.0 |
| | 445 | 1080 | 0.2 | 3.0 | 0.0 | 20 | 12 | 17.4 | 24.6 | 58.3 | 9.7 | 40.7 | 0.08 | ND | 12.4 | 19.8 | 43.2 | 24.6 | 11.4 | 3.9 |
| CBU-13 | 445 | 1020 | 0.2 | 2.3 | 0.0 | 106 | 19 | 14.8 | 35.6 | 39.7 | 13.2 | 19.0 | 0.12 | 0.69 | 6.2 | 12.4 | 45.8 | 35.6 | 14.2 | 4.3 |
| | 445 | 1030 | 0.2 | 2.0 | 0.0 | 92 | 22 | 14.8 | 37.0 | 37.3 | 13.3 | 18.4 | 0.12 | 0.69 | 6.3 | 12.1 | 44.7 | 37.0 | 13.5 | 4.1 |
| | 445 | 1040 | 0.2 | 1.8 | 0.0 | 108 | 19 | 14.7 | 35.8 | 39.3 | 13.3 | 18.4 | 0.22 | 0.79 | 6.4 | 12.5 | 45.4 | 35.8 | 13.4 | 4.3 |
| | 445 | 1030 | 0.2 | 1.9 | 0.0 | 127 | 22 | 14.7 | 37.6 | 36.3 | 13.3 | 18.4 | 0.13 | 0.70 | 7.3 | 9.0 | 46.1 | 37.6 | 13.6 | 4.2 |
| CBU-14 | 435 | 1030 | 0.2 | 2.3 | 0.0 | 246 | 27 | 13.8 | 43.3 | 26.6 | 12.9 | 20.9 | 0.82 | 0.97 | 3.9 | 8.0 | 44.7 | 43.3 | 13.7 | 4.5 |
| | 435 | 1020 | 0.2 | 3.1 | 0.0 | 251 | 27 | 13.6 | 40.1 | 32.0 | 13.2 | 19.0 | 0.29 | 0.44 | 3.8 | 10.9 | 45.3 | 40.1 | 13.7 | 4.2 |
| | 435 | 1010 | 0.7 | 2.7 | 0.0 | 328 | 26 | 13.5 | 43.1 | 27.0 | 13.2 | 19.0 | 0.07 | 0.22 | 3.8 | 8.6 | 44.5 | 43.1 | 13.5 | 4.3 |
| | 435 | 1010 | 0.7 | 2.7 | 0.0 | 291 | 30 | 13.5 | 41.1 | 30.3 | 13.5 | 17.2 | 0.07 | 0.22 | 4.1 | 11.2 | 43.6 | 41.1 | 13.4 | 4.3 |
| CBU-15 | 425 | 1030 | 0.7 | 2.8 | 0.0 | 392 | 35 | 13.3 | 43.8 | 25.8 | 13.1 | 19.6 | 0.13 | 0.17 | 3.5 | 7.4 | 45.3 | 43.8 | 13.2 | 4.3 |
| | 425 | 1040 | 0.7 | 2.6 | 0.0 | 351 | 34 | 13.5 | 43.8 | 25.8 | 13.4 | 17.8 | 0.14 | 0.18 | 3.5 | 9.3 | 43.4 | 43.8 | 13.2 | 4.3 |
| | 425 | 1040 | 0.7 | 2.9 | 0.0 | 388 | 35 | 13.3 | 42.0 | 28.8 | 13.4 | 17.4 | 0.14 | 0.18 | 3.1 | 10.0 | 44.9 | 42.0 | 13.6 | 4.3 |
| | 425 | 1070 | 0.7 | 3.0 | 0.0 | 317 | 27 | 13.6 | 41.5 | 29.7 | 13.4 | 17.8 | 0.02 | 0.06 | 3.8 | 8.4 | 46.3 | 41.5 | 13.9 | 4.3 |
| CBU-16 | 415 | 1020 | 0.7 | 3.9 | 0.0 | 714 | 40 | 13.2 | 47.0 | 20.3 | 12.9 | 20.9 | 0.06 | ND | 4.7 | 6.9 | 41.8 | 47.0 | 13.1 | 4.4 |
| | 425 | 1030 | 0.7 | 3.4 | 0.0 | 319 | 25 | 13.6 | 41.9 | 29.0 | 13.3 | 18.4 | 0.19 | ND | 4.3 | 8.9 | 44.9 | 41.9 | 13.2 | 4.4 |
| CBU-17 | 435 | 1020 | 0.7 | 3.7 | 0.0 | 333 | 29 | 13.6 | 43.7 | 26.0 | 13.7 | 16.0 | 0.10 | ND | 2.7 | 10.6 | 43.1 | 43.7 | 13.1 | 4.0 |
| | 435 | 2010 | 0.7 | 8.8 | 0.0 | 73 | 12 | 15.3 | 28.1 | 52.4 | 10.7 | 34.4 | 0.04 | ND | 3.5 | 23.2 | 45.2 | 28.1 | 12.2 | 4.1 |
| | 445 | 1040 | 0.7 | 4.5 | 0.0 | 224 | 26 | 13.6 | 36.2 | 38.6 | 14.0 | 14.1 | 0.17 | ND | 3.3 | 19.2 | 41.3 | 36.2 | 14.0 | 4.3 |
| | 445 | 2020 | 0.7 | 11.5 | 0.0 | 41 | 9 | 14.4 | 24.2 | 58.9 | 9.6 | 41.1 | 0.02 | ND | 2.9 | 27.4 | 45.5 | 24.2 | 11.4 | 4.0 |
| | 445 | 1980 | 0.7 | 3.4 | 0.0 | 39 | 15 | 15.9 | 28.4 | 49.2 | 10.5 | 35.6 | 0.01 | ND | 9.0 | 15.2 | 47.3 | 28.4 | 12.4 | 3.9 |
| CBU-18 | 415 | 2010 | 0.7 | 9.8 | 0.0 | 664 | 52 | 13.0 | 45.8 | 22.4 | 13.1 | 19.6 | 0.05 | ND | 2.9 | 7.5 | 43.7 | 45.8 | 13.4 | 4.2 |
| | 415 | 2480 | 0.7 | 11.3 | 0.0 | 484 | 44 | 13.3 | 45.5 | 22.8 | 13.2 | 19.0 | 0.06 | ND | 3.2 | 6.5 | 44.7 | 45.5 | 13.5 | 4.3 |
| | 415 | 2520 | 0.7 | 6.9 | 0.0 | 928 | 64 | 12.9 | 48.2 | 18.2 | 12.9 | 20.9 | 0.05 | ND | 3.2 | 5.6 | 43.0 | 48.2 | 12.9 | 4.2 |
| | 425 | 2000 | 0.7 | 6.7 | 0.0 | 259 | 29 | 13.5 | 42.3 | 28.2 | 13.6 | 16.6 | 0.05 | ND | 3.3 | 7.1 | 47.2 | 42.3 | 13.2 | 4.2 |
| CBU-19 | | | 1.8 | | | 50,300 | 741 | | | | | | | | | | | | | |
| Feed | 415 | 970 | 1.8 | 4.0 | 0.7 | 4,370 | 153 | 12.9 | 53.2 | 9.8 | 13.1 | 19.6 | 0.02 | ND | 1.5 | 3.1 | 42.2 | 53.2 | 12.7 | 4.5 |
| | 415 | 1960 | 1.8 | 4.5 | 1.4 | 1,510 | 87 | 14.4 | 52.5 | 11.0 | 12.3 | 24.5 | 0.00 | ND | 2.8 | 3.7 | 41.1 | 52.5 | 12.5 | 4.3 |
| | 425 | 1030 | 1.8 | 3.0 | 0.7 | 1,420 | 82 | 13.3 | 52.7 | 10.7 | 12.6 | 22.7 | 0.00 | ND | 1.6 | 4.6 | 41.2 | 52.7 | 13.1 | 4.3 |
| | 425 | 2030 | 1.8 | 4.2 | 0.8 | 606 | 45 | 12.7 | 47.2 | 20.0 | 12.3 | 24.5 | 0.07 | ND | 3.1 | 6.1 | 43.6 | 47.2 | 13.2 | 4.3 |
| | 435 | 1060 | 1.8 | 1.8 | 1.1 | 615 | 49 | 14.2 | 47.9 | 18.2 | 12.5 | 23.3 | 0.07 | ND | 3.5 | 5.0 | 43.6 | 47.9 | 13.0 | 4.3 |
| | 435 | 2000 | 1.8 | 4.3 | 0.3 | 269 | 37 | 13.3 | 41.1 | 30.5 | 12.6 | 22.7 | 0.22 | ND | 8.5 | 4.7 | 45.6 | 41.1 | 13.6 | 4.0 |
| CBU-20 | | | 1.5 | | | 46,000 | 737 | | | | | | | | | | | | | |
| Feed | 445 | 2040 | 1.5 | 3.4 | 0.0 | 72 | 14 | 15.0 | 32.2 | 45.5 | 10.8 | 33.7 | 0.01 | ND | 7.7 | 13.5 | 46.7 | 32.2 | 12.0 | 3.9 |
| | 445 | 1050 | 1.5 | 2.1 | 0.1 | 422 | 40 | 13.5 | 46.1 | 21.9 | 12.8 | 21.5 | 0.35 | ND | 4.7 | 6.2 | 43.0 | 46.1 | 13.7 | 4.3 |
| | 445 | 2040 | 1.5 | 3.1 | 0.0 | 94 | 16 | 15.5 | 36.2 | 38.7 | 11.7 | 28.2 | 0.27 | ND | 7.1 | 9.2 | 47.6 | 36.2 | 12.8 | 4.2 |
| | 445 | 2030 | 1.5 | 2.3 | 0.0 | 345 | 32 | 13.6 | 43.2 | 26.8 | 12.9 | 20.9 | 0.15 | ND | 4.3 | 5.9 | 46.7 | 43.2 | 13.8 | 4.4 |
| CBU-21 | | | 10.8 | | | | | | | | | | | | | | | | | |
| Feed | 435 | 2000 | 10.8 | 2.4 | 6.2 | 2,170 | 105 | 10.7 | 51.0 | 13.6 | 12.3 | 24.5 | 0.07 | ND | 3.3 | 4.2 | 41.5 | 51.0 | 12.5 | 4.5 |
| | 435 | 1030 | 10.8 | 1.4 | 6.7 | 2,110 | 145 | 13.5 | 50.0 | 15.3 | 13.0 | 20.2 | 0.11 | ND | 3.6 | 4.0 | 42.4 | 50.0 | 13.0 | 4.1 |
| CBU-23 | | | 10.8 | | | 56,200 | 763 | | | | | | | | | | | | | |

TABLE 1C-continued

COLD LAKE HEAVY OILS RUN DATA

| | | | | | | | | | | | | | | | | | | | | |
|---|---|---|---|---|---|---|---|---|---|---|---|---|---|---|---|---|---|---|---|---|
| Feed | 445 | 2010 | 10.8 | 2.3 | 2.8 | 228 | 33 | 15.1 | 34.2 | 42.0 | 13.1 | 19.6 | 0.31 | 0.93 | 9.7 | 7.7 | 48.4 | 34.2 | 13.1 | 3.7 |
| | 445 | 2020 | 10.8 | 2.4 | 7.1 | 202 | 29 | 14.5 | 37.1 | 37.1 | 12.6 | 22.7 | 0.45 | 1.07 | 8.2 | 8.3 | 46.5 | 37.1 | 14.1 | 3.7 |
| | 445 | 2010 | 10.8 | 3.8 | 2.0 | 196 | 36 | 15.6 | 35.5 | 39.8 | 12.4 | 23.9 | 0.12 | 3.73 | 5.5 | 10.4 | 48.6 | 35.5 | 13.1 | 4.0 |
| | 445 | 2000 | 10.8 | 2.9 | 1.7 | 225 | 33 | 14.6 | 36.7 | 37.8 | 11.6 | 28.8 | 0.12 | 2.68 | 6.2 | 10.5 | 46.5 | 36.7 | 13.2 | 4.0 |
| | 445 | 1970 | 10.8 | 3.9 | 0.4 | 242 | 20 | 14.7 | 38.3 | 35.1 | 13.2 | 19.0 | 0.21 | 0.83 | 3.5 | 13.9 | 44.4 | 38.3 | 13.6 | 3.7 |
| CBU-24 | | | 9.7 | | | 58,700 | 751 | | | | | | | | | | | | | |
| Feed | 435 | 2040 | 9.7 | 2.8 | 6.4 | 748 | 70 | 13.8 | 44.9 | 23.9 | 12.2 | 25.2 | 0.02 | 0.75 | 4.6 | 5.3 | 45.1 | 44.9 | 13.0 | 3.8 |
| | 435 | 2020 | 9.7 | 2.6 | 9.0 | 688 | 78 | 13.2 | 44.2 | 25.1 | 11.9 | 27.0 | 0.01 | 0.74 | 3.2 | 9.9 | 42.7 | 44.2 | 12.4 | 3.8 |
| | 435 | 2070 | 9.7 | 2.5 | 7.1 | 740 | 80 | 12.2 | 49.0 | 16.9 | 13.0 | 20.2 | 0.10 | 0.83 | 4.2 | 4.1 | 42.7 | 49.0 | 13.1 | 3.9 |
| | 435 | 2000 | 9.7 | 2.8 | 5.9 | 756 | 79 | 12.7 | 47.5 | 19.5 | 11.7 | 28.2 | 0.00 | 0.73 | 3.8 | 3.3 | 45.4 | 47.5 | 13.5 | 3.7 |
| CBU-25 | | | 9.8 | | | 66,500 | 818 | | | | | | | | | | | | | |
| Feed | 425 | 2010 | 9.8 | 3.5 | 4.3 | 1,030 | 80 | 12.9 | 47.2 | 20.0 | 12.3 | 24.5 | 0.08 | 0.04 | 4.0 | 4.1 | 44.8 | 47.2 | 12.8 | 4.1 |
| | 425 | 2030 | 9.8 | 2.8 | 7.8 | 1,110 | 81 | 12.7 | 50.3 | 14.7 | 13.2 | 19.0 | 0.08 | 0.08 | 2.5 | 5.3 | 41.9 | 50.3 | 12.8 | 4.1 |
| | 425 | 2050 | 9.8 | 3.0 | 4.3 | 1,040 | 79 | 12.7 | 51.9 | 12.0 | 12.4 | 23.9 | 0.11 | 0.09 | 3.3 | 2.4 | 42.5 | 51.9 | 13.1 | 3.9 |
| | 425 | 2050 | 9.8 | 2.8 | 8.7 | 1,160 | 87 | 12.3 | 54.5 | 7.7 | 13.0 | 20.2 | 0.09 | 0.07 | 1.8 | 5.7 | 38.1 | 54.5 | 12.9 | 4.1 |

*Water- and solids-free basis.
**Viscosity measured on oil after coke was removed.
***Residence time for continuous unit was calculated for temperatures within 5° C. of reaction temperature.

| | Volume % | | | | | | | Sulfur Distribution | | | Gas Analysis, % | | | | | | | | | |
|---|---|---|---|---|---|---|---|---|---|---|---|---|---|---|---|---|---|---|---|---|
| | IBP-450° F. | | | 450-650° F. | 650-950° F. | 450-950° F. | | % | % | % | | | | | | | | | | |
| Run | Vol % | °API | Sp gr | | | °API | Sp gr | Liquid | Gas | Solids | $H_2$ | $CH_4$ | CO | $CO_2$ | $C_2H_6$ | $H_2S$ | $C_3H_8$ | $C_2H_4$ | $C_3H_6$ | Other |
| | | | | | | | | Cold Lake Crude - Barrel 1 | | | | | | | | | | | | |
| Feed | 5.3 | 31.9 | .866 | 20.4 | 16.7 | 19.8 | .935 | | | | | | | | | | | | | |
| Run 1 | 2.3 | 33.2 | .859 | 21.6 | 20.1 | 20.3 | .932 | | | | | | | | | | | | | |
| Run 2 | 5.4 | 33.3 | .859 | 20.7 | 18.3 | 19.8 | .935 | | | | | | | | | | | | | |
| | | | | | | | | Cold Lake Crude - Barrel 2 | | | | | | | | | | | | |
| Feed | 4.5 | 32.7 | .862 | 21.7 | 17.4 | 19.8 | .935 | | | | | | | | | | | | | |
| Run 1 | 7.3 | 31.5 | .868 | 20.1 | 18.9 | 19.4 | .938 | | | | | | | | | | | | | |
| Run 2 | 13.5 | 41.2 | .819 | 21.9 | 26.9 | 20.2 | .933 | | | | | | | | | | | | | |
| Run 3 | 9.7 | 39.2 | .829 | 22.3 | 24.5 | 19.8 | .935 | | | | | | | | | | | | | |
| | | | | | | | | Continuous Unit Runs | | | | | | | | | | | | |
| CBU-1* | 4.6 | 33.0 | .860 | 18.5 | 22.1 | 20.3 | .932 | | | | | | | | | | | | | |
| | 6.7 | 33.2 | .859 | 22.1 | 21.4 | 20.0 | .934 | | | | | | | | | | | | | |
| | 6.0 | 32.5 | .863 | 19.8 | 22.9 | 19.8 | .935 | | | | | | | | | | | | | |
| CBU-2** | 7.9 | 32.5 | .863 | 19.5 | 21.4 | 19.7 | .936 | | | | | | | | | | | | | |
| | 11.0 | 31.9 | .866 | 20.3 | 21.6 | 19.4 | .938 | | | | | | | | | | | | | |
| | 10.4 | 35.2 | .849 | 22.0 | 25.5 | 19.8 | .935 | | | | | | | | | | | | | |
| | 11.9 | 40.6 | .822 | 17.8 | 25.1 | 20.0 | .934 | 92 | 9 | 0 | Trace | 33.3 | 0.3 | 7.2 | 20.8 | 22.2 | 16.2 | | | |
| CBU-3 | 11.2 | 42.0 | .816 | 21.4 | 24.7 | 20.0 | .934 | 88 | 5 | 0 | Trace | 39.1 | 0.6 | 7.0 | 23.8 | 12.2 | 17.4 | | | |
| | 14.3 | 43.5 | .809 | 24.0 | 25.2 | 19.5 | .937 | | | | | | | | | | | | | |
| | 16.3 | 46.6 | .794 | 23.6 | 25.7 | 19.8 | .935 | 84 | 19 | 0 | Trace | 35.7 | 0.6 | 4.6 | 22.1 | 20.9 | 16.3 | | | |
| | 22.7 | 45.6 | .799 | 27.6 | 22.2 | 17.8 | .948 | 79 | 23 | 0 | Trace | 35.0 | Trace | 3.9 | 23.9 | 19.0 | 18.2 | | | |
| CBU-4 | 9.9 | 42.7 | .812 | 19.1 | 26.8 | 21.3 | .926 | 85 | 7 | 0 | Trace | 40.2 | Trace | 5.2 | 23.9 | 13.2 | 17.5 | | | |
| | 11.6 | 41.7 | .817 | 23.6 | 25.9 | 22.0 | .922 | 82 | 18 | 0 | Trace | 34.7 | Trace | 5.3 | 22.4 | 19.9 | 17.7 | | | |
| | 18.6 | 48.3 | .787 | 27.0 | 24.6 | 20.2 | .933 | 76 | 26 | 0 | 0.0 | 36.1 | Trace | 4.6 | 23.3 | 18.8 | 17.4 | | | |
| | 21.1 | 48.3 | .787 | 26.2 | 25.7 | 19.7 | .936 | 74 | 29 | 0 | 0.0 | 38.3 | 0.0 | 3.4 | 24.5 | 15.7 | 18.0 | | | |
| CBU-5 | 14.3 | 42.8 | .812 | 22.6 | 29.0 | 19.7 | .936 | 84 | 19 | 0 | 0.0 | 25.5 | 0.0 | 2.2 | 28.7 | 22.2 | 21.3 | | | |
| CBU-6 | 7.6 | 40.4 | .823 | 20.8 | 26.2 | 21.1 | .927 | 90 | 6 | 0 | 2.3 | 37.5 | 0.0 | 3.3 | 18.9 | 24.5 | 13.4 | | | |
| | 7.4 | 38.6 | .832 | 20.1 | 23.2 | 20.3 | .932 | 92 | 4 | 0 | 2.4 | 37.7 | 0.0 | 3.1 | 19.4 | 23.1 | 14.3 | | | |
| | 7.6 | 42.6 | .813 | 20.7 | 27.3 | 21.6 | .924 | 87 | 8 | 0 | Trace | 40.1 | 0.0 | 2.5 | 21.3 | 21.5 | 14.5 | | | |

TABLE 1C-continued

COLD LAKE HEAVY OILS RUN DATA

| | | | | | | | | | | | | | | | | | | | |
|---|---|---|---|---|---|---|---|---|---|---|---|---|---|---|---|---|---|---|---|
| | 7.0 | 41.8 | .816 | 20.6 | 26.7 | 21.1 | .927 | 92 | 9 | 0 | 1.9 | 29.7 | 0.0 | 3.0 | 25.2 | 23.6 | 16.6 | | |
| CBU-8 | 18.8 | 39.1 | .829 | 24.0 | 21.8 | 21.6 | .924 | 88 | 17 | 0 | 0.0 | 23.2 | 0.0 | 2.9 | 30.5 | 20.3 | 23.1 | | |
| | 15.5 | 36.9 | .840 | 22.7 | 21.7 | 19.0 | .940 | 92 | 8 | 0 | 0.0 | 27.7 | 0.0 | 3.3 | 25.1 | 26.9 | 17.0 | | |
| | 22.0 | 40.8 | .821 | 24.1 | 20.7 | 18.1 | .946 | 84 | 20 | 0 | 0.0 | 14.9 | 0.0 | 2.9 | 34.3 | 26.2 | 21.7 | | |
| | 21.3 | 39.6 | .827 | 24.3 | 17.7 | 18.7 | .942 | 88 | 17 | 0 | 0.0 | 22.2 | 0.0 | 1.9 | 29.3 | 23.2 | 22.8 | | |
| | 29.8 | 41.0 | .820 | 25.9 | 17.8 | 16.5 | .956 | 83 | 17 | 0 | 0.0 | 25.8 | 0.0 | 1.7 | 31.3 | 16.5 | 23.7 | | |
| | 25.2 | 36.6 | .842 | 21.6 | 18.3 | 17.5 | .950 | 88 | 20 | 0 | 0.0 | 27.0 | 0.0 | 2.1 | 28.3 | 20.9 | 21.9 | | |
| CBU-9 | 5.4 | 35.2 | .849 | 20.9 | 22.9 | 21.0 | .928 | 90 | 9 | 0 | 6.7 | 24.8 | 0.6 | 4.0 | 17.6 | 23.0 | 11.9 | 7.8 | 3.4 |
| | 3.0 | 35.2 | .849 | 23.6 | 19.7 | 21.6 | .924 | 90 | 8 | 0 | 4.7 | 27.8 | 0.6 | 5.4 | 20.0 | 21.0 | 13.9 | 4.1 | 2.5 |
| | 5.5 | 35.6 | .847 | 16.2 | 26.4 | 22.0 | .922 | 90 | 9 | 0 | 6.5 | 22.5 | 0.6 | 3.5 | 18.4 | 22.8 | 13.2 | 8.4 | 4.0 |
| | 5.9 | 39.6 | .827 | 21.2 | 24.7 | 20.7 | .930 | 88 | 7 | 0 | 3.4 | 26.2 | 0.4 | 4.3 | 22.3 | 19.5 | 17.1 | 4.0 | 2.8 |
| CBU-10 | 7.0 | 39.1 | .830 | 21.7 | 25.0 | 21.1 | .927 | 85 | 14 | 0 | 4.7 | 27.8 | Trace | 2.8 | 20.0 | 20.9 | 14.9 | 8.1 | 4.3 |
| | 7.9 | 40.6 | .822 | 22.8 | 25.8 | 20.8 | .929 | 90 | 10 | 0 | 2.3 | 27.8 | Trace | 2.7 | 22.6 | 21.0 | 17.2 | 3.4 | 3.0 |
| | 10.7 | 43.2 | .810 | 22.5 | 26.6 | 21.5 | .925 | 88 | 13 | 0 | 4.0 | 20.7 | Trace | 2.5 | 23.1 | 19.8 | 17.4 | 7.9 | 4.6 |
| | 14.5 | 44.1 | .806 | 25.5 | 25.5 | 20.7 | .930 | 79 | 18 | 0 | 1.9 | 30.0 | Trace | 2.9 | 25.7 | 16.4 | 19.9 | 0.6 | 2.6 |
| CBU-11 | 6.2 | 36.5 | .842 | 21.0 | 23.4 | 19.5 | .937 | 90 | 5 | 0 | 3.3 | 27.7 | 0.0 | 4.9 | 20.6 | 15.4 | 16.2 | 8.7 | 3.3 |
| | 9.2 | 36.6 | .842 | 22.8 | 27.5 | 19.2 | .939 | 86 | 9 | 0 | 4.2 | 26.3 | 0.0 | 5.4 | 19.7 | 22.3 | 14.6 | 5.9 | 1.6 |
| | 13.7 | 38.4 | .833 | 23.3 | 22.9 | 19.2 | .939 | 85 | 10 | 0 | 5.0 | 27.0 | 0.0 | 4.0 | 18.3 | 17.9 | 16.9 | 5.5 | 4.6 |
| | 9.2 | 41.2 | .819 | 23.0 | 27.3 | 20.2 | .933 | 81 | 17 | 0 | 1.5 | 14.2 | 0.0 | 3.8 | 26.1 | 20.3 | 20.6 | 7.0 | 6.3 |
| CBU-12 | 9.9 | 42.7 | .812 | 22.6 | 25.9 | 20.7 | .930 | 91 | 15 | 0 | 2.3 | 28.9 | Trace | 3.9 | 21.4 | 21.0 | 15.5 | 4.1 | 2.8 |
| | 16.4 | 43.7 | .807 | 25.0 | 24.0 | 19.7 | .936 | 86 | 17 | 0 | 1.1 | 26.2 | Trace | 2.5 | 26.5 | 20.9 | 19.7 | 1.4 | 2.2 |
| | 22.7 | 43.8 | .807 | 27.1 | 26.0 | 29.7 | .942 | 83 | 18 | 0 | Trace | 30.9 | 0.0 | 2.0 | 26.9 | 17.7 | 21.4 | 0.0 | 0.0 |
| | 25.2 | 41.9 | .816 | 22.3 | 24.8 | 17.1 | .952 | 78 | 31 | 0 | 1.1 | 26.2 | Trace | 1.9 | 27.3 | 15.8 | 23.4 | 2.4 | 1.9 |
| CBU-13 | 15.1 | 39.9 | .826 | 24.4 | 24.8 | 19.2 | .939 | 90 | 18 | 1.02 | 0.2 | 31.4 | 0.4 | 1.6 | 25.8 | 19.5 | 20.6 | 0.5 | 0.0 |
| | 15.0 | 43.2 | .810 | 23.1 | 25.1 | 20.0 | .934 | 86 | 17 | 1.02 | 1.8 | 30.1 | 0.3 | 1.7 | 24.8 | 17.1 | 19.7 | 2.7 | 0.8 |
| | 15.5 | 32.3 | .864 | 24.7 | 24.3 | 19.7 | .936 | 90 | 17 | 1.17 | 2.1 | 30.9 | 0.3 | 1.7 | 24.6 | 16.9 | 19.3 | 3.1 | 2.5 |
| | 11.2 | 41.8 | .817 | 24.7 | 25.6 | 20.7 | .930 | 86 | 18 | 1.03 | 2.1 | 30.1 | 0.2 | 1.7 | 24.4 | 16.9 | 23.5 | 2.7 | 0.0 |
| CBU-14 | 9.7 | 39.4 | .828 | 20.9 | 26.7 | 20.5 | .931 | 96 | 11 | 2.58 | 1.0 | 31.3 | Trace | 1.8 | 24.3 | 20.3 | 18.4 | 2.5 | 0.4 |
| | 13.2 | 40.3 | .823 | 23.4 | 24.9 | 19.5 | .937 | 91 | 12 | 1.17 | 1.9 | 30.1 | 0.3 | 1.9 | 23.6 | 20.0 | 18.0 | 1.6 | 2.7 |
| | 10.5 | 40.8 | .821 | 22.4 | 25.4 | 20.3 | .932 | 91 | 11 | 0.59 | 0.7 | 30.8 | 0.3 | 2.2 | 23.7 | 19.5 | 18.3 | 1.7 | 2.8 |
| | 13.5 | 38.0 | .835 | 23.0 | 23.5 | 19.2 | .939 | 91 | 12 | 0.56 | 1.0 | 31.2 | 0.3 | 2.2 | 24.0 | 19.7 | 19.2 | 1.7 | 0.7 |
| CBU-15 | 8.9 | 40.0 | .825 | 23.3 | 25.1 | 20.3 | .932 | 92 | 10 | 0.38 | 0.0 | 29.2 | 0.4 | 2.7 | 24.4 | 22.5 | 18.2 | 0.0 | 0.0 |
| | 12.0 | 39.4 | .828 | 22.9 | 24.9 | 19.4 | .938 | 92 | 10 | 0.39 | 0.0 | 26.8 | 0.2 | 2.6 | 27.6 | 21.7 | 19.3 | 0.0 | 0.0 |
| | 11.2 | 38.5 | .833 | 21.6 | 24.6 | 20.2 | .933 | 92 | 9 | 0.40 | 1.9 | 31.0 | 0.4 | 2.5 | 24.0 | 20.5 | 17.4 | 0.0 | 0.0 |
| | 10.1 | 39.4 | .828 | 24.3 | 25.1 | 20.0 | .934 | 92 | 11 | 0.13 | 2.0 | 30.5 | 0.3 | 2.4 | 23.4 | 21.4 | 17.5 | 0.0 | 0.0 |
| CBU-16 | 8.3 | 38.7 | .832 | 21.8 | 22.9 | 20.5 | .931 | 94 | 9 | 0 | 2.3 | 26.1 | 0.8 | 4.6 | 22.3 | 19.8 | 18.5 | 2.9 | 2.5 |
| | 10.9 | 41.4 | .818 | 21.4 | 26.6 | 20.5 | .931 | 94 | 10 | 0 | Trace | 33.3 | Trace | 2.4 | 23.9 | 20.6 | 17.4 | 1.8 | 0.0 |
| CBU-17 | 13.0 | 42.0 | .816 | 21.9 | 24.2 | 20.5 | .931 | 85 | 11 | 0 | Trace | 32.2 | 0.3 | 2.5 | 25.0 | 21.4 | 18.7 | 0.0 | 0.0 |
| | 27.5 | 38.3 | .833 | 27.1 | 19.6 | 16.8 | .954 | 87 | 8 | 0 | Trace | 34.5 | 0.3 | 1.7 | 27.3 | 15.1 | 21.2 | 0.0 | 0.0 |
| | 22.9 | 37.8 | .836 | 22.7 | 20.6 | 17.3 | .951 | 92 | 8 | 0 | 1.6 | 33.0 | 0.3 | 2.2 | 26.4 | 15.8 | 20.9 | 0.0 | 0.0 |
| | 32.5 | 37.8 | .836 | 28.8 | 17.9 | 15.0 | .966 | 85 | 6 | 0 | Trace | 34.1 | Trace | 1.5 | 29.5 | 11.3 | 23.7 | 0.0 | 0.0 |
| | 18.9 | 40.4 | .823 | 28.0 | 22.9 | 16.8 | .954 | 79 | 22 | 0 | Trace | 34.5 | 0.3 | 1.5 | 27.9 | 14.0 | 21.8 | 0.0 | 0.0 |
| CBU-18 | 9.0 | 36.4 | .843 | 23.8 | 23.1 | 20.0 | .934 | 89 | 11 | 0 | Trace | 37.1 | 0.1 | 2.6 | 23.4 | 20.2 | 16.7 | 0.0 | 0.0 |
| Feed | 7.8 | 38.1 | .834 | 21.7 | 26.3 | 20.5 | .931 | 91 | 10 | 0 | Trace | 34.1 | 0.1 | 3.2 | 24.9 | 19.8 | 17.9 | 0.0 | 0.0 |
| | 6.7 | 37.6 | .837 | 21.6 | 24.7 | 20.5 | .931 | 89 | 12 | 0 | Trace | 34.3 | Trace | 2.9 | 23.4 | 22.5 | 16.9 | 0.0 | 0.0 |
| | 8.5 | 38.1 | .835 | 23.4 | 27.1 | 20.3 | .932 | 89 | 10 | 0 | Trace | 33.9 | 0.1 | 2.7 | 25.8 | 19.0 | 18.4 | 0.0 | 0.0 |
| CBU-19 | 3.6 | 35.9 | .845 | 23.9 | 20.9 | 20.7 | .930 | 97 | 5 | 0 | 2.9 | 30.9 | 0.8 | 4.8 | 20.4 | 21.4 | 14.8 | 3.7 | 0.0 |
| Feed | 4.2 | 37.3 | .838 | 19.0 | 23.6 | 21.0 | .928 | 92 | 7 | 0 | 3.5 | 31.9 | 0.8 | 5.0 | 19.8 | 21.9 | 12.9 | 4.4 | 0.0 |
| | 5.3 | 37.1 | .839 | 18.9 | 24.1 | 20.8 | .929 | 92 | 7 | 0 | 2.8 | 30.9 | 0.4 | 3.9 | 21.4 | 22.1 | 14.8 | 3.7 | 0.0 |
| | 7.1 | 38.5 | .832 | 22.4 | 23.4 | 20.8 | .929 | 92 | 6 | 0 | 1.1 | 27.7 | 0.1 | 4.5 | 24.7 | 24.1 | 16.9 | 0.9 | 0.0 |
| | 5.9 | 39.4 | .828 | 21.1 | 25.2 | 21.4 | .925 | 92 | 7 | 0 | 4.2 | 29.9 | 0.5 | 3.4 | 21.7 | 20.8 | 15.0 | 4.6 | 0.0 |
| | 5.8 | 39.0 | .830 | 23.2 | 26.4 | 21.3 | .926 | 83 | 15 | 0 | 2.1 | 32.0 | 0.2 | 3.2 | 24.0 | 20.2 | 18.7 | 1.8 | 0.0 |

TABLE 1C-continued

COLD LAKE HEAVY OILS RUN DATA

| | | | | | | | | | | | | | | | | | | | | |
|---|---|---|---|---|---|---|---|---|---|---|---|---|---|---|---|---|---|---|---|---|
| CBU-20 | 16.5 | 39.9 | .826 | 25.8 | 24.7 | 19.2 | .939 | 80 | 22 | 0 | 3.3 | 29.6 | 0.0 | 2.4 | 27.4 | 16.3 | 21.1 | Trace | 0.0 | |
| Feed | 7.2 | 37.8 | .836 | 20.7 | 24.5 | 21.0 | .928 | 92 | 10 | 0 | 1.1 | 31.2 | 0.3 | 3.1 | 24.3 | 21.1 | 18.8 | Trace | 0.0 | |
| | 11.2 | 40.4 | .823 | 26.7 | 24.5 | 20.5 | .931 | 88 | 17 | 0 | 1.1 | 32.9 | 0.0 | 2.6 | 25.9 | 17.4 | 20.2 | Trace | 0.0 | |
| | 7.0 | 39.4 | .828 | 23.1 | 26.1 | 20.5 | .931 | 93 | 12 | 0 | 3.2 | 30.3 | 0.4 | 2.9 | 23.8 | 21.5 | 17.8 | Trace | 0.0 | |
| CBU-21 | 5.1 | 41.5 | .818 | 20.8 | 23.8 | 20.5 | .931 | 97 | 3 | 0 | 6.7 | 31.7 | 0.9 | 3.0 | 22.7 | 19.3 | 15.7 | 0.0 | 0.0 | |
| Feed | 4.8 | 40.0 | .825 | 20.6 | 24.7 | 20.3 | .932 | 87 | 12 | 0 | 8.4 | 30.9 | 1.6 | 2.7 | 20.2 | 22.0 | 13.7 | 0.0 | 0.0 | |
| CBU-23 | 9.8 | 43.0 | .810 | 26.1 | 27.4 | 20.5 | .931 | 75 | 29 | 0 | 5.0 | 31.8 | 1.1 | 2.8 | 15.8 | 19.8 | 11.7 | 0.0 | 0.0 | 11.9 |
| Feed | 10.2 | 41.6 | .817 | 25.1 | 25.2 | 20.3 | .932 | 82 | 18 | 0 | 5.8 | 34.5 | 0.8 | 3.6 | 18.8 | 16.9 | 13.9 | 0.0 | 0.0 | 5.6 |
| | 12.5 | 42.1 | .815 | 24.5 | 26.2 | 20.0 | .934 | 84 | 15 | 0 | 5.0 | 30.8 | 0.6 | 3.2 | 16.2 | 19.6 | 11.8 | 0.0 | 0.0 | 14.2 |
| | 12.6 | 39.9 | .825 | 25.3 | 23.9 | 19.7 | .936 | 84 | 15 | 0 | 4.9 | 31.5 | 0.6 | 3.3 | 15.9 | 19.4 | 11.7 | 0.0 | 0.0 | 12.6 |
| | 16.7 | 43.9 | .807 | 22.6 | 23.8 | 20.3 | .932 | 78 | 16 | 0 | 5.6 | 30.6 | 0.6 | 3.9 | 17.3 | 22.1 | 13.0 | 0.0 | 0.0 | 6.9 |
| CBU-24 | 6.3 | 38.3 | .833 | 18.6 | 29.1 | 20.0 | .934 | 82 | 11 | 0 | 4.1 | 30.8 | 2.5 | 3.1 | 13.8 | 23.9 | 9.5 | 0.0 | 1.0 | 12.1 |
| Feed | 11.9 | 40.8 | .821 | 21.7 | 23.2 | 19.7 | .936 | 81 | 15 | 0 | 5.4 | 30.0 | 1.1 | 3.9 | 14.1 | 26.1 | 10.0 | 0.0 | 0.7 | 8.6 |
| | 4.9 | 40.0 | .825 | 21.6 | 23.9 | 20.8 | .929 | 82 | 13 | 0 | 5.6 | 29.7 | 1.5 | 4.1 | 14.0 | 25.5 | 9.6 | 0.0 | 0.7 | 9.3 |
| | 4.0 | 40.3 | .824 | 24.2 | 24.9 | 20.8 | .929 | 79 | 14 | 0 | 5.2 | 29.4 | 1.3 | 4.1 | 13.9 | 25.2 | 9.8 | 0.0 | 0.8 | 10.4 |
| CBU-25 | 4.9 | 38.2 | .834 | 19.4 | 28.7 | 20.7 | .930 | 87 | 12 | 0 | 4.5 | 27.3 | 1.7 | 4.4 | 14.0 | 27.3 | 9.4 | 0.0 | 0.8 | 10.8 |
| Feed | 6.3 | 39.7 | .826 | 19.7 | 25.2 | 21.0 | .928 | 88 | 8 | 0 | 4.5 | 27.3 | 1.7 | 4.4 | 14.0 | 27.3 | 9.4 | 0.0 | 0.8 | 10.8 |
| | 2.8 | 39.9 | .826 | 18.9 | 26.7 | 21.5 | .925 | 88 | 7 | 0 | 5.4 | 30.4 | 1.4 | 4.9 | 14.1 | 26.0 | 9.2 | 0.0 | 0.7 | 7.9 |
| | 6.7 | 36.6 | .842 | 15.0 | 26.0 | 21.1 | .927 | 88 | 8 | 0 | 5.4 | 30.4 | 1.4 | 4.9 | 14.1 | 26.0 | 9.2 | 0.0 | 0.7 | 7.9 |

*Samples 2, 3 and 4
**Samples 2, 4, 6 and 8

Structural analysis for the Cold Lake feed and the CBU-6 product is given in Table 1D.

An analysis was performed on the combined product of the four CBU-15 runs. The results are given in Table 1E. Results from mass spectrometer analysis of the IBP-285° F. and 285° F.–430° F. fractions of the CBU-15 run are given in Tables 1F and 1G, respectively.

TABLE 1D

STRUCTURAL ANALYSIS OF COLD LAKE CRUDE OIL AND COLD LAKE CRUDE PRODUCTS FROM CONTINUOUS-FLOW UNIT RUN CBU-6

| | Crude | CBU-6 | | | |
|---|---|---|---|---|---|
| | Oil | Run-1 | Run-2 | Run-3 | Run-4 |
| Run temperature, °C. | — | 415 | 415 | 425 | 425 |
| Residence time, min | — | 4.1 | 2.7 | 4.3 | 2.7 |
| Structure: | | | | | |
| Light fractions | | | | | |
| Paraffins | 10.6 | 14.6 | 15.7 | 16.1 | 13.7 |
| Cycloparaffins | 8.9 | 14.7 | 14.6 | 15.2 | 14.6 |
| Condensed cyclo-paraffins | 27.6 | 26.0 | 25.8 | 24.3 | 22.8 |
| Alkyl benzenes | 6.0 | 7.0 | 7.9 | 7.3 | 9.8 |
| Benzo cyclo-paraffins | 5.3 | 4.9 | 4.7 | 4.3 | 4.2 |
| Benzo dicyclo-paraffins | 5.4 | 3.5 | 3.9 | 4.0 | 4.0 |
| | 63.8 | 70.7 | 72.6 | 71.2 | 69.1 |
| Aromatic Fractions | | | | | |
| 2-ring aromatics | 13.7 | 10.2 | 11.1 | 11.0 | 11.3 |
| 3-ring aromatics | 5.8 | 4.8 | 4.2 | 4.5 | 5.7 |
| 4-ring aromatics | 0.6 | 2.8 | 1.8 | 3.1 | 3.3 |
| 5-ring aromatics | 0.3 | 1.7 | 1.3 | 2.1 | 2.3 |
| Polyaromatics | 0.1 | 0.8 | 0.4 | 0.4 | 0.5 |
| Sulfur aromatics | 9.4 | 4.0 | 3.1 | 3.6 | 3.0 |
| | 29.9 | 24.3 | 21.9 | 24.7 | 26.1 |
| Remainder | 6.3 | 5.0 | 5.5 | 4.1 | 4.8 |
| | 100.0 | 100.0 | 100.0 | 100.0 | 100.0 |

TABLE 1F-continued

CBU-15, IBP-285° F. MASS SPECTROMETER ANALYSIS

| C-Number | Mol % | Wt % | Vol % |
|---|---|---|---|
| 10 | .81 | 1.19 | 1.12 |
| 11 | .15 | .24 | .22 |
| Sum | 68.53 | 69.38 | 71.25 |
| Olefins | | | |
| 4 | .36 | .21 | .21 |
| 5 | 4.13 | 2.99 | 3.04 |
| 6 | 7.30 | 6.34 | 6.37 |
| 7 | 2.45 | 2.49 | 2.47 |
| 8 | 1.13 | 1.31 | 1.28 |
| Sum | 15.36 | 13.32 | 13.37 |
| Cyclic Olefins | | | |
| 6 | .60 | .51 | .44 |
| 7 | .49 | .49 | .42 |
| 8 | .24 | .27 | .24 |
| Sum | 1.33 | 1.27 | 1.10 |
| 1-Ring Napthenes | | | |
| 6 | 2.63 | 2.28 | 2.09 |
| 7 | 4.71 | 4.77 | 4.31 |
| 8 | 4.03 | 4.66 | 4.17 |
| 9 | 1.39 | 1.81 | 1.60 |
| 10 | .60 | .86 | .76 |
| 11 | .13 | .21 | .19 |
| Sum | 13.49 | 14.60 | 13.12 |
| Alkyl Benzenes | | | |
| 6 | .06 | .05 | .04 |
| 7 | .10 | .09 | .08 |
| 8 | .81 | .88 | .71 |
| 9 | .33 | .41 | .33 |
| Sum | 1.29 | 1.43 | 1.16 |

Uncorrected Specific Gravity, 20° C. = .7043
Specific Gravity, Corrected for S, 15° C. = 0.726
Specific Gravity, Observed, 15° C. = 0.7351

TABLE 1E

ANALYSES ON CBU-15 COMBINED PRODUCT, RUNS 1–4

| Temp. Range, °F. at 1 Atmos. | Whole Oil | IPB-285 | 285–430 | 430–525 | 525–650 | 650–950 | 950+ |
|---|---|---|---|---|---|---|---|
| Cut Vol % of Whole Oil | 100 | 1.18 | 6.00 | 9.40 | 15.52 | 35.03 | 32.87(1) |
| Σ Vol % OH at Cut End | 100 | 1.18 | 7.18 | 16.58 | 32.10 | 67.13 | 100.00(1) |
| Cut Wt % of Whole Oil | 100 | 0.89 | 4.86 | 8.19 | 14.32 | 34.66 | 37.08(1) |
| Σ Wt % OH at Cut End | 100 | 0.89 | 5.75 | 13.94 | 28.26 | 62.92 | 100.00(1) |
| °API Gravity 60/60 | 13.2 | 61.0 | 47.1 | 34.7 | 25.2 | 14.7 | −3.1 |
| Specific Gravity 60/60 | 0.9782 | 0.7351 | 0.7921 | 0.8514 | 0.9028 | 0.9679 | 1.1016 |
| Sulfur, wt % | 4.02 | 1.66 | 2.36 | 2.40 | 2.57 | 3.59 | 5.62 |
| Nitrogen, wt % | | | | | 297 ppm | 0.22 | |
| Pour Point, °F. | | | | −100 | −75 | 40 | |
| Cetane Index(2) | | | | 42.1 | 39.2 | 23.4 | |
| Smoke Point, mm | | | | 14.6 | <10 | (3) | |
| Con Carbon Res, wt % | | | | | | 0.63 | 37.5 |
| Viscosity, | | | | | | | |
| 100° F., cst | | | | 1.65 | 4.34 | 99.6 | |
| 210° F., cst | | | | 0.78 | 1.44 | 7.63 | |
| 275° F., cst | | | | | | | 10,400 |
| Nickel, wppm | | | | | | 8.0 | 192 |
| Vandium, wppm | 162 | | | | | ND | 408 |

Sulfur balance closure = 100.1%; Vanadium closure = 93.4%.
ND = None Detected.
(1)By difference to give 100% recovery since loss is primarily in the residue.
(2)Calculated from midpoint of distillation fractions, not from a separate D-86 distillation.
(3)Material would not wick, test not applicable.

TABLE 1F

CBU-15, IBP-285° F. MASS SPECTROMETER ANALYSIS

| C-Number | Mol % | Wt % | Vol % |
|---|---|---|---|
| Paraffins | | | |
| 4 | .89 | .53 | .66 |
| 5 | 10.98 | 8.17 | 9.26 |
| 6 | 15.19 | 13.50 | 14.40 |
| 7 | 19.43 | 20.09 | 20.48 |
| 8 | 15.46 | 18.22 | 17.97 |
| 9 | 5.62 | 7.43 | 7.14 |

TABLE IG

MASS SPECTROMETER ANALYSIS OF 285–430° F. FRACTION OF THE CBU-15 RUN

| | |
|---|---|
| Paraffins | 47.9 vol % |
| Olefins | ND |
| Cycloparaffins | 35.3 |
| Cond. Cycloparaffins* | 12.7 |
| Alkyl Benzenes | 4.1 |
| | 100.0 vol % |

*May include cyclic olefins and certain sulfur compounds.
ND None detected.

EXAMPLE 2

Continuous-flow unit experiments were conducted on the Boscan crude oil sample. An analysis of the feed for each of these runs is given in Table 2A. Results from mass spectrometer analysis of the IBP-285° F. and 285° F.–430° F. fractions of the feed for these runs is given in Tables 2B and 2C, respectively.

TABLE 2A

| | ANALYSES ON BOSCAN CRUDE | | | | | | |
|---|---|---|---|---|---|---|---|
| Temp. Range, °F. at 1 Atmos. | Whole Oil | IBP–285 | 285–430 | 430–525 | 525 650 | 650–950 | 950+ |
| Cut Vol % of Whole Oil | 100 | 2.29 | 3.29 | 2.59 | 6.96 | 27.44 | 57.43(1) |
| Σ Vol. % OH at Cut End | 100 | 2.29 | 5.58 | 8.17 | 15.13 | 42.57 | 100.00(1) |
| Cut Wt % of Whole Oil | 100 | 1.73 | 2.62 | 2.24 | 6.26 | 26.11 | 61.04(1) |
| Σ Wt % OH at Cut End | 100 | 1.73 | 4.35 | 6.59 | 12.85 | 38.96 | 100.00(1) |
| °API Gravity 60/60 | 11.3 | 58.7 | 47.4 | 33.2 | 27.5 | 18.6 | 2.4 |
| Specific Gravity 60/60 | 0.9907 | 0.7440 | 0.7911 | 0.8589 | 0.8901 | 0.9424 | 1.0566 |
| Sulfur, wt % | 5.21 | 0.37 | 1.27 | 3.02 | 3.89 | 4.54 | 6.06 |
| Nitrogen, wt % | | | | | 239 ppm | 0.16 | |
| Pour Point, °F. | | | | −50 | 0 | 80 | |
| Cetane Index(2) | | | | 39.7 | 42.4 | 27.7 | |
| Smoke Point, mm | | | | (3) | 12.0 | (3) | |
| Con Carbon Res, wt % | | | | | | 0.33 | 27.6 |
| Viscosity, | | | | | | | |
| 100° F., cst | | | | 2.64 | 4.99 | 68.2 | |
| 210° F., cst | | | | 1.09 | 1.58 | 6.75 | |
| 275° F., cp | | | | | | | 5,580 |
| Nickel, wppm | | | | | | 11.0 | 164 |
| Vanadium, wppm | | | | | | ND | 1,216 |

Sulfur balance closure = 100.5%.
ND = None Detected.
(1)By difference to give 100% recovery since loss is primarily in the residue.
(2)Calculated from midpoint of distillation fractions, not from a separate D-86 distillation.
(3)Material would not wick, test not applicable.

TABLE 2B

| BOSCAN CRUDE, IBP-285° F. MASS SPECTROMETER ANALYSIS | | | |
|---|---|---|---|
| C-Number | Mol % | Wt % | Vol % |
| Paraffins | | | |
| 5 | 5.21 | 3.54 | 4.15 |
| 6 | 15.44 | 12.56 | 13.84 |
| 7 | 17.13 | 16.20 | 17.08 |
| 8 | 14.61 | 15.75 | 16.06 |
| 9 | 8.26 | 9.99 | 9.93 |
| 10 | 3.98 | 5.35 | 5.21 |
| 11 | .34 | .50 | .48 |
| Sum | 64.96 | 63.89 | 66.77 |
| 1-Ring Napthenes | | | |
| 6 | 3.85 | 3.06 | 2.89 |
| 7 | 11.50 | 10.65 | 9.95 |
| 8 | 7.48 | 7.92 | 7.33 |
| 9 | 6.43 | 7.66 | 7.03 |
| 10 | 3.18 | 4.21 | 3.83 |
| 11 | .17 | .25 | .23 |

TABLE 2B-continued

| BOSCAN CRUDE, IBP-285° F. MASS SPECTROMETER ANALYSIS | | | |
|---|---|---|---|
| C-Number | Mol % | Wt % | Vol % |
| Sum | 32.60 | 33.75 | 31.26 |
| Alkyl Benzenes | | | |
| 6 | .17 | .13 | .11 |
| 7 | .60 | .52 | .43 |
| 8 | 1.37 | 1.38 | 1.15 |
| 9 | .29 | .33 | .28 |
| Sum | 2.44 | 2.36 | 1.97 |

Uncorrected Specific Gravity, 20° C. = .7288
Specific Gravity, Corrected for S, 15° C. = 0.7390
Specific Gravity, Observed, 15° C. = 0.7441

TABLE 2C

| MASS SPECTROMETER ANALYSIS OF 285–430° F. FRACTION OF THE BOSCAN FEED | |
|---|---|
| Paraffins | 60.6 vol % |
| Olefins | ND |
| Cycloparaffins | 32.5 |
| Cond. Cycloparaffins | 2.8 |
| Alkyl Benzenes | 4.1 |
| | 100.0 vol % |

ND None detected.

An analysis of the products is given in Table 2D. Batch autoclave runs were also conducted on Boscan crude oil. The results of these runs and further batch autoclave runs are given in Table 2E. Also, the structural analysis of a continuous-flow unit run of the Boscan heavy oil was determined. The results were presented in Table 2F.

TABLE 2D

BOSCAN HEAVY OILS RUN DATA

| Run | Temp. °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % | Coke Wt. % | Gas Wt. % | IBP-450° F. Wt. % | 450-950° F. Wt. % | Resid +950 F. Wt. % | Con-Carbon Wt. % | Sulfur Wt. %* |
|---|---|---|---|---|---|---|---|---|---|---|---|---|---|---|---|---|---|---|---|---|
| (Barrel 1) - Batch Runs | | | | | | | | | | | | | | | | | | | | |
| Feed | | | 0.9 | | | 59,300 | 827 | 11.4 | 68.8 | | 20.1 | | | | 0.2 | 4.4 | 26.6 | 68.8 | 14.3 | 5.6 |
| Continuous Unit Runs (Barrel 1) | | | | | | | | | | | | | | | | | | | | |
| CBU-26 | 400 | 1000 | 0.9 | 3.1 | 0.5 | 3,890 | 161 | 12.3 | 60.6 | 11.9 | 17.1 | 14.9 | 0.02 | ND | 4.2 | 6.1 | 29.1 | 60.6 | 14.1 | 5.1 |
| | 400 | 2020 | 0.9 | 5.2 | 0.6 | 3,150 | 133 | 13.2 | 56.0 | 18.6 | 17.1 | 14.9 | 0.01 | ND | 2.2 | 7.8 | 34.1 | 56.0 | 14.2 | 5.0 |
| | 415 | 2040 | 0.9 | 3.2 | 0.0 | 823 | 54 | 13.2 | 49.0 | 28.8 | 17.2 | 14.4 | 0.11 | ND | 4.5 | 8.4 | 38.1 | 49.0 | 15.0 | 4.8 |
| | 415 | 1040 | 0.9 | 2.3 | 0.0 | 845 | 61 | 14.7 | 50.2 | 27.0 | 17.5 | 12.9 | 0.07 | ND | 4.5 | 9.8 | 35.5 | 50.2 | 15.0 | 4.9 |
| | 425 | 1080 | 0.9 | 2.5 | 0.3 | 522 | 40 | 14.2 | 43.2 | 37.3 | 16.7 | 16.9 | 0.34 | ND | 4.3 | 15.2 | 37.4 | 43.2 | 15.0 | 4.9 |
| CBU-27 | 425 | 2040 | 0.9 | 2.9 | 0.0 | 712 | 40 | 14.7 | 46.0 | 33.1 | 11.7 | 41.8 | 0.24 | ND | 5.2 | 9.8 | 39.0 | 46.0 | 15.5 | 4.6 |
| | 435 | 2010 | 0.9 | 2.7 | 0.0 | 56 | 16 | 17.4 | 34.6 | 49.8 | 11.9 | 40.8 | 0.03 | ND | 7.0 | 16.4 | 42.0 | 34.6 | 13.3 | 4.8 |
| | 435 | 1060 | 0.9 | 2.2 | 0.0 | 275 | 40 | 14.8 | 42.8 | 37.8 | 15.3 | 23.8 | 0.10 | ND | 6.0 | 11.3 | 39.9 | 42.8 | 15.7 | 5.0 |
| | 445 | 1050 | 0.9 | 2.0 | 0.0 | 55 | 17 | 17.6 | 32.9 | 52.2 | 13.3 | 33.8 | 0.27 | ND | 7.4 | 17.5 | 42.2 | 32.9 | 13.2 | 4.6 |
| CBU-28 | 435 | 1010 | 0.9 | 1.9 | | 489 | 40 | 14.4 | | | 16.8 | 16.4 | 0.21 | 2.61 | | | | | | 4.9 |
| | 435 | 1030 | 0.9 | 2.1 | 0.0 | 250 | 28 | 15.7 | 40.2 | 41.6 | 15.9 | 20.9 | 0.10 | 2.50 | 6.3 | 15.3 | 38.3 | 40.2 | 15.2 | 4.8 |
| | 435 | 1030 | 0.9 | 2.3 | | 216 | 20 | 16.0 | | | 15.8 | 21.4 | 0.12 | 2.52 | | | | | | 5.1 |
| | 435 | 1050 | 0.9 | 2.3 | 0.1 | 251 | 26 | 15.3 | 40.4 | 41.3 | 15.9 | 20.9 | 0.13 | 2.53 | 5.9 | 14.8 | 39.0 | 40.4 | 14.4 | 4.5 |
| CBU-29 | 425 | 1060 | 0.9 | 2.6 | | 568 | 53 | 13.9 | | | 17.2 | 14.4 | 0.14 | 0.20 | | | | | | 5.2 |
| | 425 | 1040 | 0.9 | 2.4 | 0.1 | 622 | 45 | 13.8 | 45.3 | 34.2 | 17.0 | 15.4 | 0.17 | 0.23 | 4.0 | 12.0 | 38.8 | 45.3 | 15.7 | 4.9 |
| | 425 | 1040 | 0.9 | 2.4 | | 617 | 46 | 13.8 | | | 17.2 | 14.4 | 0.17 | 0.23 | | | | | | 5.0 |
| | 425 | 1040 | 0.9 | 2.6 | 0.0 | 629 | 51 | 13.8 | 49.3 | 28.3 | 17.3 | 14.0 | 0.04 | 0.10 | 4.8 | 9.3 | 36.7 | 49.3 | 15.7 | 4.9 |
| CBU-30 | 415 | 1030 | 0.9 | 2.7 | 0.0 | 869 | 59 | 14.8 | 49.0 | 28.7 | 17.0 | 15.4 | 0.13 | 0.13 | 3.6 | 9.9 | 37.5 | 49.0 | 15.3 | 5.0 |
| | 415 | 1010 | 0.9 | 2.5 | 0.0 | 992 | 62 | 14.8 | 52.3 | 24.0 | 17.3 | 13.9 | 0.12 | 0.12 | 3.4 | 7.1 | 37.2 | 52.3 | 15.0 | 4.8 |
| | 415 | 1000 | 0.9 | 2.6 | 0.0 | 874 | 56 | 13.6 | 47.4 | 30.7 | 17.8 | 11.4 | 0.13 | 0.13 | 4.4 | 9.2 | 39.0 | 47.4 | 15.3 | 5.3 |
| | 415 | 1020 | 0.9 | 2.6 | 0.0 | 898 | 61 | 13.6 | 52.3 | 24.0 | 17.6 | 12.4 | 0.08 | 0.08 | 3.5 | 8.1 | 36.0 | 52.3 | 15.2 | 5.0 |
| CBU-31 | 415 | 1030 | 0.9 | 4.3 | 0.0 | 775 | 52 | 13.6 | 48.6 | 29.4 | 17.7 | 11.9 | 0.45 | ND | 4.5 | 7.0 | 40.0 | 48.6 | 16.2 | 4.8 |
| | 425 | 1050 | 0.9 | 4.6 | 0.0 | 706 | 45 | 13.6 | 45.6 | 33.7 | 17.4 | 13.4 | 0.18 | ND | 5.0 | 8.7 | 40.7 | 45.6 | 15.5 | 4.6 |
| | 425 | 540 | 0.9 | 4.5 | 0.0 | 1,120 | 70 | 13.3 | 53.7 | 22.0 | 18.2 | 9.5 | 0.35 | ND | 4.3 | 6.6 | 35.4 | 53.7 | 15.4 | 5.0 |
| | 435 | 1020 | 0.9 | 6.6 | 0.0 | 642 | 40 | 13.5 | 45.6 | 33.7 | 17.5 | 12.9 | 0.32 | ND | 3.0 | 12.4 | 39.0 | 45.6 | 15.9 | 4.5 |
| CBU-35 | 415 | 500 | 0.9 | 2.5 | 0.0 | 3,335 | 152 | 13.2 | 56.2 | 18.3 | 17.5 | 12.9 | 0.09 | ND | 2.6 | 7.1 | 34.1 | 56.2 | 14.4 | 5.3 |
| | 425 | 540 | 0.9 | 1.6 | 0.0 | 975 | 60 | 12.2 | 52.2 | 24.1 | 17.2 | 14.4 | 0.11 | ND | 4.6 | 7.9 | 35.3 | 52.2 | 15.0 | 5.3 |
| | 435 | 550 | 0.9 | 1.6 | 0.0 | 707 | 73 | 15.4 | 42.3 | 38.5 | 17.3 | 13.9 | 0.25 | ND | 5.4 | 13.3 | 39.0 | 42.3 | 15.5 | 4.8 |
| | 435 | 270 | 0.9 | 0.8 | 0.0 | 978 | 60 | 12.5 | 50.0 | 27.3 | 17.6 | 12.4 | 0.09 | ND | 5.0 | 8.9 | 36.1 | 50.0 | 15.8 | 5.0 |
| CBU-36 | 400 | 1060 | 2.5 | 3.2 | 0.7 | 14,700 | 420 | 12.6 | 63.3 | 8.0 | 17.8 | 11.4 | 0.07 | ND | 2.6 | 4.9 | 29.1 | 63.3 | 14.2 | 5.6 |
| | 415 | 1030 | 2.5 | 3.1 | 0.2 | 4,430 | 177 | 13.0 | 61.6 | 10.5 | 17.1 | 14.9 | 0.04 | ND | 2.4 | 5.7 | 30.4 | 61.6 | 15.1 | 5.1 |
| | 425 | 1060 | 2.5 | 2.0 | 0.5 | 1,260 | 124 | 14.2 | 49.4 | 28.2 | 17.1 | 14.9 | 0.10 | ND | 5.3 | 7.8 | 37.5 | 49.4 | 15.2 | 5.1 |
| | 435 | 1020 | 2.5 | 1.9 | 0.0 | 822 | 109 | 14.2 | 46.7 | 32.1 | 17.3 | 13.9 | 0.19 | ND | 7.0 | 6.7 | 39.6 | 46.7 | 16.0 | 4.8 |

| Run | IBF-450° F. Vol % | IBF-450° F. °API | IBF-450° F. Sp gr | Volume % 450-650° F. | Volume % 650-950° F. | 450-950°F. °API | 450-950°F. Sp gr | Sulfur Distribution % Liquid | Sulfur Distribution % Gas | Sulfur Distribution % Solids | Gas Analysis, % $H_2$ | $CH_4$ | CO | $CO_2$ | $C_2H_6$ | $H_2S$ | $C_3H_8$ | Other |
|---|---|---|---|---|---|---|---|---|---|---|---|---|---|---|---|---|---|---|
| (Barrel 1) - Batch Experiments | | | | | | | | | | | | | | | | | | |
| Feed | 5.5 | 47.3 | .792 | 11.5 | 17.4 | 23.7 | .912 | | | | | | | | | | | |
| Continuous Unit Runs (Barrel 1) | | | | | | | | | | | | | | | | | | |
| CBU-26 | 7.4 | 42.6 | .813 | 13.9 | 17.5 | 23.0 | .916 | 88 | 18 | 0 | 4.9 | 32.7 | 0.5 | 5.1 | 13.1 | 26.9 | 5.9 | 10.9 |
| | 9.4 | 43.0 | .811 | 15.4 | 20.8 | 21.8 | .923 | 88 | 7 | 0 | 3.3 | 27.8 | 0.4 | 4.7 | 13.1 | 30.0 | 7.4 | 13.3 |
| | 10.2 | 43.5 | .809 | 17.9 | 22.7 | 22.3 | .920 | 84 | 13 | 0 | 1.6 | 22.3 | 0.1 | 3.5 | 13.7 | 30.5 | 8.9 | 19.4 |
| | 11.9 | 41.9 | .816 | 18.1 | 20.0 | 21.8 | .923 | 87 | 10 | 0 | 1.8 | 23.1 | 0.8 | 3.3 | 12.6 | 27.4 | 8.1 | 22.9 |
| | 17.8 | 37.9 | .835 | 18.0 | 21.3 | 20.7 | .930 | 85 | 14 | 0 | 2.3 | 27.2 | 0.1 | 3.0 | 13.9 | 28.0 | 9.5 | 16.0 |
| CBU-27 | 12.3 | 47.3 | .791 | 18.4 | 24.1 | 22.8 | .917 | 80 | 17 | 0 | 1.6 | 30.4 | Trace | 3.3 | 16.3 | 29.4 | 11.4 | 7.6 |

TABLE 2D-continued

BOSCAN HEAVY OILS RUN DATA

| | | | | | | | | | | | | | | | | | | |
|---|---|---|---|---|---|---|---|---|---|---|---|---|---|---|---|---|---|---|
| | 20.3 | 43.5 | .808 | 22.7 | 22.7 | 21.1 | .927 | 81 | 23 | 0 | 3.3 | 25.9 | Trace | 2.6 | 15.7 | 25.8 | 11.0 | 15.7 |
| | 14.0 | 42.5 | .813 | 22.5 | 20.8 | 21.6 | .924 | 86 | 17 | 0 | 1.6 | 31.2 | Trace | 2.5 | 17.7 | 24.6 | 13.0 | 9.4 |
| | 21.6 | 43.7 | .808 | 22.5 | 22.8 | 20.5 | .931 | 78 | 20 | 0 | 2.0 | 30.1 | 0.1 | 2.2 | 17.4 | 22.1 | 12.0 | 14.1 |
| CBU-28 | | | | | | | | | | | 2.6 | 27.4 | 0.1 | 2.7 | 14.3 | 26.4 | 10.0 | 16.4 |
| | 18.8 | 42.0 | .815 | 21.0 | 20.1 | 20.7 | .930 | 82 | 17 | 0 | 3.5 | 22.7 | Trace | 2.4 | 15.3 | 24.9 | 10.9 | 20.3 |
| | | | | | | | | | | | 1.8 | 29.2 | Trace | 2.5 | 18.2 | 26.4 | 9.0 | 12.7 |
| | 18.5 | 44.7 | .803 | 19.0 | 23.3 | 21.1 | .927 | 77 | 19 | 0 | 1.6 | 30.4 | 0.1 | 2.6 | 16.3 | 25.3 | 11.2 | 12.5 |
| CBU-29 | | | | | | | | | | | Trace | 29.5 | 0.2 | 4.8 | 15.5 | 32.1 | 10.6 | 7.2 |
| | 14.7 | 42.1 | .815 | 20.4 | 21.2 | 21.0 | .928 | 85 | 14 | 0.2 | 1.3 | 29.2 | 0.1 | 3.3 | 15.2 | 31.5 | 10.4 | 8.9 |
| | | | | | | | | | | | 1.6 | 30.8 | 0.2 | 3.3 | 15.3 | 32.0 | 10.5 | 5.9 |
| | 11.2 | 42.5 | .813 | 17.4 | 21.4 | 20.8 | .929 | 86 | 15 | 0.1 | 1.6 | 28.6 | 0.1 | 3.4 | 15.3 | 32.0 | 10.4 | 8.5 |
| CBU-30 | 11.9 | 42.0 | .815 | 18.9 | 21.1 | 21.5 | .925 | 88 | 11 | 0 | 1.3 | 29.4 | Trace | 3.1 | 13.4 | 32.2 | 9.6 | 10.9 |
| | 8.8 | 44.6 | .804 | 18.0 | 21.9 | 22.6 | .918 | 85 | 11 | 0 | 1.5 | 29.0 | 0.1 | 2.5 | 13.4 | 32.3 | 9.9 | 11.2 |
| | 11.1 | 41.3 | .819 | 20.5 | 21.5 | 21.5 | .925 | 92 | 13 | 0 | 1.5 | 28.9 | 0.1 | 2.9 | 13.4 | 32.6 | 9.8 | 10.8 |
| | 10.0 | 42.9 | .811 | 16.8 | 22.2 | 22.5 | .919 | 87 | 12 | 0 | 1.5 | 27.9 | 0.2 | 3.0 | 16.1 | 31.4 | 9.4 | 10.5 |
| CBU-31 | 8.7 | 44.0 | .806 | 19.4 | 24.2 | 23.0 | .916 | 83 | 14 | 0 | 1.5 | 27.4 | Trace | 2.3 | 14.1 | 30.3 | 11.3 | 13.1 |
| | 10.9 | 44.3 | .805 | 19.4 | 25.3 | 22.8 | .917 | 90 | 18 | 0 | 0.9 | 24.3 | Trace | 3.2 | 14.0 | 32.9 | 11.9 | 12.8 |
| | 8.2 | 43.9 | .807 | 17.1 | 21.0 | 23.3 | .914 | 86 | 14 | 0 | 1.6 | 28.1 | 0.1 | 2.6 | 14.3 | 27.4 | 11.4 | 14.5 |
| | 14.8 | 40.6 | .822 | 19.6 | 21.4 | 20.8 | .929 | 77 | 19 | 0 | 3.2 | 32.5 | 0.4 | 2.5 | 12.3 | 29.1 | 9.4 | 10.6 |
| CBU-35 | 8.4 | 39.0 | .830 | 18.5 | 17.9 | 21.1 | .927 | 94 | 4 | 0 | 1.6 | 32.9 | 3.2 | 3.9 | 13.0 | 19.6 | 10.1 | 15.7 |
| | 9.8 | 42.7 | .812 | 16.4 | 22.3 | 22.1 | .921 | 92 | 13 | 0 | 2.1 | 26.9 | 0.1 | 2.5 | 12.9 | 28.6 | 9.8 | 17.1 |
| | 16.1 | 40.9 | .821 | 22.2 | 19.3 | 20.0 | .934 | 83 | 17 | 0 | 1.9 | 23.1 | 0.6 | 1.8 | 13.5 | 30.2 | 10.8 | 18.1 |
| | 11.2 | 43.6 | .808 | 17.1 | 22.7 | 21.8 | .923 | 85 | 17 | 0 | 6.5 | 30.0 | 2.0 | 1.2 | 11.9 | 24.8 | 7.5 | 16.1 |
| CBU-36 | 6.0 | 42.0 | .816 | 12.5 | 18.9 | 22.3 | .920 | 98 | 4 | 0 | 4.7 | 28.1 | 0.9 | 3.7 | 12.1 | 28.3 | 8.2 | 14.0 |
| | 6.8 | 38.5 | .832 | 16.1 | 16.5 | 22.0 | .922 | 90 | 7 | 0 | 4.0 | 27.8 | 1.1 | 3.5 | 12.5 | 28.5 | 8.3 | 14.3 |
| | 9.4 | 39.9 | .826 | 17.7 | 22.6 | 21.0 | .928 | 88 | 13 | 0 | 3.6 | 27.2 | 0.7 | 3.0 | 12.8 | 29.4 | 8.9 | 14.4 |
| | 8.2 | 41.7 | .817 | 18.4 | 24.8 | 22.1 | .921 | 82 | 16 | 0 | 4.1 | 27.0 | 0.6 | 2.6 | 12.9 | 26.4 | 11.5 | 14.9 |

*Water- and solids-free basis.
**Viscosity measured on oil after coke was removed.
***Residence time for continuous unit was calculated for temperatures within 5° C. of reaction temperature.

TABLE 2E

BOSCAN HEAVY OILS RUN DATA

| Run | Temp °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % | Coke Wt. % | Gas Wt. % | IBP-450° F. Wt. % |
|---|---|---|---|---|---|---|---|---|---|---|---|---|---|---|---|---|
| Feed | | | 0.8 | | | 104,900 | 1,510 | 10.1 | 73.6 | | 20.9 | | 0.00 | | 0.2 | 2.6 |
| BO 1 | 400 | 460 | 0.8 | 15 | Trace | 1,190 | 87 | 12.2 | 55.5 | 24.6 | 17.8 | 14.8 | 0.00 | 0.0 | 1.4 | 8.4 |
| BO 2 | 415 | 760 | 0.8 | 15 | Trace | 118 | 21 | 15.7 | 40.5 | 45.0 | 15.3 | 26.8 | 0.11 | 2.4 | 4.4 | 12.7 |
| CBU-7 | 415 | 1060 | 0.8 | 1.8 | 0.6 | 2,300 | 111 | 14.4 | 52.4 | 28.8 | 17.3 | 17.2 | 0.00 | 0.0 | 1.7 | 11.5 |
| | 425 | 1030 | 0.8 | 1.9 | Trace | 1,180 | 81 | 14.1 | 50.6 | 31.3 | 17.3 | 17.2 | 0.00 | 0.0 | 4.0 | 8.5 |

| Run | 450-950° F. Wt. % | Resid +950 F. Wt. % | Con-Carbon Wt. % | Sulfur Wt. %* | IBF-450° F. Vol % | IBF-450° F. °API | IBF-450° F. Sp gr | Volume % 450-650° F. | Volume % 650-950° F. | 450-950° F. °API | 450-950° F. Sp gr | Sulfur Distribution % Liquid | Sulfur Distribution % Gas | Sulfur Distribution % Solids | Cl ppm |
|---|---|---|---|---|---|---|---|---|---|---|---|---|---|---|---|
| Feed | 23.6 | 73.6 | 14.0 | 5.6 | 3.0 | 42.5 | .813 | 9.9 | 15.4 | 24.3 | .908 | | | | 7.2 |
| BO 1 | 34.6 | 55.5 | 14.6 | 5.2 | 10.6 | 49.0 | .784 | 15.4 | 21.7 | 22.6 | .918 | 93 | 0 | 0 | |
| BO 2 | 40.0 | 40.5 | 13.0 | 4.8 | 15.4 | 47.0 | .793 | 20.0 | 21.8 | 22.8 | .917 | 76 | 16 | 3 | |
| CBU-7 | 34.4 | 52.4 | 14.6 | 5.3 | 13.7 | 40.0 | .825 | 17.6 | 18.7 | 20.2 | .933 | 93 | 9 | 0 | |
| | 36.9 | 50.6 | 15.6 | 5.1 | 10.4 | 43.1 | .810 | 18.0 | 21.8 | 22.0 | .912 | 89 | 14 | 0 | |

| Run | Pour Point °C. | Gas Analysis, % $H_2$ | $CH_4$ | CO | $CO_2$ | $C_2H_6$ | $H_2S$ | $C_3H_8$ | Other |
|---|---|---|---|---|---|---|---|---|---|
| Feed | 18 | | | | | | | | |
| BO 1 | −5 | | | | | | | | |
| BO 2 | | | | | | | | | |
| CBU-7 | −10 | Trace | 20.9 | 0.0 | 5.4 | 24.2 | 34.6 | 14.9 | |
| | −4 | Trace | 23.1 | 0.0 | 4.2 | 23.5 | 32.2 | 17.0 | |

*Water- and solids-free basis.
**Viscosity measured on oil after coke was removed.
***Run CBU-7 was run in the continuous unit. All other runs were performed in the batch autoclave.
For 10° API oil, 10 lbs salt/1000 bbls is equivalent to 18 ppm Cl.

TABLE 2F

STRUCTURAL ANALYSES OF BOSCAN HEAVY CRUDE OIL FEEDS AND RUN PRODUCTS (Wt %)

| | Feed | BO-1 | BO-2 | CBU-7 |
|---|---|---|---|---|
| Run Temperature, °C. | — | 400 | 415 | 425 |
| Residence Time, Min. | — | 15 | 15 | 1.9 |
| Structure | | | | |
| Light Fractions | | | | |
| Paraffins | 12.7 | 19.7 | 19.8 | 17.3 |
| Cycloparaffins | 14.8 | 15.6 | 15.0 | 14.8 |
| Condensed Cycloparaffins | 28.6 | 20.8 | 14.9 | 15.5 |
| Alkyl Benzenes | 4.9 | 5.4 | 5.9 | 7.0 |
| Benzo Cycloparaffins | 3.7 | 3.1 | 3.6 | 3.8 |
| Benzo Dicycloparaffins | 4.0 | 3.0 | 2.8 | 3.3 |
| | 68.7 | 67.6 | 62.0 | 61.7 |
| Heavier Fractions | | | | |
| 2-Ring Aromatics | 7.6 | 8.8 | 8.9 | 10.9 |

TABLE 2F-continued

STRUCTURAL ANALYSES OF BOSCAN HEAVY CRUDE OIL FEEDS AND RUN PRODUCTS (Wt %)

| | Feed | BO-1 | BO-2 | CBU-7 |
|---|---|---|---|---|
| 3-Ring Aromatics | 2.5 | 4.3 | 6.0 | 5.2 |
| 4-Ring Aromatics | 1.2 | 3.9 | 5.3 | 4.6 |
| 5-Ring Aromatics | 0.3 | 1.7 | 3.1 | 3.8 |
| Polyaromatics | 0.3 | 0.8 | 1.1 | 1.5 |
| Sulfur Aromatics | 11.1 | 6.0 | 7.4 | 5.3 |
| | 23.0 | 25.3 | 31.8 | 31.3 |
| Remainder | 8.3 | 6.9 | 6.2 | 7.0 |
| | 100.0 | 100.0 | 100.0 | 100.0 |

An analysis was performed on the combined product of the four CBU-30 runs. The results are given in Table 2G. Results from mass spectrometer analysis of the IBP-285° F. and 285° F.-430° F. fractions of the CBU-30 run are given in Tables 2H and 2I, respectively.

TABLE 2G

ANALYSES ON CBU-30 COMBINED PRODUCT, RUNS 1-4

| Temp. Range, °F. at 1 Atmos. | Whole Oil | IBP-285 | 285-430 | 430-525 | 525-650 | 650-950 | 950+ |
|---|---|---|---|---|---|---|---|
| Cut Vol % of Whole Oil | 100 | 2.27 | 6.69 | 7.77 | 12.55 | 31.73 | 38.99(1) |
| Σ Vol. % OH at Cut End | 100 | 2.27 | 8.96 | 16.73 | 29.28 | 61.01 | 100.00(1) |
| Cut Wt % of Whole Oil | 100 | 1.67 | 5.41 | 6.70 | 11.54 | 31.05 | 43.63(1) |
| Σ Wt % OH at Cut End | 100 | 1.67 | 7.08 | 13.78 | 25.32 | 56.37 | 100.00(1) |
| °API Gravity 60/60 | 13.3 | 64.9 | 47.6 | 36.6 | 25.9 | 16.4 | −2.2 |
| Specific Gravity 60/60 | 0.9771 | 0.7206 | 0.7901 | 0.8420 | 0.8990 | 0.9564 | 1.0947 |
| Sulfur, wt % | 4.79 | 1.09 | 2.34 | 3.02 | 4.06 | 4.43 | 5.73 |
| Nitrogen, wt % | | | | | 485 ppm | 0.23 | |
| Pour Point, °F. | | | | −50 | 0 | 90 | |
| Cetane Index(2) | | | | 45.2 | 40.2 | 25.3 | |
| Smoke Point, mm | | | | 14.0 | 10.8 | (3) | |
| Con Carbon Res, wt % | | | | | | 1.20 | 38.5 |
| Viscosity, | | | | | | | |
| 100° F., cst | | | | 1.66 | 4.55 | 84.9 | |
| 210° F., cst | | | | 0.81 | 1.49 | 7.50 | |
| 275° F., cp | | | | | | | 15,220 |
| Nickel, wppm | | | | | | 9.9 | 226 |

TABLE 2G-continued

| ANALYSES ON CBU-30 COMBINED PRODUCT, RUNS 1-4 | | | | | | | |
|---|---|---|---|---|---|---|---|
| Temp. Range, °F. at 1 Atmos. | Whole Oil | IBP-285 | 285-430 | 430-525 | 525 650 | 650-950 | 950+ |
| Vanadium, wppm | 849 | | | | | 3.1 | 1,573 |

Sulfur balance closure = 97.9%; Vanadium closure = 92.1%.
ND = None Detected.
(1)By difference to give 100% recovery since loss is primarily in the residue.
(2)Calculated from midpoint of distillation fractions, not from a separate D-86 distillation.
(3)Material would not wick, test not applicable.

TABLE 2H

| CBU-30, IBP-285° F. MASS SPECTROMETER ANALYSIS | | | |
|---|---|---|---|
| C-Number | Mol % | Wt % | Vol % |
| Paraffins | | | |
| 4 | 3.10 | 1.91 | 2.35 |
| 5 | 13.49 | 10.31 | 11.65 |
| 6 | 18.41 | 16.81 | 17.87 |
| 7 | 15.11 | 16.04 | 16.30 |
| 8 | 12.32 | 14.90 | 14.65 |
| 9 | 5.20 | 7.07 | 6.77 |
| 10 | 1.07 | 1.61 | 1.51 |
| 11 | .11 | .19 | .17 |
| Sum | 68.82 | 68.83 | 71.28 |
| Olefins | | | |
| 4 | .55 | .33 | .34 |
| 5 | 4.70 | 3.49 | 3.55 |
| 6 | 3.93 | 3.50 | 3.51 |
| 7 | 1.01 | 1.05 | 1.04 |
| 8 | .40 | .48 | .47 |
| Sum | 10.59 | 8.85 | 8.90 |
| Cyclic Olefins | | | |
| 6 | .54 | .47 | .41 |
| 7 | .50 | .51 | .44 |
| 8 | .55 | .64 | .55 |
| Sum | 1.59 | 1.62 | 1.40 |
| 1-Ring Napthenes | | | |
| 6 | 3.41 | 3.04 | 2.77 |
| 7 | 6.75 | 7.02 | 6.32 |
| 8 | 5.70 | 6.78 | 6.05 |
| 9 | 1.22 | 1.63 | 1.44 |
| 10 | .28 | .41 | .36 |
| Sum | 17.36 | 18.89 | 16.95 |

TABLE 2H-continued

| CBU-30, IBP-285° F. MASS SPECTROMETER ANALYSIS | | | |
|---|---|---|---|
| C-Number | Mol % | Wt % | Vol % |
| Alkyl Benzenes | | | |
| 6 | .06 | .05 | .04 |
| 7 | .40 | .39 | .32 |
| 8 | .91 | 1.02 | .83 |
| 9 | .27 | .35 | .28 |
| Sum | 1.64 | 1.81 | 1.46 |

Uncorrected Specific Gravity, 20° C. = .7035
Specific Gravity, Corrected for S, 15° C. = 0.720
Specific Gravity, Observed, 15° C. = 0.7206

TABLE 2I

| MASS SPECTROMETER ANALYSIS OF 285-430° F. FRACTION OF THE CBU-30 RUN | |
|---|---|
| Paraffins | 54.4 vol % |
| Olefins | ND |
| Cycloparaffins | 34.7 |
| Cond. Cycloparaffins* | 6.8 |
| Alkyl Benzenes | 4.1 |
| | 100.0 vol % |

*May include cyclic olefins and certain sulfur compounds.
ND None detected.

EXAMPLE 3

Batch autoclave and continuous flow unit runs were conducted on the Tia Juana crude sample. The results are given in Table 3A.

TABLE 3A

TIA JUANA HEAVY OILS RUN DATA

| Run | Temp °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % |
|---|---|---|---|---|---|---|---|---|---|---|---|---|---|
| Feed | | | 0.0 | | | 21,100 | 476 | 12.0 | 64.9 | | 12.4 | | 0.00 |
| TJ 1 | 350 | 250 | 0.0 | 15 | Trace | 9,740 | 249 | 12.8 | 59.5 | 8.3 | 13.0 | −4.8 | 0.00 |
| TJ 2 | 380 | 250 | 0.0 | 15 | 0.0 | 10,500 | 331 | 13.9 | 57.2 | 11.9 | 12.4 | 0.0 | 0.07 |
| TJ 3 | 400 | 360 | 0.0 | 15 | Trace | 1,500 | 79 | 16.9 | 52.2 | 19.0 | 13.4 | −8.1 | 0.02 |
| TJ 4 | 415 | 560 | 0.0 | 15 | 0.06 | 925 | 49 | 15.7 | 39.6 | 39.0 | 14.7 | −18.6 | 0.39 |
| TJ 5 | 425 | 650 | 0.0 | 15 | 0.0 | 477 | 29 | 19.2 | 39.3 | 39.5 | 13.6 | −9.7 | 0.09 |
| CBU-33 | 415 | 1030 | 0.0 | 3.5 | 0.0 | 2,570 | 117 | 16.1 | 51.5 | 20.6 | 13.1 | −5.3 | 0.03 |
| | 425 | 1020 | 0.0 | 3.6 | 0.0 | 863 | 103 | 14.8 | 45.5 | 29.9 | 13.5 | −9.1 | 0.06 |
| | 435 | 960 | 0.0 | 2.7 | 0.0 | 397 | 46 | 16.4 | 40.7 | 37.3 | 13.4 | −8.1 | 0.20 |

| Run | Coke Wt. % | Gas Wt. % | IBP-450° F. Wt. % | 450-950° F. Wt. % | Resid +950F Wt. % | Con-Carbon Wt. % | Sulfur Wt. %* | IBP-450° F. Vol % | IBP-450° F. °API | IBP-450° F. Sp gr | Volume % 450-650° F. | Volume % 650-950° F. | 450-950° F. °API | 450-950° F. Sp gr |
|---|---|---|---|---|---|---|---|---|---|---|---|---|---|---|
| Feed | | 0.02 | 1.6 | 33.5 | 64.9 | 12.2 | 2.8 | 1.9 | 37.0 | .840 | 11.7 | 23.9 | 21.5 | .925 |
| TJ 1 | 0.0 | 0.3 | 6.3 | 38.9 | 54.5 | 11.9 | 2.8 | 7.3 | 35.9 | .845 | 16.4 | 24.1 | 18.9 | .941 |
| TJ 2 | 0.0 | 0.2 | 4.9 | 37.7 | 57.2 | 11.8 | 2.7 | 5.7 | 35.8 | .846 | 17.2 | 22.1 | 19.8 | .935 |
| TJ 3 | 0.0 | 1.8 | 6.1 | 39.5 | 52.6 | 12.7 | 2.8 | 7.0 | 38.7 | .831 | 17.1 | 23.4 | 21.2 | .927 |
| TJ 4 | 0.0 | 2.2 | 15.0 | 43.2 | 39.6 | 13.5 | 2.7 | 17.3 | 38.9 | .831 | 22.5 | 21.8 | 19.2 | .939 |
| TJ 5 | 1.9 | 0.4 | 9.8 | 48.6 | 39.3 | 13.4 | 2.7 | 11.1 | 39.2 | .829 | 21.1 | 26.9 | 20.7 | .930 |
| CBU-33 | ND | 2.2 | 8.4 | 37.9 | 51.5 | 12.7 | 2.8 | 9.9 | 41.6 | .817 | 16.8 | 22.7 | 20.7 | .930 |
| | ND | 1.4 | 7.8 | 45.3 | 45.5 | 13.5 | 2.7 | 9.3 | 42.1 | .815 | 20.2 | 26.8 | 20.3 | .932 |
| | ND | 4.6 | 9.7 | 45.0 | 40.7 | 14.1 | 2.7 | 11.7 | 42.1 | .815 | 21.0 | 26.6 | 20.3 | .932 |

| Run | Sulfur Distribution % Liquid | Sulfur Distribution % Gas | Sulfur Distribution % Solids | Cl ppm | Pour Point °C. | Gas Analysis, % $H_2$ | $CH_4$ | CO | $CO_2$ | $C_2H_6$ | $H_2S$ | $C_3H_8$ | Other |
|---|---|---|---|---|---|---|---|---|---|---|---|---|---|
| Feed | | | | 0.49 | 9 | | | | | | | | |

TABLE 3A-continued

TIA JUANA HEAVY OILS RUN DATA

| | | | | | | | | | | | | |
|---|---|---|---|---|---|---|---|---|---|---|---|---|
| TJ 1 | 100 | 0 | 0 | 6 | | | | | | | | |
| TJ 2 | 96 | 0 | 0 | 7 | | | | | | | | |
| TJ 3 | 100 | 0 | 0 | −3 | | | | | | | | |
| TJ 4 | 96 | 0 | 0 | −9 | | | | | | | | |
| TJ 5 | 95 | 0 | 3 | −13 | | | | | | | | |
| CBU-33 | 95 | 5 | 0 | −10 | 3.4 | 30.4 | 1.3 | 6.9 | 13.4 | 13.6 | 11.9 | 18.8 |
| | 94 | 8 | 0 | −19 | 1.9 | 37.0 | 1.0 | 4.8 | 16.0 | 11.6 | 13.4 | 14.3 |
| | 93 | 10 | 0 | −25 | 1.7 | 34.6 | 0.6 | 5.3 | 16.0 | 9.8 | 14.4 | 17.6 |

*Water- and solids-free basis.
**Viscosity measured on oil after coke was removed.
***Run CBU-33 was run in the continuous unit. All other runs were performed in the batch autoclave.
For 10° API oil, 10 lbs salt/1000 bbls is equivalent to 18 ppm Cl.

Structural data for the Tia Juana crude oil feed is given in Table 3B.

TABLE 3B

STRUCTURAL ANALYSES OF TIA JUANA HEAVY CRUDE OIL FEED (Wt %)

| Structure | |
|---|---|
| Light Fractions | |
| Paraffins | 11.2 |
| Cycloparaffins | 16.7 |
| Condensed Cycloparaffins | 28.0 |
| Alkyl Benzenes | 5.1 |
| Benzo Cycloparaffins | 4.4 |
| Benzo Dicycloparaffins | 5.4 |
| | 70.8 |
| Heavier Fractions | |
| 2-Ring Aromatics | 9.8 |

TABLE 3B-continued

STRUCTURAL ANALYSES OF TIA JUANA HEAVY CRUDE OIL FEED (Wt %)

| Structure | |
|---|---|
| 3-Ring Aromatics | 3.4 |
| 4-Ring Aromatics | 1.3 |
| 5-Ring Aromatics | 0.3 |
| Polyaromatics | 0.3 |
| Sulfur Aromatics | 7.2 |
| | 22.3 |
| Remainder | 6.9 |
| | 100.0 |

EXAMPLE 4

Batch autoclave and continuous unit runs were conducted on the Zuata crude oil sample. The results are given in Table 4A.

TABLE 4A

ZUATA HEAVY OILS RUN DATA

| Run | Temp °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % |
|---|---|---|---|---|---|---|---|---|---|---|---|---|---|
| Feed | | | 9.5 | | | 193,000 | 1,440 | 9.4 | 64.6 | | 18.0 | | 0.15 |
| ZU 1 | 400 | 2200 | 9.5 | 15 | 1.2 | 2,410 | 104 | 10.7 | 52.4 | 18.9 | 14.7 | 18.3 | 0.04 |
| ZU 2 | 370 | 1750 | 9.5 | 15 | 11.8 | 46,200 | 512 | 9.7 | 61.7 | 4.5 | 14.4 | 20.0 | 0.08 |
| ZU 3 | 360 | 1850 | 9.5 | 15 | 2.1 | 9,000 | 196 | 12.9 | 51.7 | 20.0 | 14.2 | 21.1 | 0.07 |
| ZU 4 | 415 | 2275 | 9.5 | 15 | Trace | 457 | 38 | 15.7 | 41.3 | 36.1 | 14.8 | 17.8 | 0.32 |
| CBU-34 | 415 | 1060 | 9.5 | 0.9 | 10.7 | 29,800 | 514 | 12.2 | 56.3 | 12.8 | 18.2 | −1.1 | 0.17 |
| | 425 | 1020 | 9.5 | 1.4 | 7.3 | 9,410 | 234 | 12.2 | 56.2 | 13.0 | 17.1 | 5.0 | 0.16 |
| | 435 | 1040 | 9.5 | 2.7 | 0.2 | 2,800 | 103 | 14.1 | 48.7 | 24.6 | 14.4 | 19.9 | 0.19 |

| Run | Coke Wt. % | Gas Wt. % | IBP-450° F. Wt. % | 450-950° F. Wt. % | Resid +950F Wt. % | Con-Carbon Wt. % | Sulfur Wt. %* | IBP-450° F. Vol % | IBP-450° F. °API | IBP-450° F. Sp gr | Volume % 450-650° F. | Volume % 650-950° F. | 450-950° F. °API | 450-950° F. Sp gr |
|---|---|---|---|---|---|---|---|---|---|---|---|---|---|---|
| Feed | | 0.6 | 0.9 | 33.9 | 64.6 | 11.6 | 3.6 | 1.2 | 43.2 | .810 | 12.3 | 23.9 | 18.9 | .941 |
| ZU 1 | 0.0 | 1.0 | 5.5 | 41.1 | 52.4 | 12.8 | 3.7 | 6.7 | 41.7 | .817 | 17.3 | 26.3 | 19.5 | .937 |
| ZU 2 | 0.0 | 1.9 | 2.8 | 33.6 | 61.7 | 12.5 | 3.8 | — | — | — | 7.5 | 28.4 | 19.5 | .937 |
| ZU 3 | 0.0 | 0.7 | 7.6 | 40.0 | 51.7 | 12.8 | 3.4 | 8.8 | 36.5 | .842 | 18.9 | 22.4 | 17.6 | .949 |
| ZU 4 | 0.9 | 3.8 | 8.8 | 45.2 | 41.3 | 13.6 | 3.4 | 10.4 | 41.5 | .818 | 21.8 | 24.9 | 19.2 | .939 |
| CBU-34 | ND | 3.1 | 2.7 | 37.9 | 56.3 | 12.3 | 3.5 | 3.2 | 35.4 | .847 | 15.1 | 24.9 | 18.4 | .944 |
| | ND | 3.4 | 2.7 | 37.7 | 56.2 | 13.7 | 3.5 | 3.2 | 37.3 | .838 | 14.5 | 25.6 | 19.5 | .937 |
| | ND | 2.9 | 5.1 | 43.3 | 48.7 | 14.4 | 3.2 | 6.1 | 39.2 | .829 | 18.5 | 27.1 | 19.0 | .940 |

| Run | Sulfur Distribution % Liquid | Sulfur Distribution % Gas | Sulfur Distribution % Solids | Cl ppm | Pour Point °C. | Gas Analysis, % $H_2$ | $CH_4$ | CO | $CO_2$ | $C_2H_6$ | $H_2S$ | $C_3H_8$ | Other |
|---|---|---|---|---|---|---|---|---|---|---|---|---|---|
| Feed | | | | 14.9 | 24 | | | | | | | | |
| ZU 1 | 103 | 0 | 0 | | | | | | | | | | |
| ZU 2 | 106 | 0 | 0 | | 13 | | | | | | | | |
| ZU 3 | 94 | 0 | 0 | | 6 | | | | | | | | |
| ZU 4 | 94 | 0 | 1 | | | | | | | | | | |
| ZU 5 | 95 | 4 | 0 | | 5 | 3.8 | 37.7 | Trace | 8.2 | 15.6 | 11.5 | 12.7 | 10.5 |
| CBU-34 | 95 | 5 | 0 | | 2 | 1.7 | 33.1 | 3.4 | 5.2 | 14.0 | 15.0 | 10.9 | 16.7 |

TABLE 4A-continued

ZUATA HEAVY OILS RUN DATA

| | | | | | | | | | | | | | |
|---|---|---|---|---|---|---|---|---|---|---|---|---|---|
| | 86 | 10 | 0 | | −7 | 1.6 | 32.9 | 3.2 | 3.9 | 13.0 | 19.6 | 10.1 | 15.7 |

*Water- and solids-free basis.
**Viscosity measured on oil after coke was removed.
***Run CBU-34 was run in the continuous unit. All other runs were performed in the batch autoclave.
For 10° API oil, 10 lbs salt/1000 bbls is equivalent to 18 ppm Cl.

Structural data for the Zuata crude oil feed and product is given in Table 4B.

TABLE 4B

STRUCTURAL ANALYZES OF ZUATA HEAVY CRUDE OIL FEEDS AND RUN PRODUCTS (Wt %)

| | Feed | ZU-1 | ZU-4 |
|---|---|---|---|
| Run Temperature, °C. | — | 400 | 415 |
| Residence Time, Min. | — | 15 | 15 |
| Structure | | | |
| Light Fractions | | | |
| Paraffins | 12.0 | 10.3 | 11.8 |
| Cycloparaffins | 13.1 | 10.8 | 11.9 |
| Condensed Cycloparaffins | 17.3 | 22.5 | 21.1 |
| Alkyl Benzenes | 6.5 | 5.1 | 7.0 |
| Benzo Cycloparaffins | 4.5 | 4.3 | 4.6 |
| Benzo Dicyloparaffins | 5.0 | 2.9 | 3.2 |
| | 58.4 | 55.9 | 59.6 |
| Structure Heavier Fractions | | | |
| 2-Ring Aromatics | 7.1 | 9.7 | 11.2 |

TABLE 4B-continued

STRUCTURAL ANALYZES OF ZUATA HEAVY CRUDE OIL FEEDS AND RUN PRODUCTS (Wt %)

| | Feed | ZU-1 | ZU-4 |
|---|---|---|---|
| 3-Ring Aromatics | 2.4 | 5.9 | 6.3 |
| 4-Ring Aromatics | 0.9 | 4.9 | 4.5 |
| 5-Ring Aromatics | 0.1 | 2.6 | 2.3 |
| Polyaromatics | 0.1 | 1.3 | 0.6 |
| Sulfur Aromatics | 9.8 | 5.6 | 4.3 |
| | 20.4 | 30.0 | 29.2 |
| Remainder | 21.2 | 14.1 | 11.2 |
| | 100.0 | 100.0 | 100.0 |

EXAMPLE 5

Batch autoclave and continuous unit runs were conducted on the Cerro Negro crude oil sample. The results are given in Table 5A.

TABLE 5A

CERRO NEGRO HEAVY OILS RUN DATA

| Run | Temp °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % |
|---|---|---|---|---|---|---|---|---|---|---|---|---|---|
| Feed | | | 9.8 | | | 321,000 | 1,780 | 8.0 | 65.5 | | 21.8 | | 0.37 |
| CN 1 | 350 | 1550 | 9.8 | 15 | 0.7 | 16,900 | 695 | 15.0 | 58.0 | 11.5 | 16.9 | 22.5 | 0.83 |
| CN 2 | 360 | 1525 | 9.8 | 15 | 2.3 | 11,500 | 402 | 12.7 | 54.7 | 16.5 | 18.1 | 16.9 | 0.10 |
| CN 3 | 370 | 1500 | 9.8 | 15 | 5.4 | 6,360 | 215 | 14.8 | 53.5 | 18.3 | 17.8 | 18.4 | 0.21 |
| CN 4 | 405 | 1630 | 9.8 | 15 | 2.6 | 5,150 | 159 | 14.3 | 53.8 | 17.9 | 18.4 | 22.9 | 1.01 |
| CN 5 | 415 | 1760 | 9.8 | 15 | 6.8 | 4,030 | 127 | 14.2 | 44.3 | 32.4 | 20.3 | 6.9 | 1.32 |
| CBU-32 | 415 | 980 | 9.8 | 1.6 | 8.1 | 37,500 | 652 | 13.9 | 59.7 | 8.9 | 18.3 | 16.1 | 0.35 |
| | 425 | 1030 | 9.8 | 1.4 | 5.8 | 13,600 | 352 | 12.5 | 56.0 | 14.5 | 18.2 | 16.5 | 0.42 |
| | 435 | 1060 | 9.8 | 1.0 | 4.2 | 4,610 | 150 | 11.6 | 48.3 | 26.3 | 20.0 | 8.3 | 0.60 |

| Run | Coke Wt. % | Gas Wt. % | IBP–450° F. Wt. % | 450–950° F. Wt. % | Resid +950F Wt. % | Con-Carbon Wt. % | Sulfur Wt. %* | IBP-450° F. Vol % | IBP-450° F. °API | IBP-450° F. Sp gr | Volume % 450–650° F. | Volume % 650–950° F. | Volume % 450–950° F. °API | Volume % 450–950° F. Sp gr |
|---|---|---|---|---|---|---|---|---|---|---|---|---|---|---|
| Feed | | 0.2 | 2.4 | 31.9 | 65.5 | 14.6 | 3.8 | 2.9 | 37.0 | .840 | 11.7 | 22.8 | 19.5 | .937 |
| CN 1 | 0.0 | 0.7 | 2.1 | 39.2 | 58.0 | 14.2 | 3.7 | 2.4 | 37.3 | .838 | 18.1 | 22.4 | 19.8 | .935 |
| CN 2 | 0.0 | 3.8 | 3.6 | 37.9 | 54.7 | 14.2 | 3.6 | 4.3 | 36.6 | .842 | 18.7 | 21.1 | 19.8 | .935 |
| CN 3 | 0.0 | 0.9 | 5.4 | 40.2 | 53.5 | 15.4 | 3.6 | 6.3 | 38.5 | .832 | 21.4 | 20.0 | 19.4 | .938 |
| CN 4 | 0.0 | 1.6 | 2.9 | 41.7 | 53.8 | 14.6 | 3.5 | 3.5 | 41.3 | .819 | 18.4 | 25.2 | 20.8 | .929 |
| CN 5 | 0.3 | 1.7 | 9.5 | 44.2 | 44.3 | 17.3 | 3.5 | 11.3 | 42.0 | .816 | 23.0 | 22.8 | 19.2 | .939 |
| CBU-32 | ND | 2.4 | 4.0 | 33.8 | 59.7 | 15.3 | 3.3 | 4.7 | 35.1 | .849 | 16.3 | 19.6 | 19.7 | .936 |
| | ND | 2.5 | 1.3 | 40.3 | 56.0 | 15.7 | 3.3 | 1.5 | 33.1 | .860 | 19.5 | 23.7 | 20.2 | .933 |
| | ND | 7.9 | 2.6 | 41.1 | 48.3 | 15.6 | 3.3 | 3.2 | 36.8 | .841 | 22.8 | 21.8 | 19.4 | .938 |

| Run | Sulfur Distribution % Liquid | Sulfur Distribution % Gas | Sulfur Distribution % Solids | Cl ppm | Pour Point °C. | Gas Analysis, % $H_2$ | $CH_4$ | CO | $CO_2$ | $C_2H_6$ | $H_2S$ | $C_3H_8$ | Other |
|---|---|---|---|---|---|---|---|---|---|---|---|---|---|
| Feed | | | | 69.0 | 27 | | | | | | | | |
| CN 1 | 97 | 0 | 0 | 5.5 | 12 | | | | | | | | |
| CN 2 | 95 | 0 | 0 | | 3 | | | | | | | | |
| CN 3 | 95 | 0 | 0 | 13.8 | −1 | | | | | | | | |
| CN 4 | 93 | 0 | 0 | 9.2 | 4 | | | | | | | | |
| CN 5 | 93 | 0 | 0 | | | | | | | | | | |
| CBU-32 | 86 | 5 | 0 | | 5 | 9.2 | 30.1 | 1.3 | 4.9 | 12.5 | 19.7 | 9.4 | 12.9 |
| | 85 | 5 | 0 | | 5 | 9.3 | 30.8 | 1.8 | 3.6 | 12.1 | 19.2 | 9.3 | 13.9 |
| | 85 | 11 | 0 | | 2 | 6.4 | 30.7 | 1.6 | 3.1 | 12.6 | 18.4 | 10.1 | 17.1 |

*Water- and solids-free basis.
**Viscosity measured on oil after coke was removed.
***Run CBU-32 was run in the continuous unit. All other runs were performed in the batch autoclave.
For 10° API oil, 10 lbs salt/1000 bbls is equivalent to 18 ppm Cl.

Structural data for the Cerro Negro crude oil feed is given in Table 5B.

TABLE 5B

STRUCTURAL ANALYSES OF CERRO NEGRO HEAVY CRUDE OIL FEED (Wt %)

| | |
|---|---|
| Structure Light Fractions | |
| Paraffins | 12.0 |
| Cycloparaffins | 10.9 |
| Condensed Cycloparaffins | 20.7 |
| Alkyl Benzenes | 6.4 |
| Benzo Cycloparaffins | 4.3 |
| Benzo Dicycloparaffins | 7.2 |
| | 61.5 |
| Structure Heavier Fractions | |
| 2-Ring Aromatics | 12.1 |
| 3-Ring Aromatics | 2.1 |
| 4-Ring Aromatics | 0.9 |
| 5-Ring Aromatics | 0.2 |
| Polyaromatics | 0.1 |
| Sulfur Aromatics | 9.6 |
| | 25.0 |
| Remainder | 13.5 |
| | 100.0 |

EXAMPLE 6

Batch autoclave runs were conducted on two shale oil samples. The feed for Run OS-1 was from the Paraho Shale Oil operation. The feed for Runs OS 4–6 were from another shale oil operation. The results are given in Table 6A.

TABLE 6A

SHALE OIL ANALYTICAL RESULTS

| Run | Temp °C. | Pressure, psig | Feed $H_2O$ % | Time min | Product $H_2O$ % | Viscosity cp 25° C. | Viscosity cp 80° C. | Gravity °API | Residual Wt. % | Residual Conv. % | Asphaltene* Wt. % | Asphaltene* Alter. % | Solid Wt. % | Coke Wt. % | Gas Wt. % |
|---|---|---|---|---|---|---|---|---|---|---|---|---|---|---|---|
| Paraho Shale Oil - Batch Runs | | | | | | | | | | | | | | | |
| Feed | | | 0.0 | | 0.0 | Solid | 24 | 21.8 | 22.9 | | 1.8 | | 0.02 | | 0.07 |
| OS-1 | 400 | 250 | 0.0 | 15 | 0.0 | 133 | 19 | 22.5 | 34.8 | −52.0 | 3.2 | −77.8 | 0.06 | ND | 2.0 |
| Shale Oil - Batch Runs | | | | | | | | | | | | | | | |
| Feed | | | 2.4 | | | 552 | 9 | 23.1 | 12.7 | | 2.0 | | 0.34 | | 1.0 |
| OS-4 | 400 | 910 | 2.4 | 15 | 0.0 | 20 | 9 | 31.5 | 8.6 | 32.3 | 1.6 | 20.0 | 0.18 | ND | 2.1 |
| OS-5 | 380 | 830 | 2.4 | 15 | 0.9 | 20 | 8 | 30.8 | 9.3 | 26.8 | 1.6 | 20.0 | 0.35 | ND | 2.0 |
| OS-6 | 350 | 720 | 2.4 | 15 | 0.0 | 393 | 9 | 28.6 | 10.8 | 15.0 | 1.7 | 15.0 | 0.17 | ND | 0.7 |

| Run | IBP–450° F. Wt. % | 450–950° F. Wt. % | Resid +950° F. Wt. % | Carbon Wt. % | Sulfur* Wt. % | IBP–450° F. Vol % | IBP–450° F. °API | IBP–450° F. Sp gr | Volume % 450–650° F. | Volume % 650–950° F. | 450–950° F. °API | 450–950° F. Sp gr | Pour Point C. |
|---|---|---|---|---|---|---|---|---|---|---|---|---|---|
| Paraho Shale Oil - Batch Runs | | | | | | | | | | | | | |
| Feed | 6.1 | 70.9 | 22.9 | 2.5 | 1.0 | | | | | | | | |
| OS-1 | 5.3 | 57.8 | 34.9 | 4.6 | 0.8 | 6.1 | 22.5 | .919 | 21.9 | 36.1 | 22.8 | .917 | 8 |
| Shale Oil - Batch Runs | | | | | | | | | | | | | |
| Feed | 5.5 | 80.7 | 12.7 | 2.6 | 2.1 | 6.1 | 40.8 | .821 | 39.0 | 44.4 | 28.2 | .886 | 20 |
| OS-4 | 18.3 | 71.0 | 8.6 | 2.4 | 0.9 | 19.0 | 37.9 | .835 | 41.4 | 27.5 | 26.8 | .894 | −1 |
| OS-5 | 11.1 | 77.6 | 9.3 | 2.4 | 0.9 | 11.7 | 38.9 | .830 | 44.7 | 31.4 | 27.7 | .889 | 20 |
| OS-6 | 12.3 | 76.2 | 10.8 | 1.8 | 0.9 | 13.1 | 38.6 | .832 | 40.5 | 35.4 | 27.9 | .888 | 20 |

*Water and solids free basis.

EXAMPLE 7

The Cold Lake heavy oil was distilled to produce various fractions of different boiling point ranges. Initially, the Cold Lake heavy oil was distilled to produce two primary fractions: one fraction with a boiling range of up to 650° F. (−650° F.) and one fraction with a boiling range above 650° F. (+650° F.). Portions of these two primary fractions were then further distilled to give four additional fractions: (1) the −650° F. primary fraction produced one fraction with a boiling range of less than 450° F., and one fraction with a boiling range between 450° F.–650° F.; (2) the +650° F. primary fraction produced one fraction with a boiling range between 650° F.–950° F., and one fraction with a boiling range above 950° F. (+950° F.). In sum, the produced fractions for testing were as follows:

−650° F. (primary fraction)
  −450° F.
  450° F.–650° F.
+650° F. (primary fraction)
  650° F.–950° F.
  +950° F.

The whole oil and the produced fractions were analyzed and measured for weight (%), specific gravity, °API, and viscosity (centipoise). The results are given in Table 7A.

TABLE 7A

VISCOSITY AND GRAVITY OF COLD LAKE HEAVY OIL FRACTIONS

| Fraction °F. | Wt, % | Sp gr | Gravity °API | Viscosity, cps 25° C. | Viscosity, cps 80° C. |
|---|---|---|---|---|---|
| Whole Oil | | 0.990 | 11.5 | 41,600 | 612 |
| −450 | 2.4 | 0.850 | 35.0 | 6 | 4 |
| 450–650 | 18.5 | 0.902 | 25.4 | 16 | 8 |
| −650 | 20.9 | 0.889 | 27.7 | 12 | 7 |
| 650–950 | 15.9 | 0.953 | 17.0 | 434 | 47 |
| +950 | 63.2 | 1.006 | 9.1 | Solid | Solid |
| +650 | 79.1 | 0.998 | 10.2 | Solid | 17,700 |

The whole oil and +650° F. fraction were then each reacted in a series of bath rocking bomb autoclave experiments at temperatures of 400° F. and 415° F. to compare the effect of reaction temperature on viscosity reduction in a whole oil fuel and a topped fuel. The reaction times were 15 minutes. The temperature tests produced a "whole oil product" and a "+650° F. product." A portion of the +650° F. was blended with the −650° F. fraction at the proportion of the original whole oil to give a blended product. The viscosities of the temperature reacted +650° F. fraction, the blended product, and the temperature reacted whole oil were measured and compared. Results are shown in Table 7B.

TABLE 7B

COMPARATIVE TEMPERATURE RUNS

| Run | Feed | Temp °C. | Time, min | Viscosity 25° C. | Viscosity 80° C. | Resid +950° F. Wt % | Asphaltene Wt % | Volume % 450° | Volume % 450°-650° F. | Volume % 650°-950° F. |
|---|---|---|---|---|---|---|---|---|---|---|
| 1 | +650° F. | 400 | 15 | 7620 | 533 | 63.0 | 17.9 | 4.5 | 6.5 | 27.3 |
| 2 | +650° F. | 415 | 15 | 1580 | 101 | 51.5 | 19.4 | 10.9 | 13.9 | 25.0 |
| | +650° F. product from Run 1, (400° C.), blended with −650° F. fraction | 400 | 15 | 1330 | 57 | 49.8 | 14.1 | 6.0 | 23.6 | 21.6 |
| | +650° F. product from Run 2, (415° C.), blended with −650° F. fraction | 415 | 15 | 572 | 35 | 40.7 | 15.3 | 11.0 | 29.4 | 19.8 |
| 3 | Whole oil | 405 | 15 | 762 | 57 | 45.7 | 14.0 | 9.7 | 22.3 | 24.5 |
| 4 | Whole oil | 415 | 15 | 155 | 27 | 37.2 | 13.2 | 13.5 | 21.9 | 26.9 |

EXAMPLE 8

A run was made in a fifty barrel per day pilot plant, designed to simulate operation in a larger scale vertical tube reactor system. This run was performed to confirm results obtained in the batch and continuous bench scale experiments and to investigate heat transfer. The following is a description of the pilot plant:

An insulated and coiled truck tanker containing approximately 6,000 gallons of the heavy oil was located adjacent to the test site. Steam was produced by a portable boiler unit and circulated through the tanker coils to heat the oil to a temperature of approximately 120° F. to 160° F. At this temperature, the oil was fluid enough to be circulated through the tanker by a Roper gear pump. Additionally, a 1,250-gallon heated and insulated tank was provided for storage of feed oil and was also equipped with a Roper gear pump and circulating loop. A bleed stream from either the trailer or circulating loop supplied oil to either of two feed tanks. Exch of the feed tanks was equipped with an Orberdorfer gear pump and circulating loop. Each circulating loop had two inline heaters, one on the pump inlet and one on the pump discharge, to heat the oil to 165° F. to 175° F. Each set of heaters had a temperature controller to maintain the temperature of the oil in the tank. A bleed stream from each of the feed tank circulating loops supplied hot oil to the common suction manifold of the high pressure triplex pumps. All of the piping for the feed oil circuit was provided with temperature controlled heat tape and fiberglass insulation.

Two FMC Bean triplex piston pumps provided the high working pressure of the system at flow rates of 1 to 4 gpm. Only one of these pumps was in use at a time during actual operation; the second pump was a backup. The high pressure discharge of each of these fed a common line to the coaxial heat exchanger. Also on the high pressure discharge of these pumps were Grear Pulsation Dampeners, pressure indicators, safety relief valves, and rupture disks. The safety relief valves and rupture disks had return lines to the feed tanks.

High pressure feed oil was then pumped through the surface coaxial heat exchanger composed of a 1-inch diameter tube for the feed flow with a ½-inch diameter tube inside carrying the product oil. The coaxial heat exchanger flow can be configured to use two, four, or all six sections of the heat exchanger unit. The heat exchanger was wrapped with temperature limiting 8 watts/foot heat tape and fiberglass insulation.

Feed flowed from the coaxial heat exchanger to the outer 1-inch side of the 1-inch by ⅜-inch coaxial vertical geoclave reactor string. The 1-inch string was approximately 240 feet long with a 88-foot expanded section at the bottom of the string. The expanded section was 2.62-inch I.D. and gave approximately 15-minute retention time (based upon oil volume only) at a flow rate of 1.5 gallon/minute. The reacted oil then flowed up the ⅜-inch center of the coaxial string. At the top of the string the flow of product was through the ½-inch center tube of the horizontal coaxial heat exchanger. Product then flowed to the pressure letdown manifold which directed the flow to either or both of the Greylok choke assemblies or bypassed the chokes and directed flow to a series of pressure letdown barstock valves.

The product then passed to the first gas-liquid separation tank. The liquid level in this tank was monitored by a level indicator in order to maintain a liquid level in the tank. The level was controlled by manually adjusting the liquid discharge valve on the bottom of the tank. This tank was kept at 10 to 25 psig to help the separation of gas and liquid. The product was collected in a product tank and transferred by pump into the product truck trailer except during product sampling periods.

The gas flowed to the second phase separation tank where any light condensates were collected. Gas then flowed to the scrubber circuit through a gas meter, and gas sampling loop.

Gas flowed into the packed scrubber tower where it was contacted with a circulating 20% caustic (NaOH) solution spray. This solution removed the $H_2S$ from the gas. The pH of this solution was monitored and fresh solution was pumped from the caustic makeup tanks into the scrubber tank to maintain pH. Both caustic makeup and waste solution removal were made with a variable speed dual head piston pump. The waste solution was stored in appropriate tankage for treatment and disposal.

A gas booster pump was used to pull the gas from the scrubber circuit into the second section of the gas combustor unit where it was incinerated.

A Boscan, Venezuela crude was used as the feedstock. The pilot plant was operated for ninety-six hours, and 102.4 barrels of oil were processed at three conditions. Results are given in Table 8A. In the run 20 lb of coke were produced, equivalent to 0.05 weight percent of the oil fed to the system.

During this run, the reactor temperature (bulk fluid temperature) was maintained at about 750° F., 760° F., and 765° F. as shown in Table 8B. The highest heater temperatures measured were 777° F., 804° F., and 806° F. for these bulk fluid temperatures, giving the following ΔT's: 27° F. (15° C.) @ 750° F.; 44° F. (24° C.) @ 760° F.; and 41° F. (23° C.) @ 765° F.

TABLE 8A

BOSCAN HEAVY OILS RUN DATA

| Run | Temp °C. | Pressure, psig | Feed $H_2O$ % | Time min*** | Product $H_2O$ % | Viscosity** cp 25° C. | Viscosity** cp 80° C. | Gravity °API | Residual Wt. % | Residual Conv. % | Asphaltene* Wt. % | Asphaltene* Alter. % | Solid Wt. % |
|---|---|---|---|---|---|---|---|---|---|---|---|---|---|
| | | | | | | Boscan Crude | | | | | | | |
| Feed | | | 1.2 | | | 57,957 | 828 | 9.5 | 64.1 | | 19.0 | | 0.12 |
| Sample 1 | 395 | 1553 | 1.2 | 6.7 | 0.0 | 2,698 | 180 | 12.4 | 54.7 | 14.7 | 14.9 | 21.6 | 0.17 |
| Sample 2 | 399 | 1594 | 1.2 | 6.1 | 0.0 | 2,095 | 131 | 12.6 | 56.6 | 11.7 | 15.5 | 18.4 | 0.21 |
| Sample 3 | 399 | 2058 | 1.2 | 5.7 | 0.0 | 2,086 | 103 | 12.6 | 53.0 | 17.3 | 15.5 | 18.4 | 0.09 |
| Sample 4 | 404 | 1995 | 1.2 | 7.1 | 0.0 | 1,085 | 64 | 12.9 | 50.4 | 21.4 | 15.8 | 16.8 | 0.08 |
| Sample 5 | 408 | 2032 | 1.2 | 5.8 | 0.0 | 736 | 43 | 13.0 | 46.1 | 28.1 | 16.0 | 16.0 | 0.15 |
| Sample 6 | 407 | 2088 | 1.2 | 4.8 | 0.1 | 857 | 50 | 13.2 | 47.5 | 25.9 | 15.8 | 16.8 | 0.11 |
| Sample 7 | 407 | 2106 | 1.2 | 5.6 | 0.0 | 754 | 43 | 13.5 | 47.8 | 25.4 | 15.6 | 17.9 | 0.04 |
| Sample 8 | 408 | 2071 | 1.2 | 5.8 | 0.0 | 934 | 46 | 13.2 | 46.7 | 27.2 | 15.8 | 16.8 | 0.11 |
| Sample 9 | 406 | 2056 | 1.2 | 5.7 | 0.0 | 1,036 | 81 | 13.2 | 46.8 | 26.9 | 15.8 | 16.8 | 0.12 |
| Sample 10 | 407 | 1982 | 1.2 | 5.3 | 0.1 | 842 | 55 | 13.5 | 48.4 | 24.6 | 15.6 | 17.9 | 0.14 |
| Sample 11 | 404 | 2123 | 1.2 | 5.1 | 0.0 | 868 | 46 | 13.2 | 49.7 | 22.5 | 15.8 | 16.8 | 0.13 |
| Sample 12 | 407 | 2000 | 1.2 | 4.5 | 0.0 | 1,137 | 58 | 13.0 | 48.1 | 24.9 | 15.7 | 17.4 | 0.17 |
| Sample 13 | 408 | 2000 | 1.2 | 4.1 | 0.0 | 941 | 73 | 13.3 | 51.3 | 20.0 | 15.5 | 18.4 | 0.10 |
| Sample 14 | 409 | 2124 | 1.2 | 3.1 | 0.1 | 1,123 | 67 | 13.2 | 51.3 | 19.9 | 15.7 | 17.4 | 0.12 |
| Sample 15 | 406 | 2120 | 1.2 | 4.0 | 0.0 | 1,245 | 73 | 13.0 | 52.4 | 18.3 | 15.6 | 17.9 | 0.10 |
| Sample 16 | 402 | 2007 | 1.2 | 4.1 | 0.0 | 989 | 66 | 12.9 | 50.7 | 20.9 | 15.7 | 17.4 | 0.11 |

| Run | Gas Wt. % | IBP–450° F. Wt. % | 450–950° F. Wt. % | Resid +950F Wt. % | Con-Carbon Wt. %* | Sulfur Wt. % | Pour Pt. °C. | IBP–450° F. Vol % | IBP–450° F. °API | IBP–450° F. Sp gr | Volume % 450–650° F. | Volume % 650–950° F. | 450–950° F. °API | 450–950° F. Sp gr |
|---|---|---|---|---|---|---|---|---|---|---|---|---|---|---|
| | | | | | | Boscan Crude | | | | | | | | |
| Feed | 1.6 | 5.1 | 29.2 | 64.1 | 13.5 | 5.2 | 7 | 6.0 | 38.3 | .833 | 18.0 | 13.2 | 21.6 | .924 |
| Sample 1 | 3.1 | 5.1 | 37.1 | 54.7 | 15.1 | 4.7 | −5 | 6.0 | 36.6 | .842 | 19.0 | 20.9 | 21.3 | .926 |
| Sample 2 | 2.6 | 5.7 | 35.1 | 56.6 | 14.9 | 4.8 | −12 | 6.8 | 40.0 | .825 | 16.2 | 21.2 | 21.8 | .923 |
| Sample 3 | 4.7 | 6.2 | 36.2 | 53.0 | 14.6 | 4.8 | −12 | 7.3 | 36.9 | .840 | 16.5 | 22.1 | 21.1 | .927 |
| Sample 4 | 3.0 | 8.3 | 38.4 | 50.4 | 15.5 | 4.4 | −15 | 9.6 | 36.2 | .844 | 20.0 | 20.6 | 21.8 | .929 |
| Sample 5 | 3.0 | 8.6 | 42.4 | 46.1 | 15.9 | 4.5 | −19 | 10.2 | 37.2 | .839 | 19.4 | 19.9 | 21.3 | .926 |
| Sample 6 | 4.9 | 9.2 | 38.5 | 47.5 | 15.3 | 4.5 | −22 | 10.9 | 38.3 | .833 | 19.2 | 21.9 | 20.8 | .929 |
| Sample 7 | 6.6 | 5.4 | 40.2 | 47.8 | 15.9 | 4.4 | −21 | 6.4 | 38.1 | .835 | 17.4 | 25.9 | 21.1 | .927 |
| Sample 8 | 4.7 | 11.2 | 37.5 | 46.7 | 15.1 | 4.4 | −16 | 13.1 | 36.1 | .844 | 17.0 | 22.7 | 19.8 | .935 |
| Sample 9 | 4.0 | 9.2 | 40.0 | 46.8 | 16.0 | 4.5 | −17 | 11.0 | 38.7 | .831 | 21.3 | 21.3 | 20.5 | .931 |
| Sample 10 | 4.6 | 7.1 | 40.0 | 48.4 | 15.1 | 4.4 | −17 | 6.8 | 41.1 | .820 | 20.7 | 20.1 | 21.8 | .923 |
| Sample 11 | 4.2 | 6.6 | 39.6 | 49.7 | 13.6 | 4.6 | −18 | 7.9 | 38.6 | .832 | 21.1 | 21.5 | 21.5 | .925 |
| Sample 12 | 3.7 | 11.3 | 36.9 | 48.1 | 15.4 | 4.5 | −18 | 13.5 | 37.4 | .838 | 18.5 | 21.2 | 20.5 | .931 |
| Sample 13 | 3.9 | 7.1 | 37.7 | 51.3 | 14.8 | 4.6 | −18 | 8.5 | 39.7 | .827 | 19.8 | 20.8 | 21.6 | .924 |
| Sample 14 | 4.0 | 7.6 | 37.1 | 51.3 | 16.0 | 4.6 | −18 | 9.2 | 40.4 | .823 | 19.6 | 20.4 | 21.5 | .925 |
| Sample 15 | 2.6 | 6.7 | 38.3 | 52.4 | 15.5 | 4.5 | −15 | 8.0 | 39.7 | .826 | 19.7 | 21.4 | 21.8 | .923 |
| Sample 16 | 2.4 | 7.6 | 39.2 | 50.7 | 15.8 | 4.4 | −14 | 9.1 | 39.7 | .827 | 19.3 | 22.6 | 21.5 | .925 |

| Run | Sulfur Distribution % Liquid | Sulfur Distribution % Gas | Sulfur Distribution % Solids | Gas Analysis, % $H_2$ | $CH_4$ | CO | $CO_2$ | $C_2H_6$ | $H_2S$ | $C_3H_8$ | $C_2H_4$ | $C_3H_6$ | Other |
|---|---|---|---|---|---|---|---|---|---|---|---|---|---|
| | | | | | Boscan Crude | | | | | | | | |
| Feed | | | | | | | | | | | | | |
| Sample 1 | 89 | 9 | 0 | 3.6 | 26.4 | 0.5 | 4.2 | 11.2 | 32.2 | 7.7 | 0.2 | 1.8 | 10.9 |
| Sample 2 | 92 | 4 | 0 | 1.8 | 25.4 | 0.3 | 4.6 | 11.4 | 33.2 | 8.1 | 0.2 | 1.8 | 11.8 |
| Sample 3 | 90 | 10 | 0 | 1.8 | 25.9 | 0.3 | 4.1 | 11.7 | 33.3 | 8.1 | 0.2 | 1.7 | 11.0 |
| Sample 4 | 84 | 5 | 0 | 1.8 | 29.8 | 0.1 | 4.0 | 11.9 | 31.3 | 8.1 | 0.1 | 1.3 | 11.5 |
| Sample 5 | 85 | 10 | 0 | 1.7 | 26.8 | 0.2 | 3.2 | 11.3 | 36.7 | 8.1 | 0.1 | 1.1 | 10.8 |
| Sample 6 | 85 | 13 | 0 | 1.8 | 28.5 | 0.0 | 3.8 | 12.3 | 31.0 | 8.5 | 0.1 | 1.2 | 12.9 |
| Sample 7 | 82 | 15 | 0 | 1.8 | 28.2 | 0.1 | 3.7 | 12.5 | 31.6 | 9.2 | 0.1 | 1.0 | 11.8 |
| Sample 8 | 83 | 14 | 0 | 1.4 | 30.0 | 0.0 | 3.8 | 12.8 | 30.9 | 9.0 | 0.1 | 1.1 | 10.8 |
| Sample 9 | 85 | 13 | 0 | 0.8 | 30.2 | 0.2 | 3.1 | 13.2 | 31.0 | 9.3 | 0.1 | 1.3 | 10.8 |
| Sample 10 | 84 | 15 | 0 | 1.6 | 25.6 | 0.0 | 3.2 | 11.0 | 38.9 | 8.0 | 0.1 | 1.1 | 10.6 |
| Sample 11 | 86 | 12 | 0 | 1.9 | 31.9 | 0.2 | 3.7 | 12.9 | 30.3 | 8.6 | 0.1 | 1.1 | 9.4 |
| Sample 12 | 85 | 14 | 0 | 1.3 | 31.0 | 0.1 | 3.2 | 11.2 | 29.7 | 14.2 | 0.1 | 0.9 | 8.2 |
| Sample 13 | 86 | 15 | 0 | 1.1 | 30.0 | 0.6 | 3.5 | 12.7 | 31.1 | 8.7 | 0.1 | 0.7 | 10.9 |
| Sample 14 | 86 | 16 | 0 | 0.7 | 29.9 | 0.1 | 3.4 | 13.0 | 32.5 | 9.0 | 0.1 | 1.1 | 10.3 |
| Sample 15 | 86 | 6 | 0 | 0.8 | 30.4 | 0.2 | 3.5 | 12.9 | 32.4 | 9.0 | 0.1 | 1.2 | 9.6 |
| Sample 16 | 83 | 8 | 0 | 1.5 | 29.6 | 0.0 | 3.4 | 12.8 | 30.6 | 9.2 | 0.1 | 1.3 | 11.6 |

*Water- and solids-free basis.
**Viscosity measured on oil after coke was removed.
***Residence time for continuous unit was calculated for temperatures within 5° C. of reaction temperature.

TABLE 8B

| Sample # | (1) Reactor Temp., °F. Top | (1) Reactor Temp., °F. Bottom | (2) Heater Temp., °F. (3) Top | (2) Heater Temp., °F. (3) Bottom |
|---|---|---|---|---|
| 1 | 745 | 743 | 764 | 752 |
| 2 | 747 | 750 | 777 | 763 |
| 3 | 748 | 750 | 778 | 765 |
| 4 | 758 | 759 | 788 | 779 |

TABLE 8B-continued

| Sample # | (1) Reactor Temp., °F. Top | (1) Reactor Temp., °F. Bottom | (2) Heater Temp., °F. (3) Top | (2) Heater Temp., °F. (3) Bottom |
|---|---|---|---|---|
| 5 | 766 | 767 | 794 | 788 |
| 6 | 763 | 764 | 804 | 797 |
| 7 | 764 | 764 | 802 | 797 |
| 8 | 767 | 766 | 799 | 791 |

TABLE 8B-continued

| Sample | (1) Reactor Temp., °F. | | (2) Heater Temp., °F. | |
|---|---|---|---|---|
| # | Top | Bottom | (3) Top | (3) Bottom |
| 9 | 763 | 763 | 798 | 790 |
| 10 | 764 | 765 | 802 | 797 |
| 11 | 759 | 760 | 791 | 787 |
| 12 | 764 | 765 | 804 | 801 |
| 13 | 764 | 766 | 806 | 804 |
| 14 | 765 | 768 | 796 | 792 |
| 15 | 761 | 762 | 779 | 772 |
| 16 | 760 | 756 | 770 | 763 |

(1) Bulk temperature of fluid measured at top and bottom of the lower 22 feet of reactor string.
(2) Measured with thermocouple adjacent to heater.
(3) Heater located within one foot of top and bottom of lower 22 feet of reactor string.

EXAMPLE 9

A heavy crude oil having a viscosity in excess of 200,000 cps is passed through a dewatering process to reduce the basic sediment and water (BSW) of the produced oil to less than 5 weight percent. The resulting oil is then passed into storage tanks. For convenience the storage tanks are sized to provide at least a 24 hr supply of feed oil at a use rate of 10,000 barrels per day. The treated oil is then passed from the storage system or alternatively directly from the BSW unit to the processing unit. This processing unit is located in a vertical shaft having a depth of about 4,500 ft and a finished casing diameter of 24 in. Suspended in the vertical shaft is the reactor string which consists of two concentrically oriented pipes which comprise a downcomer-riser system. Attached to the bottom of the downcomer-riser system is the reactor which consists of an inner reactor pipe and an outer reactor pipe. The downcomer pipe is a 14 in. diameter pipe. The riser pipe which is located inside the downcomer is 10 in. diameter. The outer reactor pipe has a 20 in. diameter and is 464 ft in length. The inner reactor pipe, which is located within the outer reactor pipe, is 464 ft in length with a 10 in. diameter. The inner and outer reactor pipes together comprise a reactor volume of 880 cubic ft which provides a 12 to 15 min residence time at reaction temperature and pressure with about a 2 weight percent steam and about 2 weight percent gas content of the hydrocarbon stream.

The crude oil feed enters the reactor string at about 60° C. to about 100° C. and travels downward through the annular portion of the concentric pipe downcomer-riser system. The oil is heated through indirect heat exchange with processed oil which is traveling upward in the center riser pipe. The crude oil stream is heated to within 25° C. of the reaction temperature before it enters the outer reactor pipe. Supplemental heat is supplied by means of indirect heat exchange with a high-temperature pressure-balance fluid which occupies the void volume surrounding the reactor string. With a 25° C. approach temperature at the hot end of the riser downcomer heat exchanger, the system heat duty is about 5.64 million BTU/hr. In order to account for well-casing heat losses, this value is increased by 50 percent to 8.46 million BTU/hr. A heat exchange fluid flow rate of 1,060 gal/min is required to supply this heat duty at a hot fluid-reactor approach temperature of 25° C. The heat transfer fluid is circulated via a 3 in. pipe using a 50 psi high-temperature centrifugal pump. A gas cap is maintained above the heat exchange fluid to provide the primary pressure drive forced to overcome the pressure head. A surface gas-fired tube heater rated at 8.5 million BTU/hr is used to heat the heat exchange fluid.

The crude oil feed stream which has been heated to about 375° C. and whose pressure has increased from an inlet pressure of 50 psig to a pressure of about 1500 psig enters the outer reactor pipe. The temperature of the stream is increased to a reaction temperature of about 400° C. The pressure is increased to about 1750 psig. The temperature differential between the bulk temperature of the hydrocarbon stream and the heat exchange fluid is less than 25° C. The hydrocarbon stream passes through the outer reactor pipe and into the inner reactor pipe at a flow rate which provides a total reactor residence time of about 12 minutes at a hydrocarbon stream feed rate of 10,000 barrels per day. As the processed hydrocarbon stream passes out of the inner reactor pipe and into the riser pipe, cooling of the processes stream is initiated by heat exchange contact with the incoming hydrocarbon feed stream. The temperature and pressure of the processed stream decreases as it flows upward from the reactor zone. When the processed stream exits the riser pipe the temperature is about 125° C. and the pressure is about 250 psig.

Upon leaving the reactor system the process stream is fed into a depropanizer in which the primary product is separated from propane, water, and other gases. This gas stream which amounts to about 1 million standard cubic feet per day is further processed in a sequential process stream to recover sulfur, process fuel, and natural gas in an environmentally acceptable manner. The primary product, which now has a viscosity of about 1000 cps at 25° C., is then introduced back into a transportation network for transport to a refinery or transshipment point.

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A method for improving the transportability of hydrocarbons said method comprising:

(a) flowing an influent hydrocarbon feed stream at a first temperature and a first pressure into a downcomer to form a hydrostatic pressure head and provide a pressurized feed stream at a second pressure;

(b) heating said influent stream by heat exchange with an effluent treated hydrocarbon stream wherein at least one of said streams is in turbulent flow to increase the temperature of said influent stream from said first temperature to a second temperature and provide a heated feed stream;

(c) contacting said heated and pressurized feed stream with an active heat source in a reaction zone to provide the feed stream at a reaction temperature between about 300° C. and the coking temperature of said hydrocarbons and a reaction pressure of at least about 1000 psi to form said treated hydrocarbon stream;

(d) maintaining a temperature differential between said active heat source and said feed stream in said reaction zone of less than about 30° C. to form a treated hydrocarbon stream; and (e) removing said treated stream from said reaction zone by passing said treated stream upward in a riser to form said effluent treated stream of reduced viscosity.

2. The method of claim 1 wherein said reaction pressure is between about 1000 and about 4000 psi.

3. The method of claim 2 wherein said reaction temperature is between about 350° C. and about 475° C.

4. The method of claim 2 wherein said reaction temperature is between about 375° C. and about 435° C.

5. The method of claim 1 wherein said contacting with said active heat source provides a coke make of less than about 0.5 weight percent of said hydrocarbon stream.

6. The method of claim 1 wherein said turbulent flow is multiphase flow.

7. The method of claim 6 wherein said influent stream and said effluent stream are each in multiphase flow.

8. The method of claim 1 wherein said temperature differential is less than about 15° C.

9. The method of claim 1 wherein said temperature differential is less than about 5° C.

10. The method of claim 1 wherein said hydrocarbon feed stream is selected from the group consisting of whole crude oil, kerogen, bitumen, shale oil, tar sands oil, and mixtures thereof.

11. The method of claim 1 wherein said hydrocarbon feed stream has an initial API gravity at 25° C. below about 20° and said treated hydrocarbon stream has an API gravity at least 2° higher than that of said hydrocarbon feed stream.

12. The method of claim 1 wherein said first pressure is less than about 500 psi.

13. The method of claim 1 wherein said treated hydrocarbon stream is removed from said riser and gaseous materials are separated from said stream.

14. The method of claim 1 wherein said treated hydrocarbon stream is removed from said riser and a portion of components boiling below about 40° C. are separated from said treated stream and introduced into said hydrocarbon feed stream.

15. The method of claim 1 wherein said first temperature is less than about 100° C. said first pressure is less than about 200 psi said reaction temperature is between about 350° C. and about 450° C. said reaction pressure is between about 1000 psi and about 2000 psi said second temperature is above about 250° C. and said temperature differential is less than about 25° C.

16. The method of claim 1 wherein said hydrocarbon feed stream comprises up to about 10 weight percent water.

17. The method of claim 1 wherein said treated hydrocarbon stream is removed from said riser and blended with untreated hydrocarbon.

18. The method of claim 1 wherein said hydrocarbon feed stream consists essentially of a heavy oil, water and a diluent wherein said water is present in an amount less than about 10 weight percent of said feed, and said diluent is a light fraction of hydrocarbons which is present in an amount sufficient to render said heavy oil pumpable.

19. The method of claim 18 wherein said heavy oil is whole crude oil.

20. A method for decreasing the viscosity of hydrocarbons said method comprising:

(a) providing an influent hydrocarbon feed stream at a temperature $T_1$ and a pressure $P_1$;

(b) passing said influent stream downward in a downcomer to form a hydrostatic pressure head and increase pressure on said influent stream to provide a pressurized feed stream;

(c) heating said influent stream by heat exchange contact with an effluent stream wherein said streams are in multiphase flow to increase the temperature of said influent stream from temperature $T_1$ to temperature $T_2$, which is within about 50° C. of a reaction temperature and provide a heated feed stream;

(d) contacting said heated and pressurized feed stream with an active heat source having a temperature differential between said heat source of said feed stream of less than about 30° C. in a reaction zone to provide the feed stream at a reaction temperature of between about 300° C. and the coking temperature of said hydrocarbons and a reaction pressure of at least about 1000 psi;

(e) maintaining said feed stream in said reaction zone to reduce the viscosity of said feed stream and form a treated hydrocarbon stream; and (f) removing said treated stream from said reaction zone and passing it upward as said effluent stream in a riser into said heat exchange contact with said influent stream.

21. The method of claim 20 wherein said effluent stream is removed from said riser and at least a portion of components boiling below about 40° C. are separated from said stream and are introduced into said influent feed stream.

22. The method of claim 20 wherein said effluent stream is removed from said riser and is blended with untreated heavy oil to reduce the viscosity of said heavy oil.

23. The method of claim 20 wherein said hydrocarbon feed is selected from the group consisting of whole crude oil, bitumen, kerogen, shale oil, tar sands oil, and mixtures thereof.

24. The method of claim 20 wherein said reaction temperature is between about 350° C. and about 475° C. and said reaction pressure is between about 1000 psi and about 2000 psi.

25. The method of claim 20 wherein said reaction pressure is between about 1000 psi and 4000 psi.

26. The method of claim 20 wherein said hydrocarbon feed consist essentially of a heavy oil, water and a diluent, wherein said water is present in an amount less than about 10 weight percent of said feed and said diluent is a light fraction of hydrocarbons which is present in an amount sufficient to render said heavy oil pumpable.

27. The method of claim 26 wherein said heavy oil is whole crude oil.

28. The method of claim 20 wherein said temperature differential is less than about 15° C.

* * * * *

UNITED STATES PATENT AND TRADEMARK OFFICE

CERTIFICATE OF CORRECTION

PATENT NO. : 4,778,586

DATED : October 18, 1988

INVENTOR(S) : Bain et al.

It is certified that error appears in the above—identified patent and that said Letters Patent is hereby corrected as shown below:

Column 10, line 7, please delete the letter "s" from the word hours.

Column 19, Table 1C, in the first line of the headings please delete "IPB" and insert -- IBP -- therefor.

Column 47, line 36, please delete "Exch" and insert -- Each -- therefor.

Note:

Column 32, line 33, is a continuation of Table 2B.

Column 43, last line of the column, should follow the term "Heavier Fractions" in Table 4B.

Signed and Sealed this

Seventh Day of March, 1989

*Attest:*

DONALD J. QUIGG

*Attesting Officer*

*Commissioner of Patents and Trademarks*